US011551614B2

(12) United States Patent
Berget et al.

(10) Patent No.: US 11,551,614 B2
(45) Date of Patent: Jan. 10, 2023

(54) ENCODING DEMURA CALIBRATION INFORMATION

(71) Applicant: SYNAPTICS INCORPORATED, San Jose, CA (US)

(72) Inventors: Damien Berget, Sunnyvale, CA (US); Hirobumi Furihata, Tokyo (JP); Joseph Kurth Reynolds, San Jose, CA (US); Takashi Nose, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 251 days.

(21) Appl. No.: 16/488,520

(22) PCT Filed: Feb. 23, 2018

(86) PCT No.: PCT/US2018/019578

§ 371 (c)(1),
(2) Date: Aug. 23, 2019

(87) PCT Pub. No.: WO2018/156999

PCT Pub. Date: Aug. 30, 2018

(65) Prior Publication Data

US 2021/0134221 A1 May 6, 2021

Related U.S. Application Data

(63) Continuation of application No. 15/594,327, filed on May 12, 2017, now Pat. No. 10,176,761, and a
(Continued)

(51) Int. Cl.
*G09G 3/20* (2006.01)
*G09G 3/3258* (2016.01)
(Continued)

(52) U.S. Cl.
CPC ..... *G09G 3/3258* (2013.01); *G09G 3/2011* (2013.01); *G09G 3/3275* (2013.01);
(Continued)

(58) Field of Classification Search
CPC .. G09G 3/3258; G09G 3/3291; G09G 3/2011; G09G 5/395; G09G 2310/027;
(Continued)

(56) References Cited

U.S. PATENT DOCUMENTS 6,034,724 A 3/2000 Nakamura
7,012,626 B2 3/2006 Shingai et al.
(Continued)

FOREIGN PATENT DOCUMENTS

CN 106339196 A 1/2017
JP H4177916 A 6/1992
(Continued)

OTHER PUBLICATIONS

International Search Report and Written Opinion Application No. PCT/US2018/019578, dated Nov. 27, 2018, consists of 14 pages.
(Continued)

*Primary Examiner* — David Tung
(74) *Attorney, Agent, or Firm* — Ferguson Braswell Fraser Kubasta PC

(57) ABSTRACT

A system and method for encoding, transmitting and updating a display based on demura calibration information for a display device comprises generating demura correction coefficients based on display color information, separating coherent components from the demura correction coefficients to generate residual information, and encode the residual information using a first encoding technique. Further, the image data may be divided into data streams, compressed and transmitted to from a host device to a display driver of a display device. The display driver decom-
(Continued)

presses and drives subpixels of the pixels in based on the decompressed data. The display driver updates the subpixels of a display using corrected greyscale values for each subpixel are determined from the decompressed data.

10 Claims, 47 Drawing Sheets

Related U.S. Application Data continuation of application No. 15/594,203, filed on May 12, 2017, now Pat. No. 10,706,779.

(60) Provisional application No. 62/462,586, filed on Feb. 23, 2017.

(51) Int. Cl.
*G09G 3/3291* (2016.01)
*G09G 3/3275* (2016.01)
*G09G 5/395* (2006.01)

(52) U.S. Cl.
CPC ..... *G09G 3/3291* (2013.01); *G09G 5/395* (2013.01); *G09G 2300/0439* (2013.01); *G09G 2310/027* (2013.01); *G09G 2320/0271* (2013.01); *G09G 2320/0285* (2013.01); *G09G 2320/0626* (2013.01); *G09G 2330/028* (2013.01); *G09G 2340/02* (2013.01); *G09G 2350/00* (2013.01)

(58) Field of Classification Search
CPC ... G09G 2320/0285; G09G 2320/0626; G09G 2320/0271; G09G 2340/02; G09G 2350/00; G09G 2330/028; G09G 2300/0439
See application file for complete search history.

(56) References Cited

U.S. PATENT DOCUMENTS

| | | | | |
|---|---|---|---|---|
| 7,623,108 | B2 | 11/2009 | Jo et al. | |
| 7,859,492 | B2 | 12/2010 | Kohno | |
| 8,022,908 | B2 | 9/2011 | Mizukoshi et al. | |
| 8,149,190 | B2 | 4/2012 | Mizukoshi et al. | |
| 8,291,129 | B2 | 10/2012 | Tamatani | |
| 2007/0153021 | A1 | 7/2007 | Umeda et al. | |
| 2009/0027410 | A1 | 1/2009 | Inuzuka | |
| 2010/0134468 | A1 | 6/2010 | Ogura et al. | |
| 2011/0148942 | A1 | 6/2011 | Furihata et al. | |
| 2012/0044216 | A1 | 2/2012 | Furihata et al. | |
| 2012/0120043 | A1 | 5/2012 | Cho et al. | |
| 2012/0154453 | A1 | 6/2012 | Yamashita et al. | |
| 2013/0321678 | A1 | 12/2013 | Cote et al. | |
| 2014/0022221 | A1 | 1/2014 | Furihata et al. | |
| 2014/0104249 | A1 | 4/2014 | Furihata et al. | |
| 2014/0146098 | A1 | 5/2014 | Furihata et al. | |
| 2014/0355897 | A1 | 12/2014 | Tourapis | |
| 2015/0187306 | A1* | 7/2015 | Syu | G09G 3/3655 345/87 |
| 2015/0187328 | A1* | 7/2015 | Kim | G09G 5/02 345/690 |
| 2015/0228215 | A1 | 8/2015 | Nose et al. | |
| 2015/0279325 | A1* | 10/2015 | Lu | G09G 5/18 345/690 |
| 2015/0356899 | A1* | 12/2015 | Yamanaka | G09G 3/3258 345/77 |
| 2016/0035293 | A1 | 2/2016 | Furihata et al. | |
| 2016/0301950 | A1 | 10/2016 | Jacobson et al. | |
| 2018/0191371 | A1* | 7/2018 | Tao | G06F 3/147 |

FOREIGN PATENT DOCUMENTS

| | | | |
|---|---|---|---|
| JP | H6237448 | A | 8/1994 |
| JP | 2010237528 | A | 10/2010 |

OTHER PUBLICATIONS

International Report on Patentability Application No. PCT/US2018/019578, dated Sep. 6, 2019, consists of 10 pages.
Notice of Reasons for Refusal for Application No. 2019-545260, mailed from the Japanese Patent Office dated Oct. 27, 2021, with translation, 11 pages.

* cited by examiner

| SYMBOL | HUFFMAN CODE | NUMBER OF BITS |
|---|---|---|
| 0 | 0 | 1 |
| 1 | 10 | 2 |
| −1 | 110 | 3 |
| 2 | 1110 | 4 |
| −2 | 11110 | 5 |
| OTHERS (−127~127) | 11111xxxxxxx | 13 |

FIG. 8

$AX_0 = X_{CP}(2k)$
$AX_0 = X_{CP}(2k+1)$
$AX_0 = X_{CP}(2k+2)$
$Y_{X0} = Y_{CP}(2k)$
$BY_0 = Y_{CP}(2k+1)$
$CY_0 = Y_{CP}(2k+2)$

AX0=XCP(2k)
BX0=XCP(2k+1)
CX0=XCP(2k+2)
AY0=YCP(2k)
BY0=YCP(2k+1)
CY0=YCP(2k+2)

ENCODING DEMURA CALIBRATION INFORMATION

CROSS-REFERENCE TO RELATED APPLICATIONS

This application claims benefit of PCT Application No. PCT/US2018/019578, filed Feb. 23, 2018 which claims priority from U.S. Provisional Application No. 62/462,586 filed Feb. 23, 2017, which claims priority from U.S. application Ser. No. 15/594,327 filed May 12, 2017, which claims priority from U.S. application Ser. No. 15/594,203 filed May 12, 2017, which are incorporated by reference in their entirety

FIELD

Embodiments of the present disclosure generally relate to display devices, and in particular, to compression of demura calibration information for display devices.

BACKGROUND

Production variations during display device manufacturing often cause poor image quality when displaying an image on the display panel of the display device. Demura correction may be utilized to minimize or correct such image quality issues. Demura correction information may correct for power law differences between pixels due to production variations. The demura correction information may be stored within a memory of a display driver. However, display driver memory is expensive, increasing the cost of the display driver. Although the demura correction information may be compressed to reduce the amount of memory needed for storage, there is a desire to further reduce the amount of memory required to store the compressed demura correction information.

Hence, there is a need for improved techniques to reduce the amount of memory required to store the demura correction information.

SUMMARY

In one or more embodiments, a method for encoding demura calibration information for a display device comprises generating demura correction coefficients based on display color information, separating coherent components from the demura correction coefficients to generate residual information, and encoding the residual information using a first encoding technique.

In one or more embodiments, a display device comprises a display panel comprising subpixels of pixels, a host device, and a display driver. The host device is configured to divide original data respectively associated with the subpixels of the pixels into data streams, generate compressed data streams from the data streams, divide each of the compressed data streams into blocks, and sort the blocks. The display driver is configured to drive the display panel. The display driver comprises a memory configured to store the sorted blocks sequentially received from the host device, decompression circuitry configured to perform a decompression process on the blocks to generate decompressed data, and drive circuitry configured to drive the subpixels of the pixels based on the decompressed data.

In one or more embodiments, a display driver for driving a display panel includes a plurality of pixel circuits, a voltage data generator, and driver circuitry. The voltage data generator circuit is configured to calculate a voltage data value from an input grayscale value with respect to a first pixel circuit of a plurality of pixel circuits. The voltage data generator circuit comprising a basic control point data storage circuit configured to store basic control point data which specify a basic correspondence relationship between the input grayscale value and the voltage data value, a correction data memory configured to hold correction data for each of the plurality of pixel circuits, a control point calculation circuit configured to generate control point data associated with the first pixel circuit by correcting the basic control point data based on the correction data associated with the first pixel circuit, and a data correction circuit configured to calculate the voltage data value from the input grayscale value based on a correspondence relationship specified by the control point data. The driver circuitry configured to the display panel based on the voltage data value.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 8 illustrates an example of a code allocation in Huffman coding;

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Demura Calibration and Encoding

Figure 1:
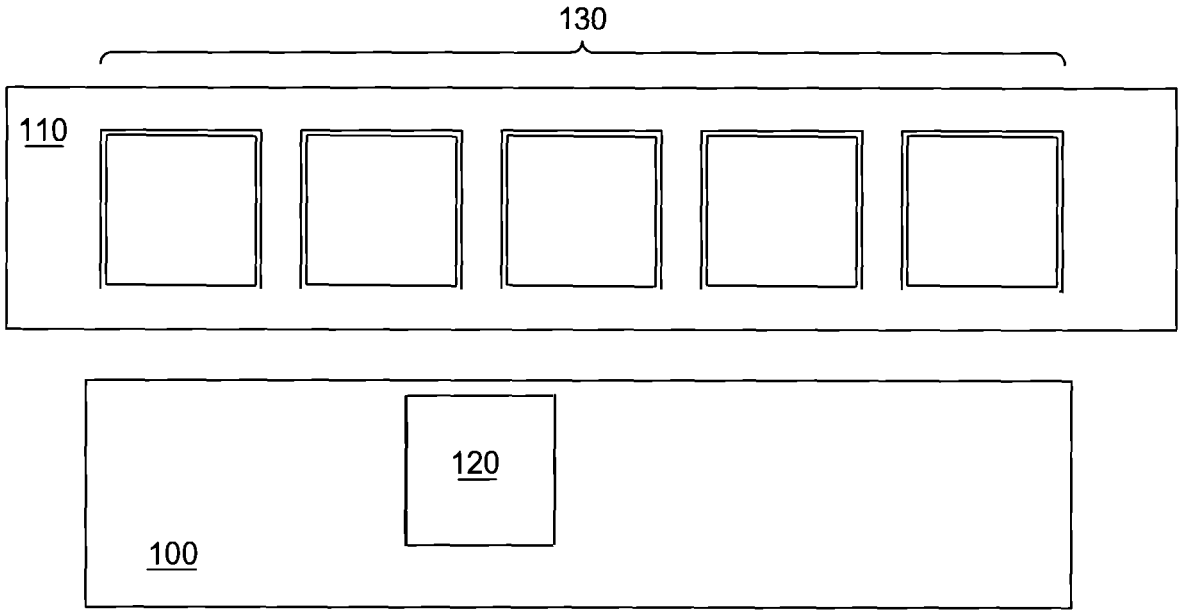
FIG. 1 illustrates an example image acquisition device according to one or more embodiments.

FIG. 1 illustrates an optical inspection system 100 for a display product line 110. In one embodiment, the optical inspection system 100 includes camera device 120 configured to image display panels of display devices 130 within the display production line 110. Display devices may include one or more memory elements (not shown) and the optical inspection system 100 is configured communicate with the one or more memory elements of the display device 130. In one or more embodiments, camera device 120 includes at least one high resolution camera configured to image an entire display panel to acquire luminosity of each sup-pixel within each display panel. In one specific example, a 4×4 equivalent camera pixel per original pixel is employed. In such embodiments, calibration of a display panel may include image for each corresponding color channel. For example, for a display panel comprising red, green, and blue subpixels (a red channel, green channel, and blue channel), an image of each color at various levels may be acquired by the camera device 120. In other embodiments, the display panel may comprise different subpixel arrangements, and accordingly, images of each subpixel type may be acquired a different levels. For example, the display panel may include pixels having 4 or more subpixels. In one particular embodiment, each pixel may include a red subpixel, a green subpixel, a blue subpixel and at least one of a white subpixel, and a yellow subpixel, and another blue subpixel.

Further, in some embodiments, a camera device 120 having multiple cameras may be used to acquire various images of the display panel which then may be combined together to create a single image of the display panel. In one embodiment, each of the images may be individually used for calibration of the display panel without combining the images. The camera device 120 may include one or more CCD cameras, colorimeters, or the like. In one or more embodiments, the acquisition time of the images by the camera device 120 is set based on the screen refresh time.

For example, the acquisition time may be set to be at least about an integer number of the screen refresh time to ensure that the resulting extraction is free from darker regions caused by a rolling refresh.

Display data may be divided into one or more streams corresponding to different subpixel types. For example, a first data stream corresponds to a red data channel, a second data stream corresponds to a green data stream, and a third data stream for a blue data stream. In other embodiments, a display panel may include more than three subpixel types and, accordingly, more than three data streams. For example, there may be an additional green data channel, a yellow data channel, and/or a white data channel. Further, in various embodiments, each stream of data may be encoded based on one or more compression techniques.

In one embodiment, first subpixel data may be encoded with a first technique and second subpixel data may be encoded with a second technique, where the first and second techniques differ. Further, first data subpixel data and second subpixel data may be encoded with a first encoding technique and third subpixel data is encoded with a second encoding technique different than the first. In one embodiment, a blue subpixel data is encoded such that the data is more highly compressed than the green subpixel data. Further, red subpixel data may be more highly compressed than the green subpixel data. In one embodiment, green subpixel data is more highly compressed that white or yellow subpixel data. Further, the compression applied to each subpixel color may be variable.

Figure 2:
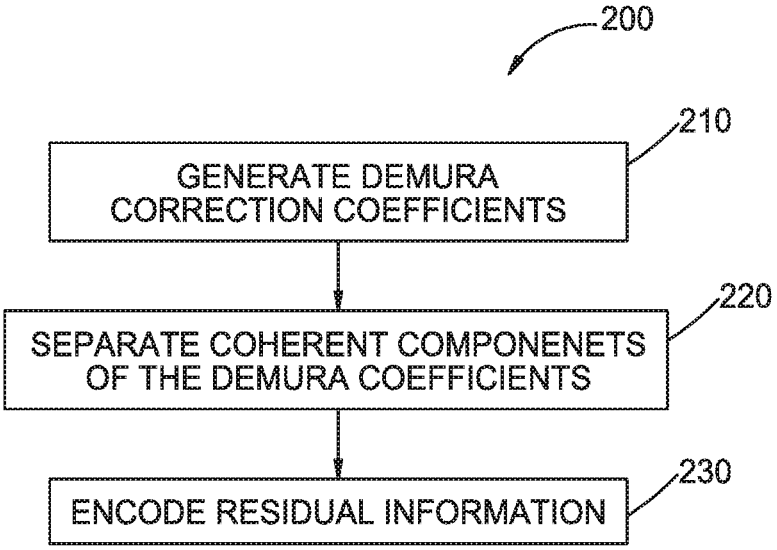
FIG. 2 illustrates a method for compressing demura correction information according to one or more embodiment.

FIG. 2 illustrates flow chart illustrating a method 200 for encoding demura calibration information. The demura calibration information is generated based on various brightness levels for each subpixel of a display panel. In one embodiment, the demura calibration information is encoded using one or more encoding methods and stored within a memory of a display driver of the display device.

At step 210 of method 200, the demura correction coefficients are generated. In one embodiment, generating the demura correction coefficients comprises acquiring subpixel data and building a pixel luminance response for each subpixel type of a display panel. The pixel luminance response may be a measurement based pixel response. Further, in one embodiment, the pixel luminance response may include a parameter map for each subpixel type. In one embodiment, multiple brightness levels for each subpixel type are acquired by an image acquisition device such as the camera device 120. Each subpixel type may be driven according to one or more brightness codes to display each brightness level. In one embodiment, the brightness levels include 8 levels. In other embodiments, more than 8 levels may be used, or less than 8 levels may be used.

As described above, the subpixel types include one or more colors of subpixels. For example, the subpixel types may include at least red, green, and blue subpixels. In other embodiments, the subpixel types may additionally include white subpixels, second green subpixels and/or yellow subpixels. The number of images acquired may vary based on the number of subpixel types of a display panel, and the number of brightness levels. In one embodiment, a display panel comprises three different subpixel types, and each subpixel is driven with 8 levels, for a total of 24 images.

In one or more embodiments, the pixel luminance response may be created using a tri-point method. Further, the pixel luminance response may be used to generate correction images based on luminosity maps generated for each of the subpixel types. The pixel luminance response may be configured corresponding to the capability of the display driver of the display panel under calibration. For example, each subpixel may be represented using 1, 2, 3, or more parameters, and the number of parameters may be selected based on the capability of the corresponding display driver. In one or more embodiments, the model parameters may be extracted after the pixel luminance response is built. For example, a tri-point method may be employed to extract the model parameters. In various embodiments, after the model parameters are extracted, model parameter maps for each subpixel may be generated.

Figure 3:
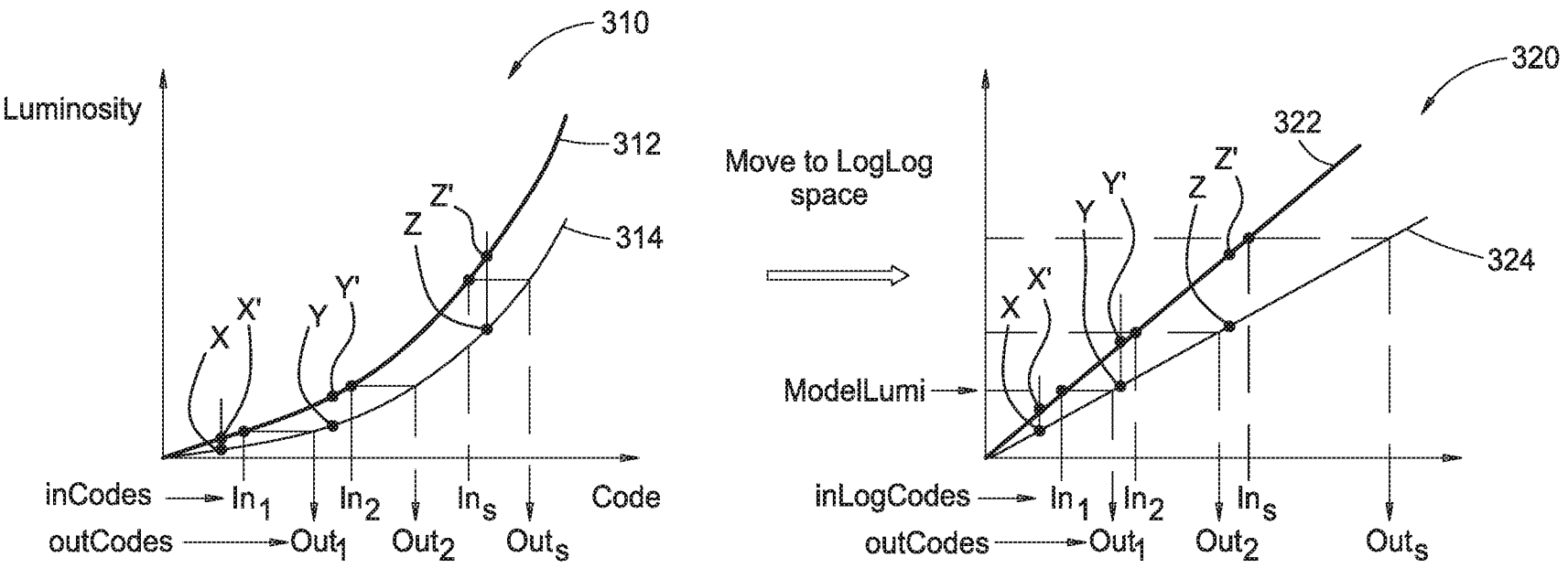
FIG. 3 illustrates luminosity curves according to one or more embodiments.

In one embodiment, generating a pixel luminance response includes generating one or more pixel luminance response images. The pixel luminance response images may be bitmap images that are configured to appear perfectly flat when displayed on a display panel. For example, the pixel luminance response images may be selected such that each pixel is configured to display about the same luminosity of a target curve for a chosen code. Graph 310 of FIG. 3 illustrates the input codes, inCodes or Cin ($In_1$, $In_2$, and $In_3$ on Curve 312), and the corrected codes, outCodes or Cout ($Out_1$, $Out_2$, and $Out_3$ on Curve 314), for subpixels of a particular type. Curve 312 represents the target luminosity and curve 314 represents the output luminosity after performing the demura calibration. In one embodiment, as each pixel is a different power, the codes are altered to ensure that outputted codes match the requested codes. For example, if a first subpixel is requested to output a first brightness, the corrected codes for the first subpixel ensure that the first brightness is outputted by the first pixel. As the actual brightness differs from the expected brightness, the corrected codes increase and/or decrease the value of the requested brightness based on measured brightness levels for each subpixel, to ensure that when the subpixels are driven, they output the expected brightness level, or a brightness level with a threshold value of the expected brightness level.

The pixel luminance response is represented by this "in" to "out" code transformation. In various embodiments, only a few images are acquired by the image acquisition device such as the camera device 120 (e.g., measurement points X, Y, and Z on curve 314 in Graph 310), and the exact "in" and "out" code values may not be measured. As such, interpolation and/or extrapolation of both curves may be used to extract the pixel luminance response images.

Graph 310 illustrates the pixel luminosity pre-loglog space, i.e., the original code and luminosity space, and graph 320 illustrates the pixel luminosity after the curves are converted to a log-log space. As can be seen, the target luminosity (curve 312) and the pixel luminosity (curve 314) in graph 310 are linear in graph 320 (curve 322 and curve 324), and a straight line may be used to interpolate between points or to extrapolate before the first point or after the last point on the curves. In one or more embodiments, interpolation is performed on any two points on the curves, for example In2 and Out 2 on curves 312 and 314. In one or more embodiments, extrapolation is performed before the first point or the lowest point on the curves, for example measurement point X on curve 314 or target point X' on curve 312. Extrapolation may also be performed after the last point or the highest point on the curves, for example measurement point Z on curve 314 or target point Z' on curve 312. In one or more embodiments, other techniques for interpolation and extrapolation can be used to compute Cout from Cin using both pixel and target curves in the pre-loglog space or the loglog space.

Each of the subpixel model parameters may be extracted from the pixel luminance response representations, which represents a perfect demura correction for each pixel of the display panel. However, memory space within the display driver of the display panel may often be too small to store the unaltered and complete pixel luminance response representations. To accommodate for the limited memory space within the display driver, the pixel luminance response representations may be approximated, reducing the amount of memory space required to store the pixel luminance response representations.

In one embodiment, the pixel luminance response representation may be approximated through the use of polynomial equations to represent each "code in" or "inCodes" ($C_{in}$) to "code out" or "outCodes" ($C_{out}$) curve. In such an embodiment, as the number of polynomial coefficients available increases, the model prediction tracks the computed curve more accurately, resulting in the increased accuracy of the model prediction.

For example, for a single coefficient (Offset), $C_{out}$ may be determined based on $C_{out}(C_{in})=C_{in}+\text{Offset}$. For two coefficients (Scale and Offset), $C_{out}$ may be determined based on $C_{out}(C_{in})=C_{in}+\text{Offset}$. For two coefficients (Quadratic and Scale), $C_{out}$ may be determined based on $C_{out}(C_{in})=\text{Quadratic}*C_{in}^2+\text{Scale}*C_{in}$. Further, for three coefficients (full quadratic), $C_{out}$ may be determined based on $C_{out}(C_{in})=\text{Quadratic}*C_{in}^2+\text{Scale}*C_{in}+\text{Offset}$. In other embodiments, greater than three coefficients may be employed. In various embodiments, the number of coefficients may be based on the size of the memory within the display driver. For display drivers having larger memories, more coefficients may be employed. In some embodiments, a least mean square method, or a weighted method may be used to determine the parameters.

In various embodiments, to achieve a uniform display screen a target pixel luminosity is computed, and the target pixel luminosity may be then used as a template to a change all pixel responses for the display panel. In one embodiment, the target pixel luminosity may be computed from the luminance images. In another embodiment, the target pixel luminosity may be set to a theoretical curve. The relative amplitude (a) may be extracted based on an average of the center area of each color. For example, expression 1 may be used to determine the target pixel luminosity:

$$\text{TargetLumi}_{RGB}(\text{Code})=\alpha_{RGB}(\text{Code})^{2.2}. \quad 1$$

In expression 1, 2.2 represents the selected gamma curve. In other embodiments, where a different gamma curve is selected, 2.2 may differ.

Figure 4:
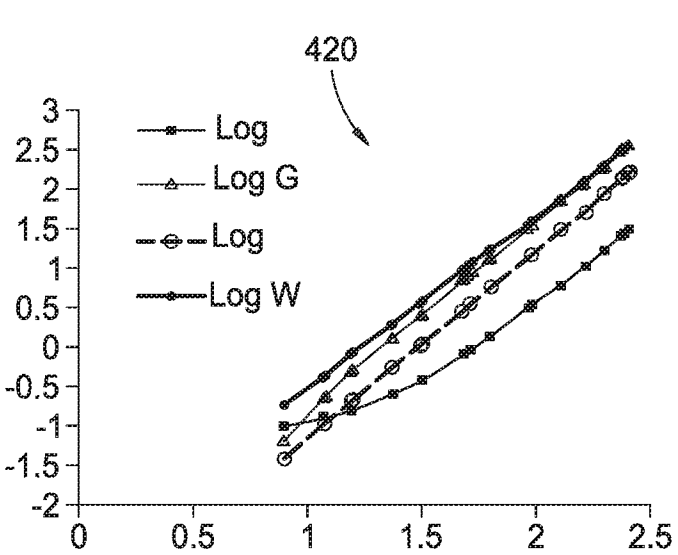
FIG. 4 illustrates gamma curves according to one or more embodiments.
Figure 4:
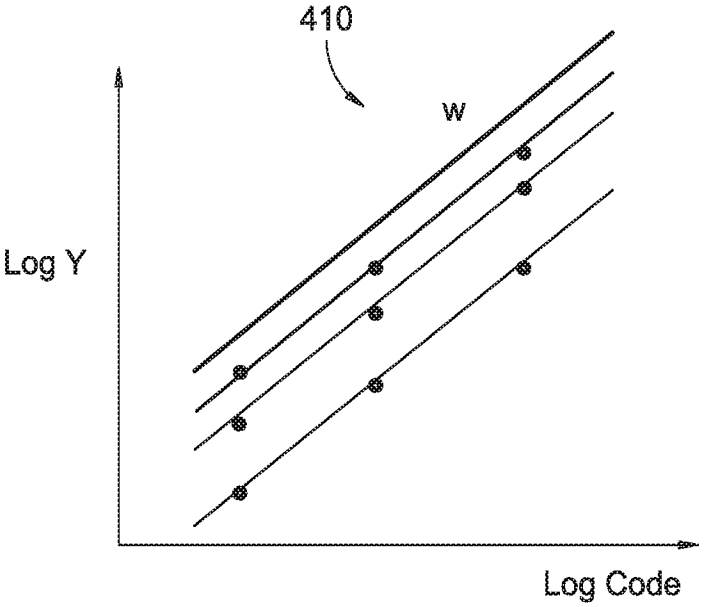

However, in various embodiments, even after performing gamma and white point tuning, individual pixel luminosity functions may not follow an exact exponential curve. For example, while a white level of a display panel may be set to an exact gamma curve, the individual colors may follow a slightly different curve. As shown in FIG. 4, graph 410 illustrates a theoretical perfect pixel function. However, as the code changes, the individual colors may follow a slightly different curve. The different curves for the different color subpixels are shown in by graph 420 of FIG. 4. In such an embodiment, as the individual color curves may be extracted from the images captured by the image acquisition device such as the camera device 120 as the demura compensation method corrects for the uniformity within each of the curves.

Figure 5:
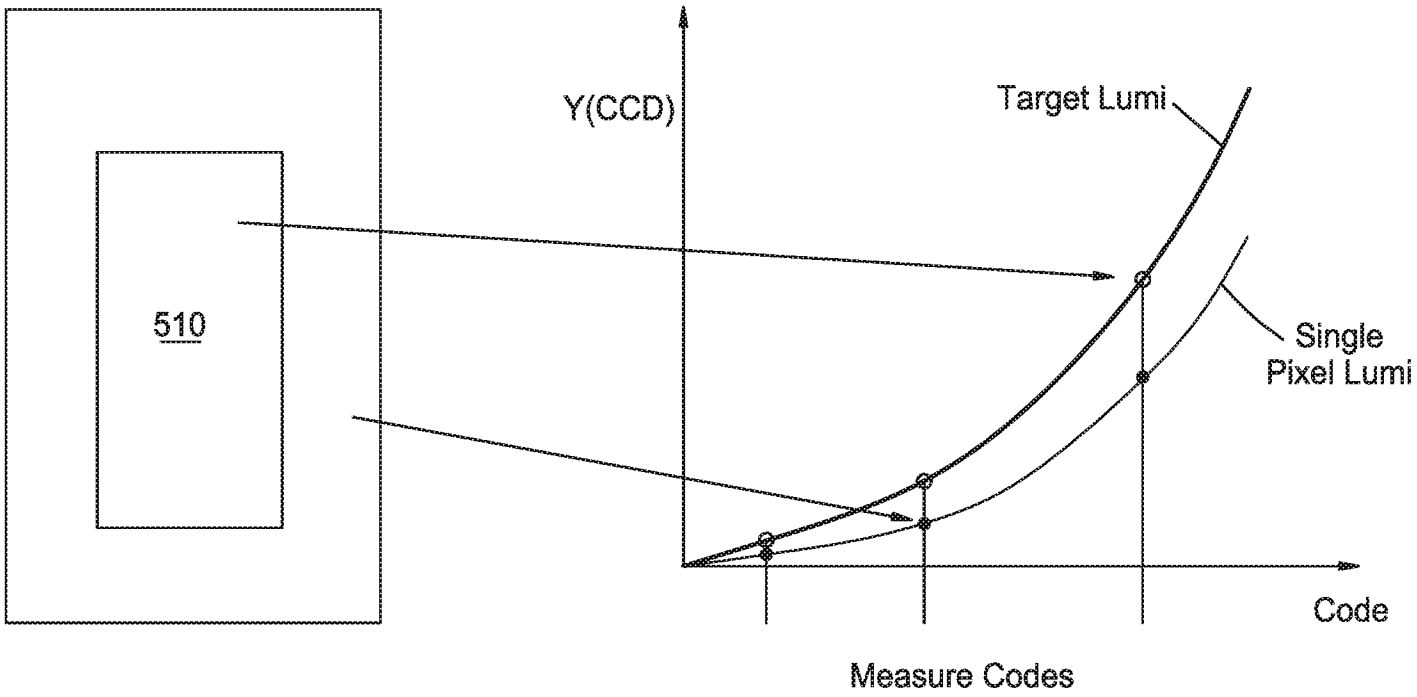
FIG. 5 illustrates an example luminosity determination according to one or more embodiments.

In one embodiment, to extract the target curve a single curve may be determined for all pixels. As shown in FIG. 5, the curve may be determined based on a median or average of at least a portion of the display panel (e.g. the location where the panel Gamma is tuned by equipment to meet manufacturing purposes). For example, as shown in FIG. 5, a center area 510 where the gamma is set before demura calibration may be used. While a center area is shown in FIG. 5, in other embodiments, other portions of the display panel may be used to provide a target for each row (horizontal line) of the display. In one or more embodiments, the full area of the display panel may be used. In yet other embodiments, multiple target curves may be determined from various different portions of the display panel. In one embodiment, different target luminance depends on the location of a subpixel (e.g. the horizontal line). In one or more embodiments, each pixel on a horizontal line follows a local curve for a horizontal band centered on the pixel representing the local horizontal target.

Returning to FIG. 2, at step 220 of method 200, coherent spatial components of the model coefficient map are separated from high spatial frequency portion of the demura coefficient map. The high spatial frequency portion may be the localized features (e.g. single sub-pixel) of the demura coefficient map. In one embodiment, separation of the coherent components includes separating one or more baselines of the model coefficient map. In another embodiment, separation of the coherent components includes separating a first and second profile (e.g. pixel row and/or column) of the model coefficient map. In an embodiment, separation of the coherent components includes separating one or more baselines and separating profiles of model coefficient map. Separating the coherent components generates residual high frequency information. The residual information may be referred to as prediction error of the baseline model.

In one or more embodiments, the baselines are spatially averaged baselines. Further, separating the baselines of the model coefficient map includes removing the local average coefficients. In one embodiment, separating the baseline includes separating two components within the coefficient spatial map. For example, the low frequency (large features) variation over the whole screen (called baseline) and a "sand/white" noise closer to random for each individual pixel level which can be separately compressed and stored.

In one embodiment, the baselines may be stored uncompressed. In other embodiments, the baselines may be encoded after they are separated from the coherent components. In one or more embodiments, the baseline may be encoded using a pitch grid and interpolation. In one embodiment, the size of the pitch grid may be from about 4×4 pixels to 32×32 pixels. The larger the size of the pitch grid, the greater compression of the baselines.

Figure 6:
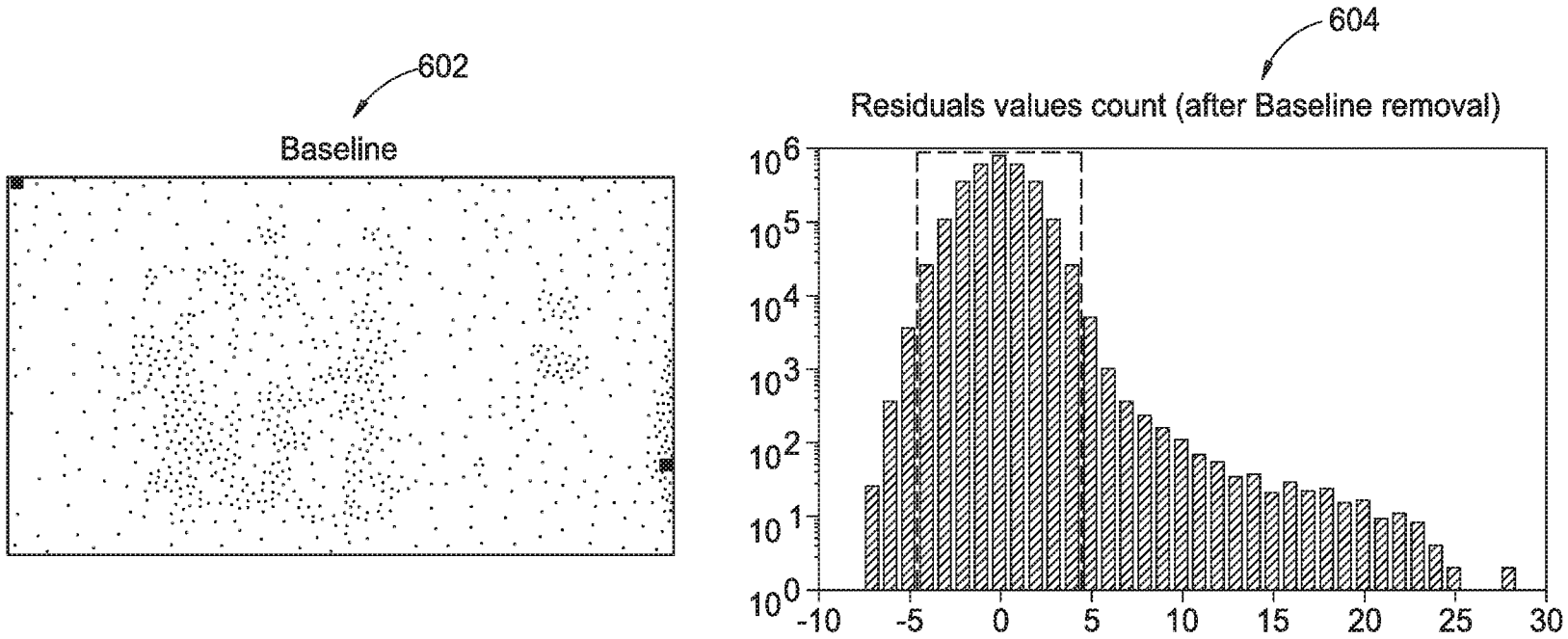
FIG. 6 illustrates an example of a baseline according to one or more embodiments.

As is stated above, separating the coherent components from the model parameters generates residual information. FIG. 6 illustrates an example baseline 602 and residual counts 604 after the baseline is removed. The baseline 602 removes the "smoothness" from the model parameters, generating prediction error, which may be referred to as residual information. In one or more embodiments, the baseline dynamic is small. For example, the baseline dynamic may be about 5 counts. Further, the residual information may be in the −4 to +4 range account for 99.0% of the pixels.

In one embodiment, to separate the baselines, an average or a median over the area covered by a grid step may be used. In one embodiment a spatial filter may be applied to remove any artifacts introduced by any outliers. Further, various interpolation techniques may be employed to restrict the size of the demura correction image. For example, the interpolation techniques may include a closest neighbor value, bi-linear interpolation, bi-cubic interpolation, or a spline interpolation.

In one or more embodiments, variations in the source lines and/or gate lines of the display panel may be detected (e.g. by averaging across a line) and stored as row or column profiles (e.g. line or source mura). As the gate lines and sources are typically disposed along vertical and horizontal directions, the profiles may be referred to as vertical and horizontal profiles. However, depending on the direction of the repeating noise, profiles along different directions may be determined. In one embodiment, the detected features are vertical and horizontal lines created by variation in the source lines and the gate lines of the display panel. However, it is possible to identify a repeating noise that varies in amplitude with the pixel value request and remove those spatial component before encoding the residual variation.

The profiles determined from the identified and extracted noise, are stored and applied to all pixels depending on the original values of the pixels. In one embodiment, the profiles may be stored uncompressed. In other embodiment, the profiles may be encoded before they are stored.

In one embodiment, both baselines and profiles may be separated from the model parameters. In such an embodiment, the profiles maybe separated after the baselines are separated. For example, after the baselines are separated from the model characteristics, the coherent high frequency features may remain which may be difficult to encode efficiently. Profiles may be used to separate these features from the model parameters. In other embodiments, only one of baselines and profiles may be used.

In one embodiment, a different baseline may be applied to each subpixel type. For example, a first baseline may be applied to red subpixels, a second baseline may be applied to green subpixels, and a third baseline may be applied to blue subpixels. In one embodiment, at least two of the baselines may be similar. Where the baselines are similar, a baseline of one set of subpixels may be stored as a difference from another set to reduce dynamic range and improve compression ratio or accuracy.

Returning to FIG. 2, further, at step 230, the residual information is encoded using encoding technique different from that used to encode the coherent components. For example, the residual information may be encoded using a lossy compression technique. In one embodiment, all the residual information be compressed using a common compression technique. In other embodiments, at least a portion of the residual information is compressed using a different compression technique than another portion of the residual information.

In various embodiments, a Huffman tree encoding may be employed. In other embodiments, other types of encoding techniques may be used. In one or more embodiment, run length encoding (RLE) may be employed alternatively to or in addition to the Huffman tree encoding. Other encoding methods such as multi-symbol Tunstall codes or Arithmetic coding (e.g. with stored state) may be used.

Flash binary image is built from the encoded residual information and the baselines and/or the profiles. In one embodiment, the flash binary image is formed based on the baseline data, the vertical and horizontal profile data, and, if available, the encoded residual information (e.g., prediction error). In one embodiment, a Huffman tree configuration may be used to build the flash binary image.

The binary image is communicated from the image acquisition device such as the camera device 120 to the display driver of each display device 130. In one embodiment, each display driver is communicatively coupled to the image acquisition device during calibration. Such a configuration provides a communication path between the image acquisition device and the display driver of each display device 130 to transfer the binary image to the display driver.

Figure 7:
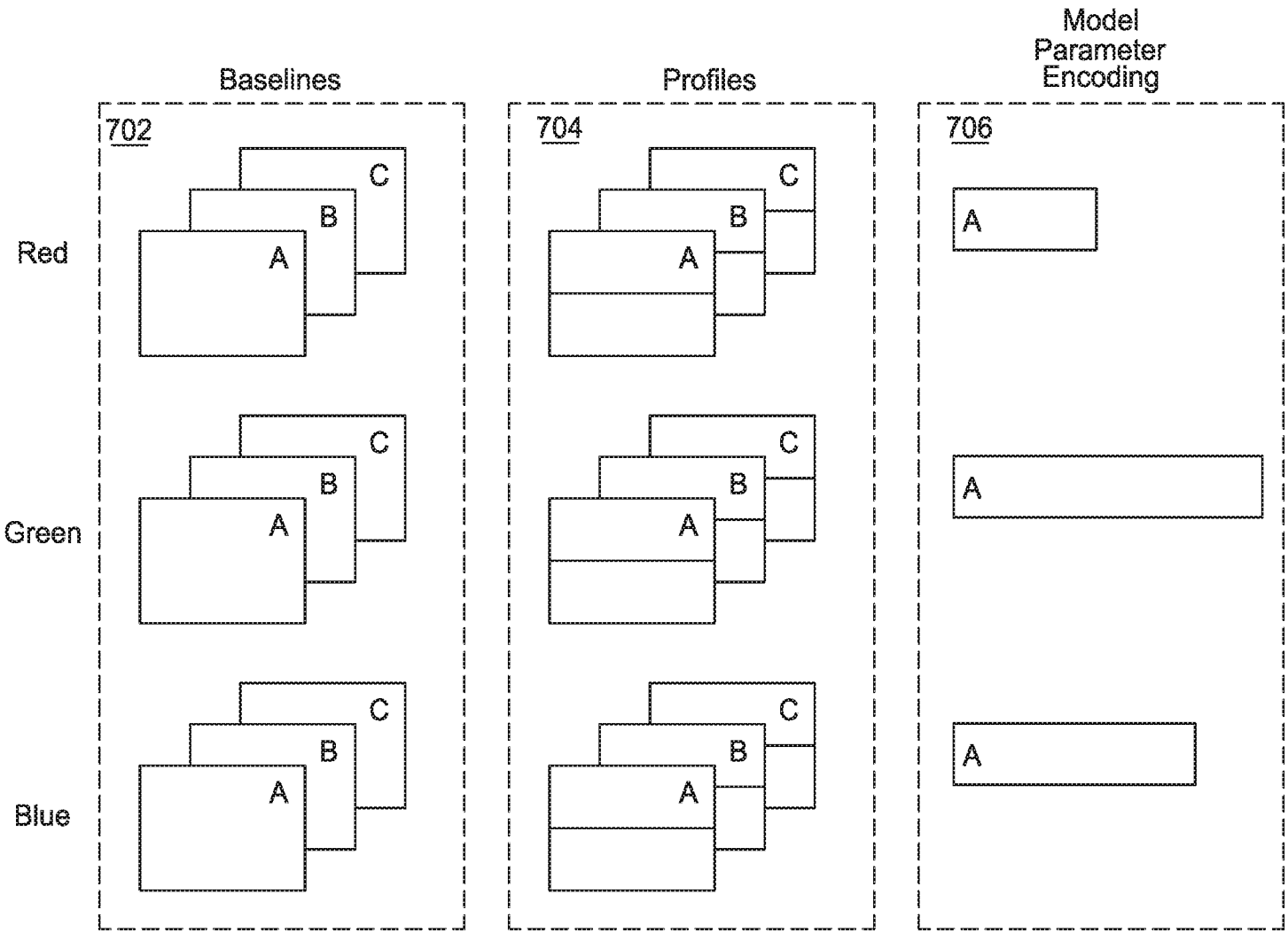
FIG. 7 illustrates example information contained within a binary image according to one or more embodiments.

FIG. 7 illustrates an example of the compressed data within a binary image. In the illustrated embodiment, compressed data is shown for red, green and blue subpixel types. However, in other embodiments, one or more additional subpixel types may be included. Model parameters A, B, and C, are illustrated for each of the red, green and blue subpixels. As illustrated by 702, for each subpixel type, three different baselines may be separated from the model parameters. For example, for the red subpixels, a first baseline maybe separated from the A parameter, a second baseline may be separated from the B parameter, and a third baseline may be separated from the C parameter (e.g., also green and blue). Further, different baselines may be applied to each parameter of each subpixel type.

As is further illustrated in FIG. 7 at 704, profiles are removed from each model parameter of each subpixel type. The profiles may be as are described above. For example, a vertical and horizontal profile may be separated from model parameter after the baselines have been removed. As shown in portion 706, residuals of one or more model parameters may be encoded using an encoding technique. The encoding technique may be one of a Huffman encoding technique or similar encodings mentioned above. As is illustrated, "A" model parameter residuals of the green subpixels are less compressed (e.g. improved accuracy with lower error) than the corresponding model parameter residuals of the red and blue subpixels. Further, "A" model parameter residuals of the blue subpixels are less compressed than the corresponding model parameter residuals of the red subpixels. As illustrated in FIG. 7, the size of the corresponding rectangle for each of the model parameter residuals corresponds to the "byte size" of that encoded information. Further, while only the "A" model parameter residuals are illustrated as being compressed, in other embodiments, any combination of the model parameters residuals may be compressed.

The baselines, profiles and encoded parameter residuals may be combined into a binary image for storage within the display driver of a display device. For example, the baseline data, profile data and encoded data for each subpixel type may be combined together to form the binary image.

In one embodiment, the binary image includes a header indicating the encoding values, lookup tables, and configuration of the corresponding data. Further, the compression data may include the baseline data and the compressed bit streams. In one specific example, the header may indicate Huffman tree values, lookup tables and Mura block configuration. The compression data may include baseline and Merged and reordered Huffman bit streams. The words for each decoder may be provided using a just in time (JIT) scheme. In various embodiments, as each color channel may have a different bitrate value, the next word may be determined at file creation.

Transmission of Compressed Image Data

In a display system including a display panel, data associated subpixels of respective pixels are transmitted to a display driver which drives the display panel. The data may include, for example, image data specifying the grayscale values of the respective subpixels of the respective pixels and correction data associated with the respective subpixels of the respective pixels. The correction data referred herein is data used in a correction calculation of image data to improve the image quality. As the number of pixels of a display panel to be driven by a display driver increases, the amount of data to be supplied to the display driver may increase. As the amount of data increases, the baud rate and power consumption which are required for the data transfer to the display driver may also increase.

One approach to address the increase of data is to generate compressed data by performing data compression on original data before transmission to the display driver. The compressed data is decompressed by the display driver and then driven onto the display panel.

Restrictions of hardware of the display driver may, however, affect the transmission of the compressed date. A display driver, which handles an increased amount of compressed data, may be forced to rapidly decompress the compressed data, and hardware limitations of the display driver may limit how fast the display driver is able to decompress the compressed data.

In one embodiment, when variable length compression employing for example a long code length is used in the data compression, the decompression of the compressed data includes a bit search to identify the end of each code and the value of each code; however, a display driver suffers from a limitation of the number of bits for which the bit search can be performed in each clock cycle. This may become a restriction against rapidly decompressing the compressed data generated through a variable length compression.

Accordingly, there is a technical need for rapidly decompressing compressed data in a display driver in a panel display system configured to transmit compressed data to a display driver.

In one or more embodiments, data compression is achieved through variable length compression, for example Huffman coding.

FIG. 8 illustrates an example of a code allocation in Huffman coding. In the example of FIG. 8, each symbol is a data associated with each subpixel, for example, a correction data or an image data. In the code allocation illustrated in FIG. 8, each symbol is defined as a signed eight-bit data, taking a value from −127 to 127. A Huffman code is defined for each symbol. The code lengths of Huffman codes are variable; in the example illustrated in FIG. 8, the code lengths of the Huffman codes range from one to 13 bits.

Figure 9:
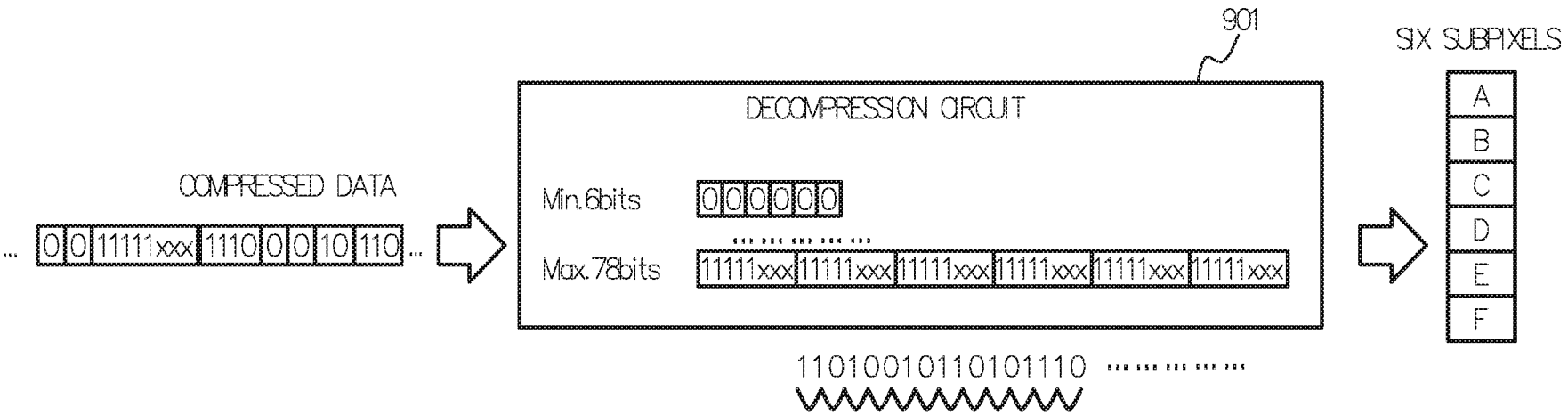
FIG. 9 illustrates an example of a decompression process of compressed data generated through Huffman coding according to one or more embodiments.

FIG. 9 illustrates an example of the decompression process of compressed data generated through the Huffman coding based on the code allocation illustrated in FIG. 8. In the example illustrated in FIG. 9, compressed data associated with six subpixels are decompressed by a decompression circuit 901. In one embodiment, the minimum number of bits of compression data associated with six subpixels is six and the maximum number of bits is 78. Therefore, when the compressed data thus configured are decompressed, a bit search of a maximum of 78 bits is employed. Thus, decompressing compressed data in units of six subpixels may require a processing circuit which operates at a very high speed.

In one embodiment, parallelization is utilized to improve the processing speed of compressed data. The effective processing speed is improved by preparing a plurality of decompression circuits in the display driver and performing decompression processes by the plurality of decompression circuits in parallel.

Figure 10:
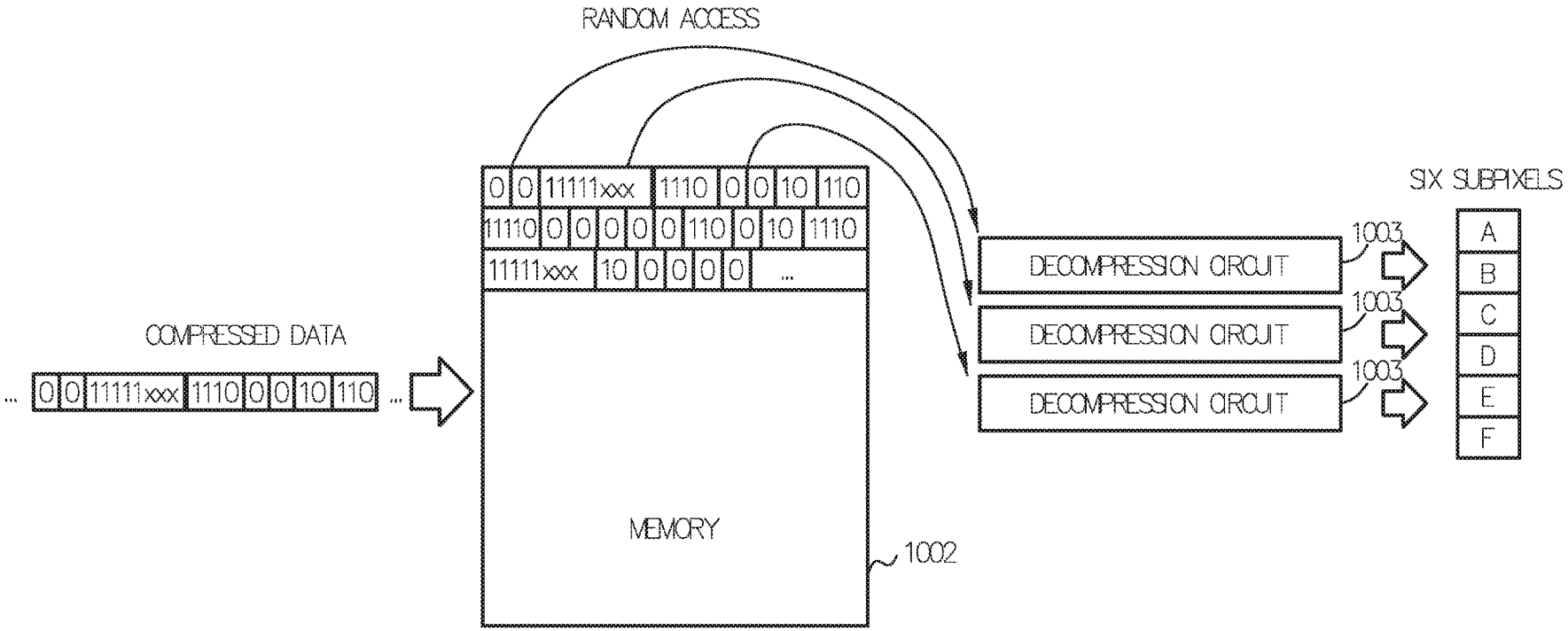
FIG. 10 is a block diagram illustrating one example of an architecture in which decompression processes are performed in parallel.

In one or more embodiments, as illustrated in FIG. 10, when compressed data generated through variable length compression is delivered to the plurality of decompression circuits 1003, the compressed data is transmitted at individual timing as the lengths of codes included in the compressed data delivered to the respective decompression circuits 1003 may be different. In such a configuration, the memory includes one of random accesses or concurrent accesses to multiple addresses.

Figure 11:
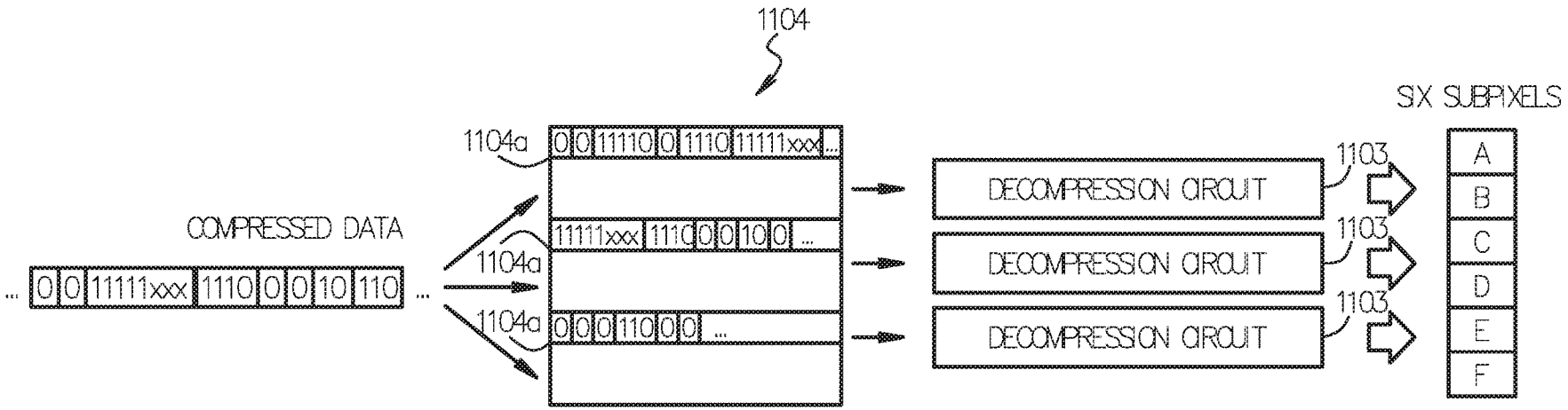
FIG. 11 is a block diagram illustrating another example of an architecture in which decompression processes are performed in parallel.

In another embodiment, as illustrated in FIG. 11, a memory 1104 including a plurality of individually accessible memory blocks 1104*a* is prepared and memory blocks 1104*a* are respectively allocated to the plurality of decompression circuits 1003. This configuration has, however, the complex circuit configuration of the memory 1104. Additionally, once one of the memory blocks 1104*a* becomes full of compressed data, compressed data cannot be further supplied to the memory 1104. This, in one or more embodiments, affects the efficiency of transmission of the compressed data to the memory 1104.

In one or more embodiments, enhancement of the speed of the decompression process is performed in a display driver through parallelization.

Figure 12:
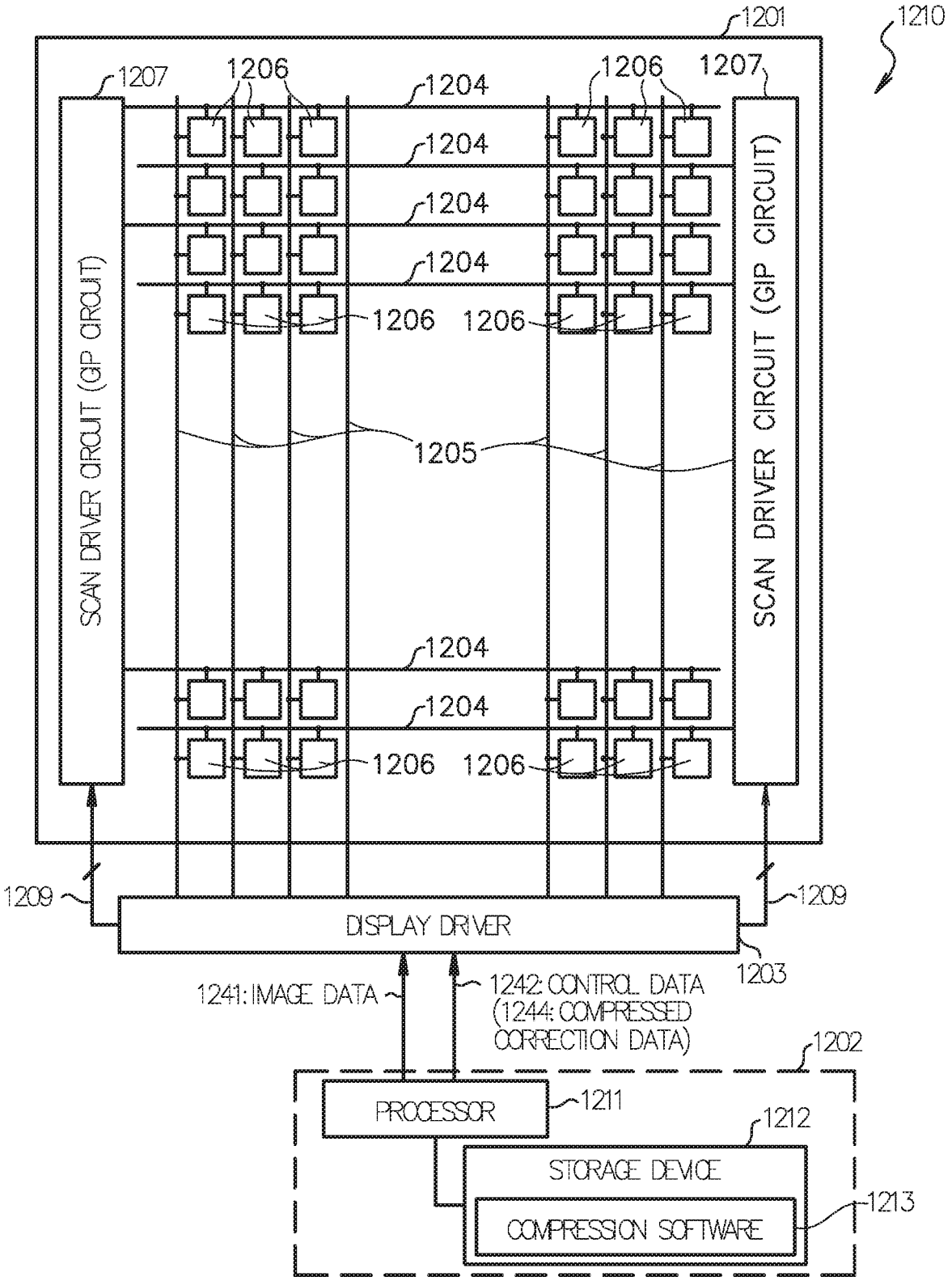
FIG. 12 is a block diagram illustrating the configuration of a display system in one embodiment.

FIG. 12 is a block diagram illustrating the configuration of a display system 1210 according to one embodiment. The display system 1210 illustrated in FIG. 12 includes a display panel 1201, a host device 1202 and a display driver 1203. An OLED (Organic Light Emitting Diode) display panel or a liquid crystal display panel may be used as the display panel 1201, for example.

The display panel 1201 includes scan lines 1204, data lines 1205, pixel circuits 1206 and scan driver circuits 1207. Each of the pixel circuits 1206 is disposed at an intersection of a scan line 1204 and a data line 1205 and configured to display a selected one of the red, green and blue colors. The pixel circuits 1206 displaying the red color are used as R subpixels. Similarly, the pixel circuits 1206 displaying the green color are used as G subpixels, and the pixel circuits 1206 displaying the blue color are used as B subpixels. When an OLED display panel is used as the display panel 1201, the pixel circuits 1206 displaying the red color include an OLED element emitting red colored light, the pixel circuits 1206 displaying the green color include an OLED element emitting green colored light, and the pixel circuits 1206 displaying the blue color include an OLED element emitting blue colored light. It should be noted that, when an OLED display panel is used as the display panel 1201, other signal lines for operating the light emitting elements within the respective pixel circuits 1206, such as emission lines used for controlling light emission of the light emitting elements of the respective pixel circuits 1206, may be disposed.

Figure 13:
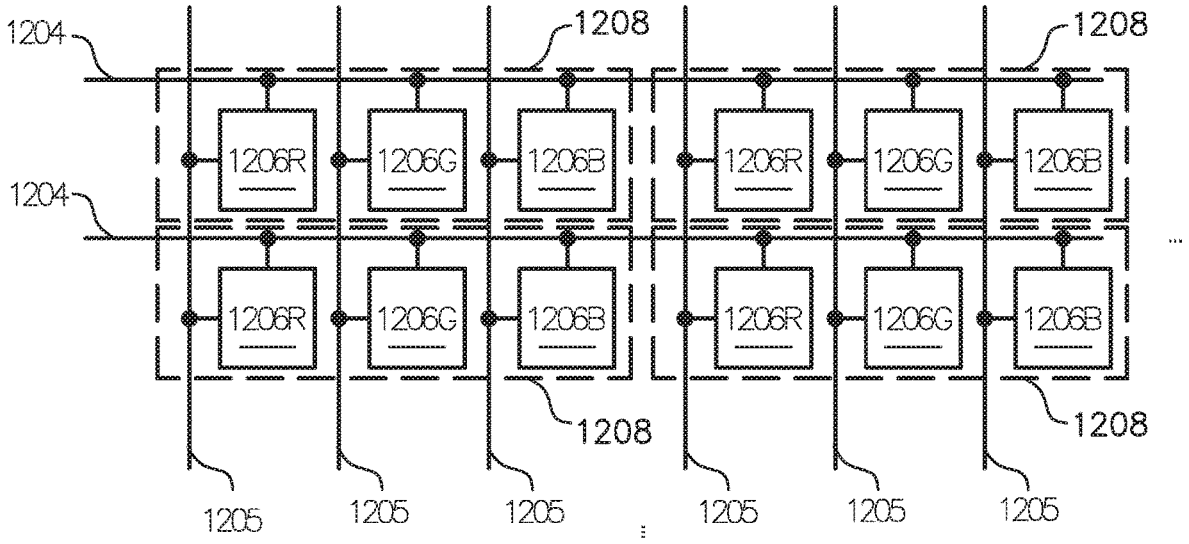
FIG. 13 illustrates the configuration of pixels of a display panel.

As illustrated in FIG. 13, each pixel 1208 of the display panel 1201 includes one R subpixel, one G subpixel and one B subpixel. In FIG. 13, the R subpixels (the pixel circuits 1206 displaying the red color) are denoted by numeral "1206R". Similarly, the G subpixels (the pixel circuits 1206 displaying the green color) are denoted by numeral "1206G" and the B subpixels (the pixel circuits 1206 displaying the blue color) are denoted by numeral "1206B".

Referring back to FIG. 12, the scan driver circuits 1207 drive the scan lines 1204 in response to scan control signals 1209 received from the display driver 1203. In one embodiment, a pair of scan driver circuits 1207 are provided; one of the scan driver circuits 1207 drives the odd-numbered scan lines 1204 and the other drives the even-numbered scan lines 4. In one or more embodiments, the scan driver circuits 1207 are integrated in the display panel 1201 with a GIP (gate-in-panel) technology. The scan driver circuits 1207 thus configured may be referred to as GIP circuits.

The host device 1202 supplies image data 1241 and control data 1242 to the display driver 1203. The image data 1241 describes the grayscale values of the respective subpixels (the R, G and B subpixels 1206R, 1206G and 1206B)

of the pixels 8 for displayed images. The control data 1242 includes commands and parameters used for controlling the display driver 1203.

The host device 1202 includes a processor 1211 and a storage device 1212. The processor 1211 executes software installed on the storage device 1212 to supply The image data 1241 and the control data 1242 to the display driver 1203. In the present embodiment, the software installed on the storage device 1212 includes compression software 1213. An application processor, a CPU (central processing unit), a DSP (digital signal processor) or the like may be used as the processor 1211. In one or more embodiments, storage device 1212 may be separate from the host device 1202, e.g. a serial flash device. Furthermore, in yet other embodiments, display driver 1203 may read compressed correction data 1244 directly from the separate storage device. Reading data 1244 from the storage device 1212 may be a default action of the display driver 1203 (e.g. without requiring commands from the host device 1202).

In the one or more embodiments, the control data 1242 supplied to the display driver 1203 includes compressed correction data 1244. The compressed correction data is generated through compressing correction data prepared for the respective subpixels of the respective pixels 8 with the compression software 1213. The compressed correction data 1244 is enclosed in fixed-length blocks (fixed rate) or variable length blocks (variable rate) and then supplied to the display driver 1203.

In various embodiments, the control data 1242 includes compressed correction data for each type of subpixel separately transmitted. For example, the control data 1242 may include compressed correction data for R subpixels, compressed correction data for G subpixels, and compressed correction data for B subpixels; where R represents red subpixels, G represents green subpixel data, and B represent blue subpixel data. In other embodiments, control data 1242 may additionally or alternatively include compressed correction data for W subpixels data for white subpixels. Further, the control data 1242 may include subpixel data for different subpixel colors.

The control data 1242 may include correction data for one or more of the subpixels. In one embodiment, each subpixel type may have a common correction coefficient. In other embodiments, each subpixel type may have a different correction coefficient. The correction coefficient may be included within the control data 1242, communicated separately from the control data 1242, or stored within display driver 1203.

Figure 14:
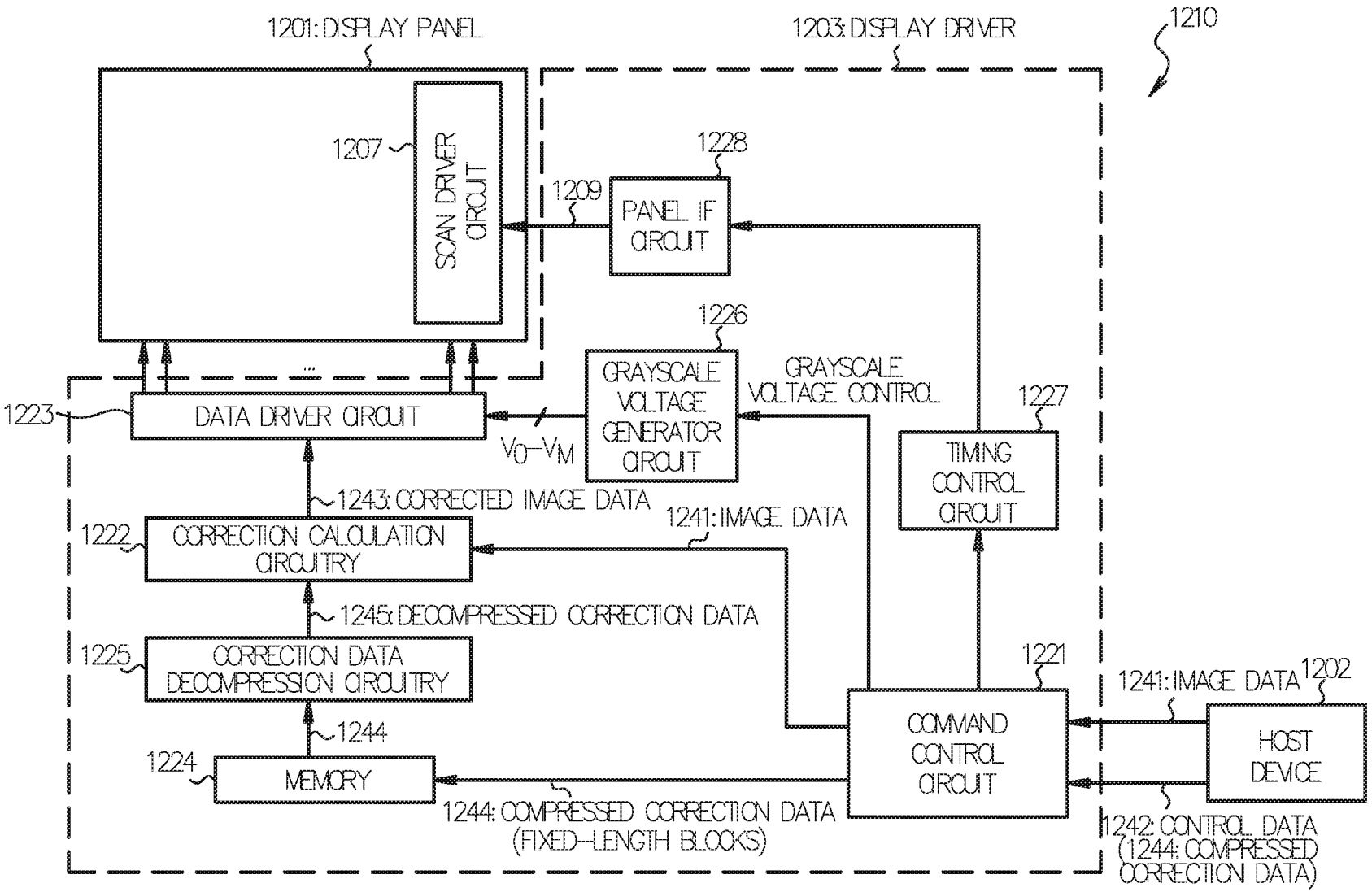
FIG. 14 is a block diagram illustrating the configuration of a display driver in one embodiment.

The display driver 1203 drives the display panel 1201 in response to the image data 1241 and control data 1242 received from the host device 1202, to display images on the display panel 1201. FIG. 14 is a block diagram illustrating the configuration of the display driver 1203 in one embodiment.

The display driver 1203 includes a command control circuit 1221, a correction calculation circuitry 1222, a data driver circuit 1223, a memory 1224, a correction data decompression circuitry 1225, a grayscale voltage generator circuit 261226, a timing control circuit 1227, and a panel interface circuit 1228.

The command control circuit 1221 forwards the image data 1241 received from the host device 1202 to the correction calculation circuitry 1222. Additionally, the command control circuit 1221 controls the respective circuits of the display driver 1203 in response to control parameters and commands included in the control data 1242. In one or more embodiments, when the control data 1242 includes compressed correction data, the command control circuit 1221 supplies the compressed correction data to the memory 1224 to store the compressed correction data. In FIG. 14, the compressed correction data supplied from the command control circuit 1221 to the memory 1224 are denoted by numeral "1244".

In one embodiment, the host device 1202 encloses the compressed correction data 1244 in fixed-length blocks and sequentially supplies the fixed-length blocks to the command control circuit 1221 of the display driver 1203. The command control circuit 1221 sequentially stores the fixed-length blocks into the memory 1224. This results in that the compressed correction data 1244 is stored in the memory 1224 as the data of the fixed-length blocks.

The correction calculation circuitry 1222 performs correction calculation on the image data 1241 received from the command control circuit 1221 to generate corrected image data 1243 used to drive the display panel 1201. In one embodiment, the corrected image data 1243 describes the grayscale values of the respective subpixels of the respective pixels 8.

In one embodiment, performing the correction calculation includes applying one or more correction coefficients to the subpixel data of the image data. The correction coefficients may include one or more offset values that may be applied the subpixel data of the image data.

The data driver circuit 1223 operates as a drive circuitry which drives the respective data lines with the grayscale voltages corresponding to the grayscale values described in the corrected image data 1243. In one or more embodiments, the data driver circuit 1223 selects, for the respective data lines 2605, the grayscale voltages corresponding to the grayscale values described in the corrected image data 1243 from among the grayscale voltages V0 to VM supplied from the grayscale voltage generator circuit 1226, and drives the respective data lines 1205 to the selected grayscale voltages.

The memory 1224 receives the compressed correction data 1244 from the command control circuit 1221 and stores therein the received compressed correction data 1244. The compressed correction data 1244 stored in the memory 1224 is read out from the memory 1224 as necessity and supplied to the correction data decompression circuitry 1225.

In one or more embodiments, the memory 1224 outputs the fixed-length blocks to the correction data decompression circuitry 1225 in the order of that they are received. This operation facilitates the access control of the memory 1224 and is effective for reducing the circuit size of the memory 1224.

Figure 15:
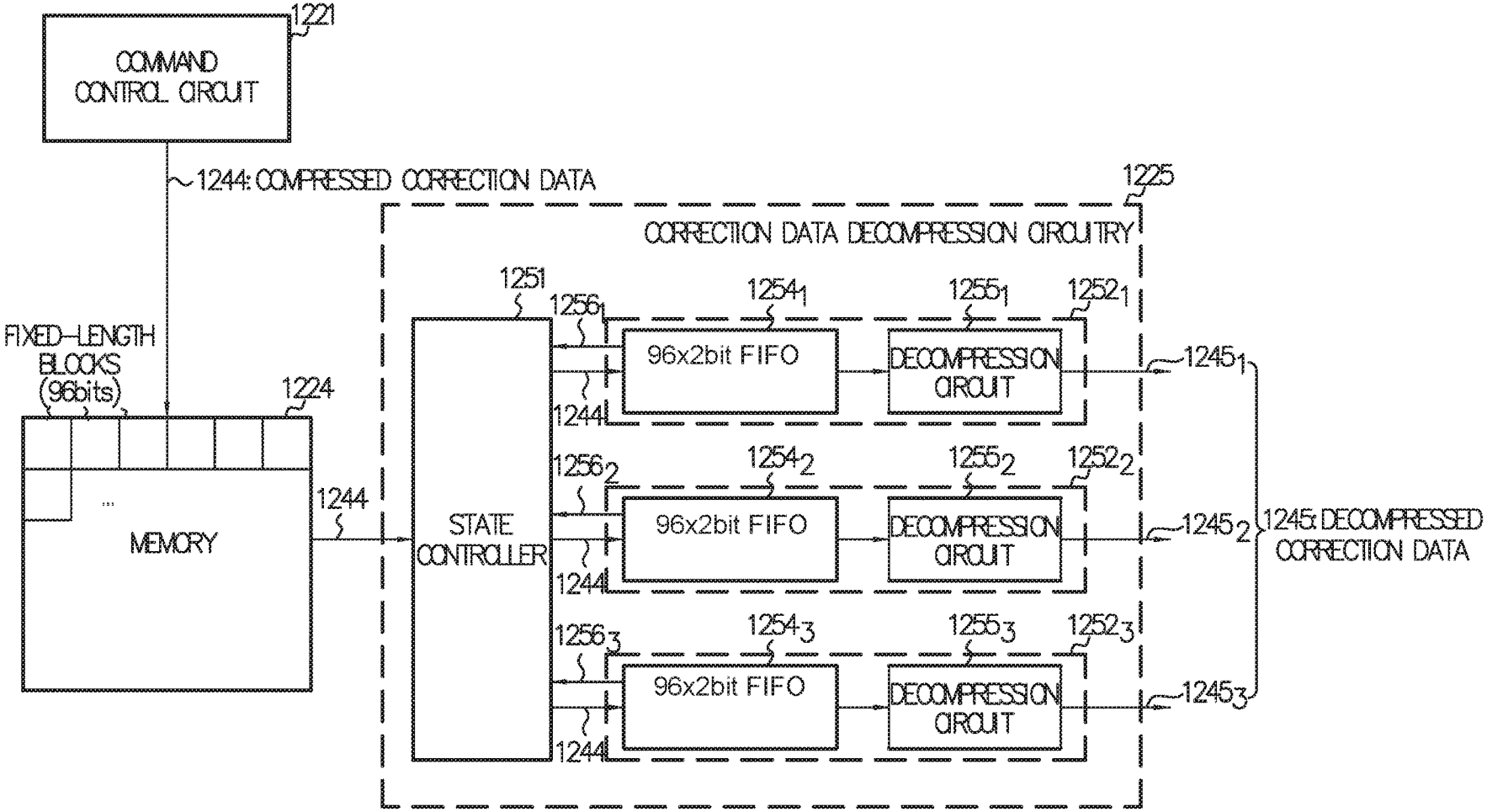
FIG. 15 is a block diagram illustrating the configuration of a correction data decompression circuitry in one embodiment.

The correction data decompression circuitry 1225 decompresses the compressed correction data 1244 read out from the memory 1224 to generate decompressed correction data 1245. The decompressed correction data 1245, which is same as the original correction data prepared in the host device 1202, is associated with the respective subpixels of the respective pixels 8. The decompressed correction data 1245 is supplied to the correction calculation circuitry 1222 and used for correction calculation in the correction calculation circuitry 1222. In one embodiment, the decompressed correction data includes one or more correction coefficients. The correction calculation performed with respect to an image data 1241 associated with a certain subpixel type (an R subpixel 1206R, a G subpixel 1206G or a B subpixel 1206B) of a certain pixel 1208 is performed in response to the decompressed correction data 1245 associated with the certain subpixel of the certain pixel 1208. While FIG. 15 illustrates 3 decompression circuitries, in other embodiments, more than 3 decompression circuitries may be employed. The number of decompression circuitries may be equal to the number of different subpixel types.

The grayscale voltage generator circuit 1226 generates a set of grayscale voltages V0 to VM respectively corresponding to the allowed values of the grayscale values described in the corrected image data 1243. The generated grayscale voltages V0 to VM are supplied to the data driver circuit 1223 and used to drive the data lines 1205 by the data driver circuit 1223.

The timing control circuit 1227 performs timing control of the respective circuits of the display driver 1203 in response to control signals received from the command control circuit 1221.

The panel interface (IF) circuit 1228 supplies the scan control signals 1209 to the scan driver circuits 1207 of the display panel 1201 to thereby control the scan driver circuits 2607.

In one or more embodiments, the correction data decompression circuitry 1225 is configured to decompress the compressed correction data 1244 through parallel processing to generate the decompressed correction data 1245. FIG. 15 is a block diagram illustrating the configuration of the correction data decompression circuitry 1225 according to one embodiment.

The correction data decompression circuitry 1225 includes a state controller 1251 and three processing circuits $\mathbf{1252}_1$ to $\mathbf{1252}_3$. The state controller 1251 reads out the blocks enclosing the compressed correction data 1244 from the memory 1224 and delivers the blocks to the processing circuits $\mathbf{1252}_1$ to $\mathbf{1252}_3$. The processing circuits $\mathbf{1252}_1$ to $\mathbf{1252}_3$ performs a decompression process on the compressed correction data 1244 enclosed in the received blocks and generates decompressed correction data 1245 corresponding to the original correction data. The compressed correction data 1204 may include fixed length blocks or variable length blocks.

In one or more embodiments, the decompressed correction data 1245 is generated through parallel processing using the plurality of processing circuits $\mathbf{1252}_1$ to $\mathbf{1252}_3$. The processing circuits $\mathbf{1252}_1$ to $\mathbf{1252}_3$ each performs a decompression process on the compressed correction data 1244 received thereby and generate processed correction data 12451 to 453, respectively. The decompressed correction data 1245 is composed of the processed correction data $\mathbf{1245}_1$ to $\mathbf{1245}_3$ generated by the processing circuits $\mathbf{1252}_1$ to $\mathbf{1252}_3$. While FIG. 15 illustrates three processing circuits, in other embodiments, there may be more than three processing circuits. Further, in one or more embodiments, the number of processing circuits is equal to the number of types of subpixels.

In one embodiment, the processing circuits $\mathbf{1252}_1$, $\mathbf{1252}_2$ and $\mathbf{1252}_3$ are each configured to supply request signals $\mathbf{1256}_1$, $\mathbf{1256}_2$ and $\mathbf{1256}_3$ requesting transmission of compressed correction data 1244, to the state controller 1251. When the state controller 1251 is requested to transmit compressed correction data 1244 by the request signal 561, the state controller 1251 reads out the respective compressed data to be transmitted to the processing circuit $\mathbf{1252}_1$ from the memory 1224 and transmits the compressed data to the processing circuit $\mathbf{1252}_1$. Similarly, when the state controller 1251 is requested to transmit compressed data by the request signal $\mathbf{1256}_2$, the state controller 1251 reads out the compressed data to be transmitted to the processing circuit $\mathbf{1252}_2$ from the memory 1224 and transmits the compressed data to the processing circuit $\mathbf{1252}_2$. Furthermore, when the state controller 1251 is requested to transmit compressed data by the request signal $\mathbf{1256}_3$, the state controller 1251 reads out the compressed data to be transmitted to the processing circuit $\mathbf{1252}_3$ from the memory 1224 and transmits the compressed data to the processing circuit $\mathbf{1252}_3$.

In one or more embodiments, the processing circuits $\mathbf{1252}_1$ to $\mathbf{1252}_3$ include FIFOs $\mathbf{1254}_1$ to $\mathbf{1254}_3$ and decompression circuits $\mathbf{1255}_1$ to $\mathbf{1255}_3$, respectively. The FIFOs $\mathbf{1254}_1$ to $\mathbf{1254}_3$ each have a capacity to store two blocks of compressed data. In other embodiments, FIFOs having other capacities may be used. The FIFOs $\mathbf{1254}_1$ to $\mathbf{1254}_3$ temporarily stores therein the blocks of compressed data delivered from the state controller 1251. The FIFOs $\mathbf{1254}_1$ to $\mathbf{1254}_3$ may be configured to temporarily store data supplied thereto and output the data in the order of reception. Additionally, the FIFOs $\mathbf{1254}_1$ to $\mathbf{1254}_3$ may be configured to activate the request signals $\mathbf{1256}_1$ to $\mathbf{1256}_3$, respectively, to request transmission of compressed correction data 1244, when the FIFOs $\mathbf{1254}_1$ to $\mathbf{1254}_3$ output the compressed correction data 1244 to the decompression circuits $\mathbf{1255}_1$ to $\mathbf{1255}_3$, respectively. The decompression circuits $\mathbf{1255}_1$ to $\mathbf{1255}_3$ receive compression blocks enclosing compressed correction data 1244 from the FIFOs $\mathbf{1254}_1$ to $\mathbf{1254}_3$, respectively, and decompress the compressed correction data 1244 enclosed in the received fixed-length blocks to generate the processed correction data $\mathbf{1245}_1$ to $\mathbf{1245}_3$. The decompressed correction data 1245 to be output from the correction data decompression circuitry 1225 are composed of the processed correction data $\mathbf{1245}_1$ to $\mathbf{1245}_3$.

In one or more embodiments, compressed correction data 1244 is supplied from the host device 1202 to the display driver 1203 and the supplied compressed correction data 1244 is written into the memory 1224. In one embodiment, the correction data is prepared in the host device 1202 with respect to the respective subpixels of the respective pixels 8 of the display panel 1201, and compressed correction data 1244 is generated by compressing the correction data with the compression software 1213. The compressed correction data 1244 is enclosed in fixed-length blocks or variable length blocks and transmitted to the display driver 1203 as a part of control data 1242. The compressed blocks transmitted to the display driver 1203 are written into the memory 1224. The compressed blocks enclosing the compressed correction data 1244 may be written immediately after a boot of the display system 1210 or at appropriate timing after the display system 1210 starts to operate.

When an image is displayed on the display panel 1201, image data 1241 corresponding to the image is supplied from the host device 1202 to the display driver 1203. The image data 1241 supplied to the display driver 1203 is supplied to the correction calculation circuitry 1222.

In the meantime, the compressed correction data 1244 is read out from the memory 1224 and supplied to the correction data decompression circuitry 1225. The correction data decompression circuitry 1225 decompresses the compressed correction data 1244 enclosed in the supplied compressed blocks to generate the decompressed correction data 1245. The decompressed correction data 1245 is generated for the respective subpixels of the display panel.

The correction calculation circuitry 1222 corrects the image data 1241 in response to the decompressed correction data 1245 received from the correction data decompression circuitry 1225 to generate corrected image data 1243. In one or more embodiments, the calculation circuitry 1222 applies one or more correction coefficients along with the decompressed correction data 1245 to correct The image data 1241. The correction coefficients may be common for each subpixel type or different for each subpixel type. In one embodiment, corrected image data is generated based after the decompressed correction data is determined based on the correction coefficients. For example, the decompressed coefficient data may be applied to $CX^2+BX+A$, where C, B, and A are correction coefficients and X is the decompressed compression data.

In correcting the image data 1241 associated with a certain subpixel of a certain pixel 1208, the decompressed correction data 1245 associated with the certain subpixel of the certain pixel 1208 is used to thereby generate the corrected image data 1243 associated with a respective subpixel of a respective pixel. The corrected image data 1243 thus generated is transmitted to the data driver circuit 1223 and used to drive respective subpixels.

In one or more embodiments, when sequentially receiving compressed blocks enclosing compressed correction data 1244, the memory 1224 operates to output the compressed blocks to the correction data decompression circuitry 1225 in the order of reception. This operation is effective for facilitating the access control of the memory 1224 and reducing the circuit size of the memory 1224.

Figure 16:
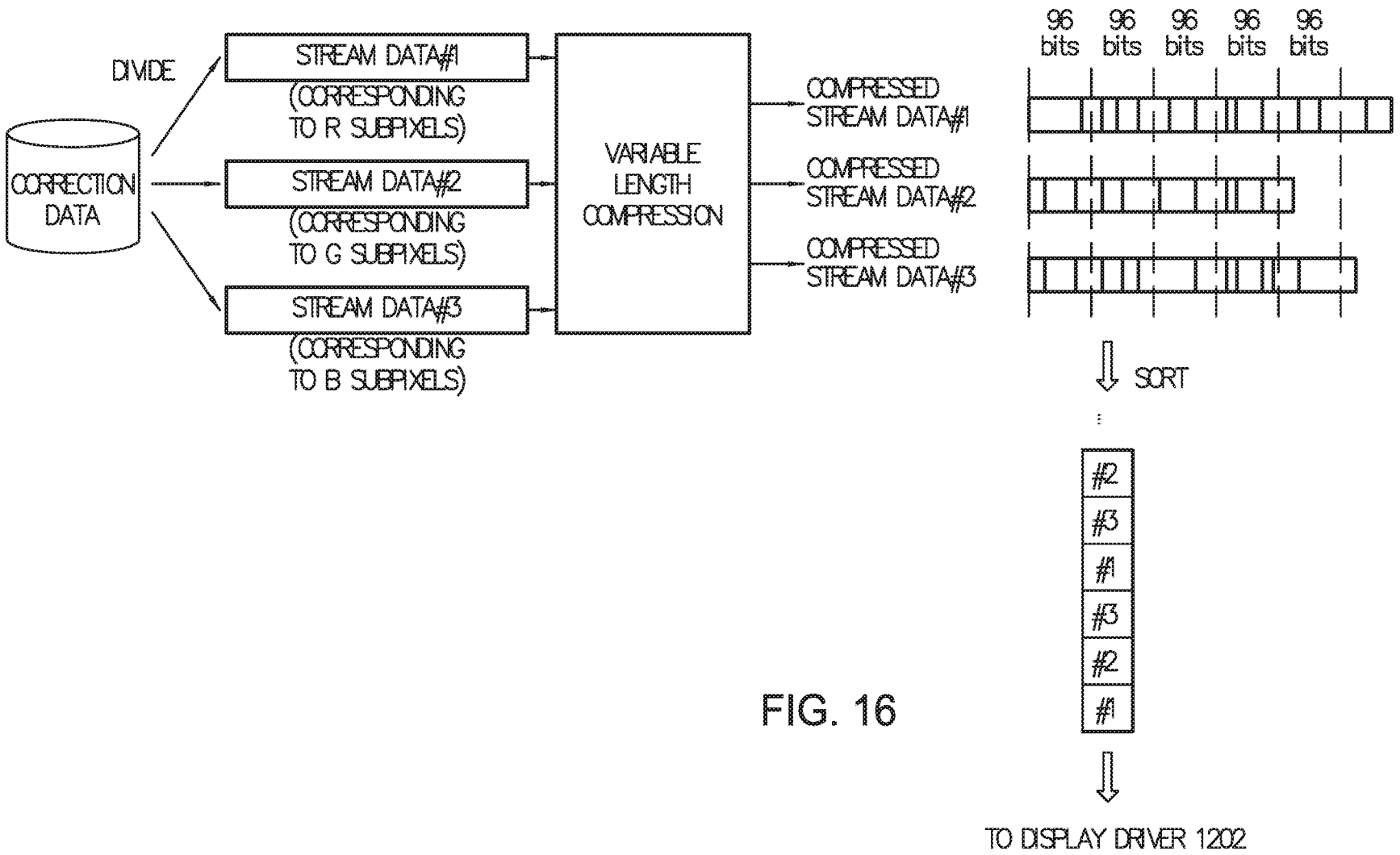
FIG. 16 is a diagram illustrating an operation of a host device to generate compressed correction data and transmit the compressed correction data to the display driver with the compressed correction data enclosed in fixed-length blocks.

FIG. 16 is a diagram illustrating the operation of the host device 1202 according to one embodiment, which involves generating the compressed correction data 1244 and transmitting the generated compressed correction data 1244 to the display driver 1203 with the compressed correction data 1244 enclosed in fixed-length blocks. The operation illustrated in FIG. 16 is achieved by executing the compression software 1213 by the processor 1211 of the host device 1202.

In the embodiment of FIG. 16, correction data is prepared in the host device 1202 for the respective subpixels of the pixels 8 of the display panel 1201. The correction data may be stored, for example, in the storage device 1212.

The prepared correction data is divided into a plurality of stream data. The number of the stream data is equal to the number of the processing circuits $\mathbf{1252}_1$ to $\mathbf{1252}_3$, which perform the decompression process through parallel processing in the correction data decompression circuitry 1225 of the display driver 1203. While three streams and three processing circuits are illustrated, in other embodiments, more than three streams and three processing circuits may be used. Further, in one or more embodiments, the number of processing circuits and the number of streams are equal to the number of types of subpixels.

Figure 17:
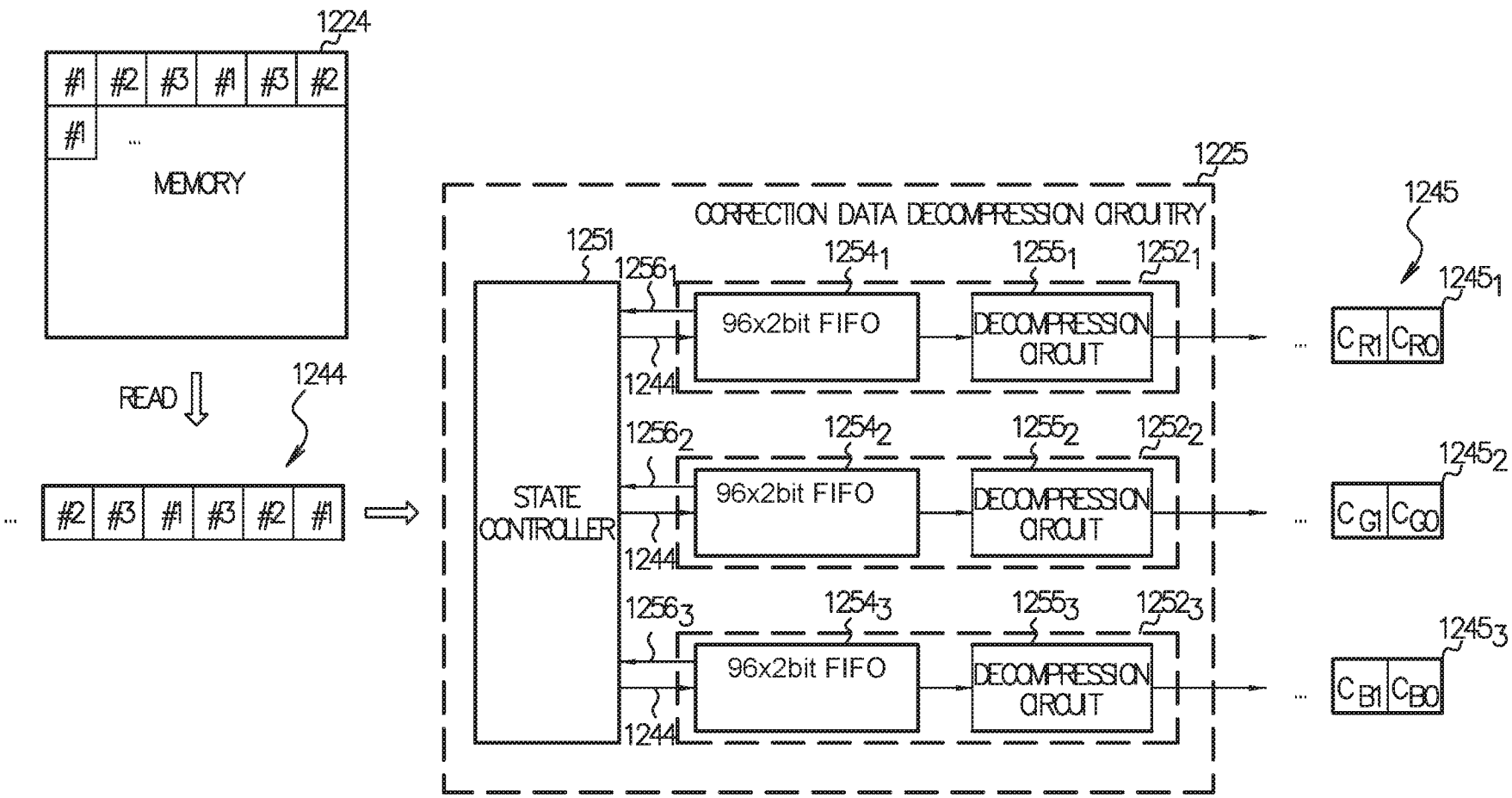
FIG. 17 is a diagram illustrating a decompression process performed in the correction data decompression circuitry in one embodiment.

As illustrated in FIG. 17, in one embodiment, the number of the processing circuits $\mathbf{1252}_1$ to $\mathbf{1252}_3$ is three and therefore the correction data is divided into stream data #1 to #3. In one embodiment, in which the number of the stream data is three, the stream data may be generated by dividing the correction data on the basis of the associated colors of the subpixels. In one embodiment, stream data #1 includes correction data associated with the R (red) subpixels 1206R of the respective pixels 8, stream data #2 includes correction data associated with the G (green) subpixels 1206G of the respective pixels 8, and stream data #3 includes correction data associated with the B (blue) subpixels 1206B of the respective pixels 8. Stream data #1 to #3 thus generated are stored in the storage device 1212 of the host device 1202. In other embodiments, one or more additional streams may be included and may include correction data associated with another type of subpixels. For example, a stream may include correction data associated with (W) white subpixels.

In various embodiments, the correction data is not divided on the basis of the colors of the subpixels. For example, when the number of the processing circuits 1252 is four and there are three subpixel types, for example, the correction data may be divided into four stream data respectively associated with the processing circuits 1252.

The stream data #1 to #3 are individually compressed through variable length compression, to thereby generate compressed stream data #1 to #3. The compressed stream data #1 is generated by performing a variable length compression on the stream data #1. Similarly, the compressed stream data #2 is generated by performing a variable length compression on the stream data #2 and the compressed stream data #3 is generated by performing a variable length compression on the stream data #3. In other embodiments, a fixed length compression may be employed.

In various embodiments, each of the compressed stream data #1 and #3 are individually divided into fixed-length blocks. In one embodiment, each of the compressed stream data #1 and #3 is divided into 96-bit fixed-length blocks.

The fixed-length blocks obtained by dividing the compressed stream data #1 to #3 are sorted and transmitted to the display driver 1203. In one embodiment, the order into which the fixed-length blocks are sorted in the host device 1202 is important for facilitating the access control of the memory 1224. In one embodiment, fixed-length blocks are sequentially transmitted to the display driver 1203 and sequentially stored in the memory 1224.

The compressed correction data 1244 enclosed in the fixed-length blocks stored in the memory 1224 are used when the correction calculation is performed on the image data 1241. When a correction calculation is performed on the image data 1241 of a certain subpixel of a certain pixel 1208, the decompressed correction data 1245 associated with the certain subpixel of the certain pixel 1208 are generated in time for the correction calculation by decompressing the associated compressed correction data 1244 by the correction data decompression circuitry 1225.

FIG. 17 is a diagram illustrating the decompression process performed in the correction data decompression circuitry 1225 according to one embodiment. The state controller 1251 reads out the blocks enclosing the compressed correction data 1244 from the memory 1224 and delivers the blocks to the processing circuits $\mathbf{1252}_1$ to $\mathbf{1252}_3$ in response to the request signals $\mathbf{1256}_1$ to $\mathbf{1256}_3$ received from the processing circuits $\mathbf{1252}_1$ to $\mathbf{1252}_3$.

In detail, in the correction calculation performed in a specific frame period, six blocks are first sequentially read out by the state controller 1251 and the compressed correction data 1244 of two blocks are stored in each of the FIFOs $\mathbf{1254}_1$ to $\mathbf{1254}_3$ of the processing circuits $\mathbf{1252}_1$ to $\mathbf{1252}_3$.

Subsequently, the compressed correction data 1244 is sequentially transmitted from the FIFOs $\mathbf{1254}_1$ to $\mathbf{1254}_3$ to the decompression circuits $\mathbf{1255}_1$ to $\mathbf{1255}_3$ in the processing circuits $\mathbf{1252}_1$ to $\mathbf{1252}_3$, and the decompression circuits $\mathbf{1255}_1$ to $\mathbf{1255}_3$ sequentially perform the decompression process on the compressed correction data 1244 received from the FIFOs $\mathbf{1254}_1$ to $\mathbf{1254}_3$ to thereby generate processed correction data $\mathbf{1245}_1$, $\mathbf{1245}_2$ and $\mathbf{1245}_3$, respectively. As described above, the decompressed correction data 1245 is composed of the processed correction data $\mathbf{1245}_1$, $\mathbf{1245}_2$ and $\mathbf{1245}_3$.

In one embodiment, the processed correction data $\mathbf{1245}_1$, $\mathbf{1245}_2$ and $\mathbf{1245}_3$ is reproductions of stream data #1, #2 and #3, respectively, that is, the correction data associated with the R subpixels 1206R, the G subpixels 1206G and the B subpixels 1206B, in the present embodiment. In FIG. 17, the correction data associated with the R subpixels 1206R is denoted by symbols CR0, CR1 . . . , the correction data associated with the G subpixels 6G is denoted by symbols CG0, CG1 . . . , and the correction data associated with the B subpixels 6B is denoted by symbols CB0, CB1 . . . . In the correction calculation circuitry 1222, The image data 1241 associated with the R subpixels 1206R is corrected on the basis of the correction data CRi associated with the R subpixels 1206R, The image data 1241 associated with the G subpixels 1206G is corrected on the basis of the correction data CGi associated with the G subpixels 1206G, and The image data 1241 associated with the B subpixels 1206B is corrected on the basis of the correction data CBi associated with the B subpixels 1206B. While red, green and blue subpixels are shown, in other embodiments, additional subpixels such as white may be used.

In the operation described above, the FIFO $\mathbf{1254}_1$ of the processing circuit $\mathbf{1252}_1$ activates the request signal $\mathbf{1256}_1$ every when transmitting compressed correction data 1244 of one fixed-length block to the decompression circuit 1251. In one embodiment, in response to the request signal $\mathbf{1256}_1$ being activated to request for read of a block, the state controller 1251 reads out one block from the memory 1224 and supplies the block to the FIFO $\mathbf{1254}_1$.

The same goes for the processing circuits $\mathbf{1252}_2$ and $\mathbf{1252}_3$. The FIFO $\mathbf{1254}_2$ of the processing circuit $\mathbf{1252}_2$ activates the request signal $\mathbf{1256}_2$ every when transmitting compressed correction data 1244 of one fixed-length block to the decompression circuit $\mathbf{1255}_2$. The request signal $\mathbf{1256}_2$ may be activated to request for read of a fixed-length block, the state controller 1251 reads out one fixed-length block from the memory 1224 and supplies the fixed-length block to the FIFO $\mathbf{1254}_2$. Furthermore, the FIFO $\mathbf{1254}_3$ of the processing circuit $\mathbf{1252}_3$ activates the request signal $\mathbf{1256}_3$ every when transmitting compressed correction data 1244 of one fixed-length block to the decompression circuit $\mathbf{1255}_3$. The request signal $\mathbf{1256}_3$ is activated to request for read of a fixed-length block, the state controller 1251 reads out one fixed-length block from the memory 1224 and supplies the fixed-length block to the FIFO $\mathbf{1254}_3$.

Since the compressed correction data 1244 is compressed through variable length compression, the code lengths of the compressed correction data 1244 transmitted from the FIFOs $\mathbf{1254}_1$ to $\mathbf{1254}_3$ to the decompression circuits $\mathbf{1255}_1$ to $\mathbf{1255}_3$ may be different from one another, even when the decompression circuits $\mathbf{1255}_1$ to $\mathbf{1255}_3$ generate the processed correction data $\mathbf{1245}_1$ to $\mathbf{1245}_3$ associated with the same number of subpixels per clock cycle. This implies that the order in which the FIFOs $\mathbf{1254}_1$ to $\mathbf{1254}_3$ require reading of fixed-length blocks to the state controller 1251 is dependent on the code lengths of the compressed correction data 1244 used in the decompression process in the decompression circuits $\mathbf{1255}_1$ to $\mathbf{1255}_3$.

In one or more embodiments, to address such situations and thereby facilitate the access control of the memory 1224, in the present embodiment, the host device 1202 sorts the blocks enclosing the compressed correction data 1244 into the order in which the fixed-length blocks is required by the processing circuits 521 to 523 of the correction data decompression circuitry 1225, and supplies the sorted blocks to the display driver 1203 to store the same into the memory 1224.

In some embodiments, the order in which the blocks are provided to the processing circuits $\mathbf{1252}_1$ to $\mathbf{1252}_3$ is determined in advance, since the contents of the decompression process performed by the processing circuits $\mathbf{1252}_1$ to $\mathbf{1252}_3$ are determined on the basis of the correction calculation performed in the correction calculation circuitry 1222. This implies that the order into which the host device 1202 should sort the blocks enclosing the compressed correction data 1244 may be available in advance. The host device 1202 may be configured to sort the blocks into the order in which the blocks based on the processing circuits $\mathbf{1252}_1$ to $\mathbf{1252}_3$ and supplies the sorted fixed-length blocks to the display driver 1203.

To correctly determine the order in which the blocks are supplied to the processing circuits $\mathbf{1252}_1$, the host device 1202 may perform the same process as the process performed on the blocks by the state controller 1251 and the processing circuits $\mathbf{1252}_1$ to $\mathbf{1252}_3$ with software, before the host device 1202 actually transmits the blocks enclosing the compressed correction data 1244 to the display driver 1203. In one embodiment, the host device 1202 may determine the order into which the blocks are to be sorted, by simulating the process performed on the blocks by the state controller 1251 and the processing circuits $\mathbf{1252}_1$ to $\mathbf{1252}_3$ with software. In this case, the compression software installed on the storage device 1212 of the host device 1202 may include a software module which simulates the process same as the process performed on the blocks by the state controller 1251 and the processing circuits $\mathbf{1252}_1$ to $\mathbf{1252}_3$.

As described above, in the display system 1210 of one embodiment, the host device 1202 is configured to sort the blocks enclosing the compressed correction data 1244 into the order in which the blocks are required by the processing circuits $\mathbf{1252}_1$ to $\mathbf{1252}_3$ of the correction data decompression circuitry 1225, supply the sorted blocks to the display driver 1203 and store the same into the memory 1224. This allows matching the order in which the state controller 1251 reads out the blocks from the memory 1224 in response to the requests from the processing circuits $\mathbf{1252}_1$ to $\mathbf{1252}_3$ with the order in which the blocks are stored in the memory 1224. This operation is effective for facilitating the access control of the memory 1224. For example, the operation of the present embodiment eliminates the need of performing random accesses to the memory 1224. This is effective for reducing the circuit size of the memory 1224.

Figure 18:
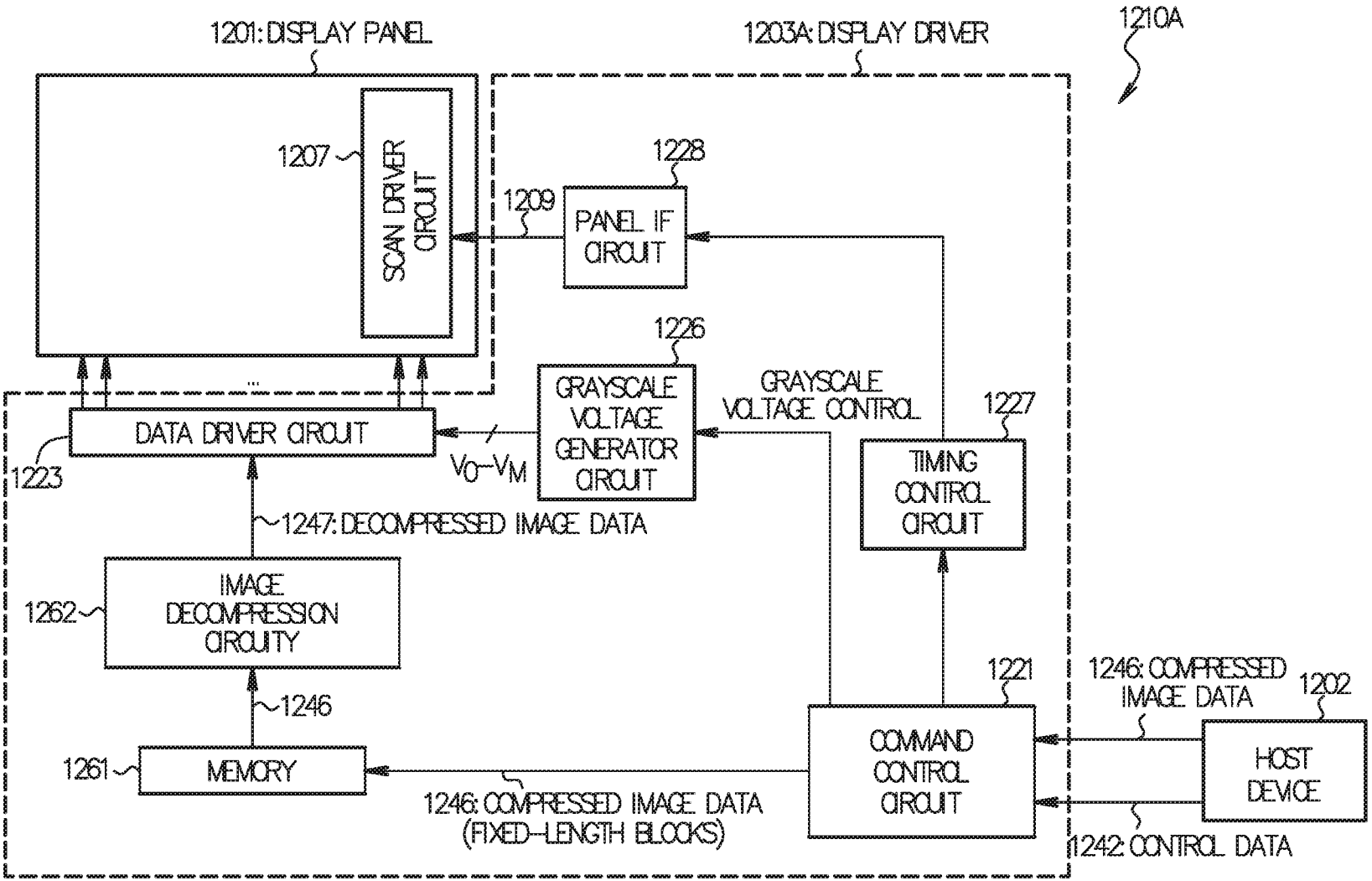
FIG. 18 is a block diagram illustrating the configuration of a display system according to one or more embodiments.

FIG. 18 is a block diagram illustrating the configuration of the display system 1210A, more particularly, the configuration the display driver 1203A in another embodiment of the disclosure. The configuration of the display system 1210A of the illustrated embodiment is similar to that of the display system 1210 of the earlier described embodiment. In the illustrated embodiment, a memory 61 and an image decompression circuitry 1262 are provided in the display driver 1203A in place of the memory 1224 and the correction data decompression circuitry 1225.

The display system 1210A of the embodiment illustrated within FIG. 18 is configured so that the host device 1202 generates compressed image data 1246 by compressing image data corresponding to an image to be displayed on the display panel 1201 and supplies the compressed image data 1246 to the display driver 1203A. The compression process in which the host device 1202 compresses the image data to generate the compressed image data 1246 is the same as the compression process in which the host device 1202 compresses the correction data to generate the compressed correction data 1244 in the first embodiment, except for that the image data are compressed in place of the correction data. The compressed image data 1246 is enclosed in and supplied to the display driver 1203A. Details of the compression process to generate the compressed image data 1246 will be described later in detail.

The display driver 1203A is configured to receive the blocks enclosing the compressed image data 1246, store the received blocks into the memory 61, supply the blocks read out from the memory 1261 to the image decompression circuitry 1262 and perform a decompression process on the compressed image data 1246 enclosed in the blocks by the image decompression circuitry 1262. Decompressed image data 1247 generated by the decompression process by the image decompression circuitry 1262 are supplied to the data driver circuit 1223, and the data driver circuit 1223 drives the respective data lines 1205 with the grayscale voltages corresponding to the grayscale values described in the decompressed image data 1247. In one or more embodiments, the correction data includes one or more correction coefficients which may be used with the correction data to determine the image data. The correction coefficients may add a "weight" or offset to the correction data. Further, the correction coefficients may be the same for each subpixel type or different for each subpixel type.

Figure 19:
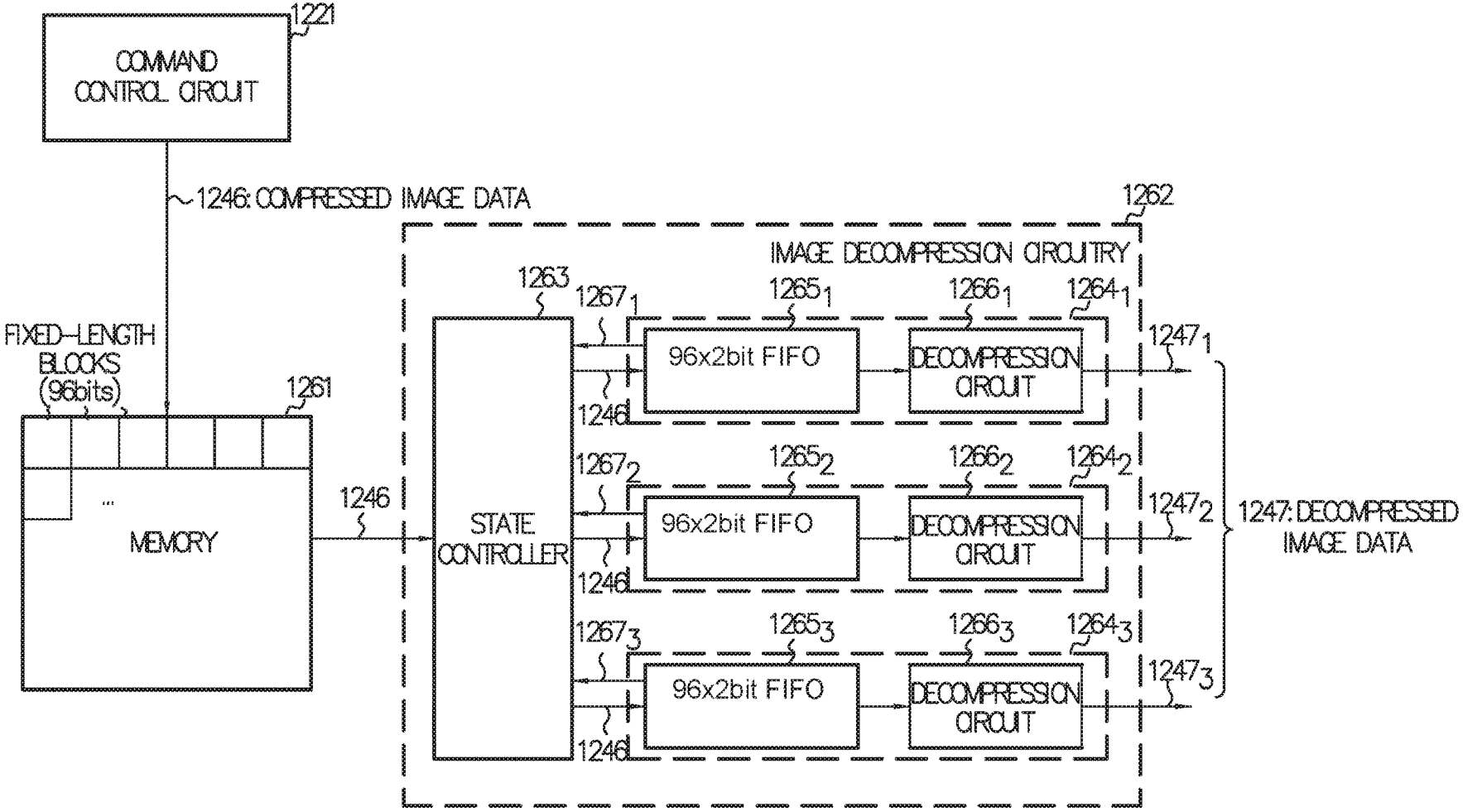
FIG. 19 is a block diagram illustrating the configuration of an image decompression circuitry in one embodiment.

FIG. 19 is a block diagram illustrating the configuration of the image decompression circuitry 1262 according to one embodiment. The image decompression circuitry 1262 is configured to generate the decompressed image data 1247 by decompressing the compressed image data 1246 through parallel processing. The configuration of the image decompression circuitry 1262 is similar to that of the correction data decompression circuitry 1225 illustrated in FIG. 15, except for that the compressed image data 1246 is supplied to the image decompression circuitry 1262 in place of the compressed correction data 1244.

In one or more embodiments, the image decompression circuitry 1262 includes a state controller '163 and three processing circuits $\mathbf{1264}_1$ to $\mathbf{1264}_3$. In other embodiment, the number of processing circuits is equal to the number of subpixel types. The state controller 1263 reads out the blocks enclosing the compressed image data 1246 from the memory 61 and delivers the blocks to the processing circuits $\mathbf{1264}_1$ to $\mathbf{1264}_3$. The processing circuits $\mathbf{1264}_1$ to $\mathbf{1264}_3$ sequentially perform the decompression process on the compressed image data 1246 enclosed in the received fixed-length blocks to generate the decompressed image data 1247 corresponding to the original image data.

In one or more embodiments, the decompressed image data 1247 is generated through parallel processing using the plurality of processing circuits $\mathbf{1264}_1$ to $\mathbf{1264}_3$. The processing circuits $\mathbf{1264}_1$ to $\mathbf{1264}_3$ each performs the decompression process on the compressed image data enclosed in the blocks received thereby, to generate processed image data $\mathbf{1247}_1$ to $\mathbf{47}_3$, respectively. The decompressed image data 1247 is composed of the processed image data $\mathbf{1247}_1$ to $\mathbf{1247}_3$ generated by the processing circuits $\mathbf{1264}_1$ to $\mathbf{1264}_3$.

The processing circuits $\mathbf{1264}_1$, $\mathbf{1264}_2$ and $\mathbf{1264}_3$ are configured to supply request signals $\mathbf{1256}_1$, $\mathbf{1256}_2$ and $\mathbf{1256}_3$ requesting transmission of blocks enclosing compressed image data 1246, to the state controller 1263. When the state controller 1263 is requested to transmit a block enclosing compressed image data 1246 by the request signal $\mathbf{1267}_1$, the state controller 1263 reads out the block to be transmitted to the processing circuit $\mathbf{1264}_1$ and transmits the block to the processing circuit $\mathbf{1264}_1$. Similarly, when the state controller 1263 is requested to transmit a block by the request signal $\mathbf{1267}_2$, the state controller 1263 reads out the block to be transmitted to the processing circuit $\mathbf{1264}_2$ and transmits the block to the processing circuit $\mathbf{1264}_2$. Furthermore, when the state controller 1263 is requested to transmit a block by the request signal $\mathbf{1267}_3$, the state controller 1263 reads out the block to be transmitted to the processing circuit $\mathbf{1264}_3$ from the memory 1261 and transmits the fixed-length block to the processing circuit $\mathbf{1264}_3$.

More specifically, the processing circuits $\mathbf{1264}_1$ to $\mathbf{1264}_3$ include FIFOs $\mathbf{1265}_1$ to $\mathbf{1265}_3$ and decompression circuits $\mathbf{1266}_1$ to $\mathbf{1266}_3$, respectively. The FIFOs $\mathbf{1265}_1$ to $\mathbf{1265}_3$ each have a capacity to store two blocks. The FIFOs $\mathbf{1265}_1$ to $\mathbf{1265}_3$ temporarily stores therein blocks delivered from the state controller 1263. The FIFOs $\mathbf{1265}_1$ to $\mathbf{1265}_3$ are configured to temporarily store data supplied thereto and output the data in the order of reception. Additionally, the FIFOs $\mathbf{1265}_1$ to $\mathbf{1265}_3$ activate the request signals $\mathbf{1267}_1$ to $\mathbf{1267}_3$, respectively, to request transmission of compressed image data 1246, every when the FIFOs $\mathbf{1265}_1$ to $\mathbf{1265}_3$ output the compressed image data 1246 enclosed in one block to the decompression circuits $\mathbf{1266}_1$ to $\mathbf{1266}_3$, respectively. The decompression circuits $\mathbf{1266}_1$ to $\mathbf{1266}_3$ receives blocks enclosing compressed correction data 46 from the FIFOs $\mathbf{1265}_1$ to $\mathbf{1265}_3$, respectively, and decompress the compressed image data 1246 enclosed in the received blocks to generate the processed image data $\mathbf{1247}_1$ to $\mathbf{1247}_3$. The decompressed image data 1247 to be output from the image decompression circuitry 1262 are composed of the processed image data $\mathbf{1247}_1$ to $\mathbf{1247}_3$.

Figure 20:
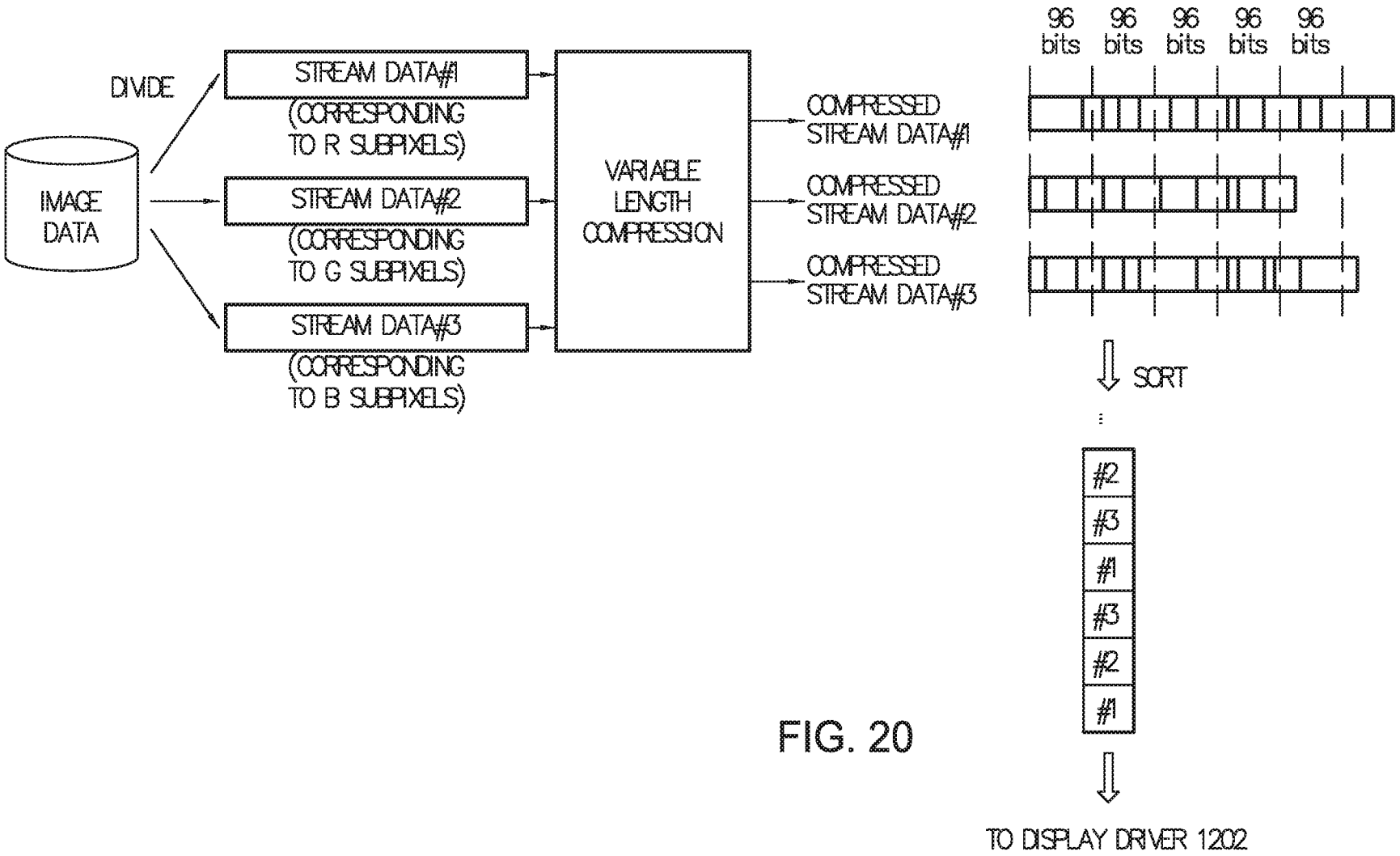
FIG. 20 is a diagram illustrating an operation of a host device to generate compressed image data and transmit the compressed image data to the display driver with the compressed image data enclosed in fixed-length blocks.

FIG. 20 is a diagram illustrating the operation of the host device 1202 according to one embodiment, which involves generating the compressed image data 1246 and transmitting the generated compressed image data 1246 to the display driver 1203A with the compressed image data 1246 enclosed in blocks. The operation illustrated in FIG. 20 is achieved by executing the compression software 1213 by the processor 1211 of the host device 1202.

In one or more embodiments, image data describing the grayscale values of the respective subpixels of the respective pixels 8 of the display panel 1201 are prepared in the host device 1202. The image data may be stored, for example, in the storage device 1212.

The prepared image data is divided into a plurality of stream data. The number of the stream data is equal to the number of the processing circuits $\mathbf{1264}_1$ to $\mathbf{1264}_3$, which perform the decompression process through parallel processing in the image decompression circuitry 1262 of the display driver 1203A. In one embodiment, the number of the processing circuits $\mathbf{1264}_1$ to $\mathbf{1264}_3$ is three and therefore the image data is divided into stream data #1 to #3. In one embodiment, in which the number of the stream data is three, the stream data may be generated by dividing the image data on the basis of the associated colors of the subpixels. In this case, stream data #1 includes image data associated with the R subpixels 1206R of the respective pixels 1208, stream data #2 includes image data associated with the G subpixels 1206G of the respective pixels 1208, and stream data #3 includes image data associated with the B subpixels 1206B of the respective pixels 8. Stream data #1 to #3 thus generated are stored in the storage device 1212 of the host device 1202. In other embodiments, there may be more than three colors, and three streams of compressed data.

In various embodiments, when the number of the processing circuits 1264 is four, for example, the image data may be divided into four streams of data respectively associated with the processing circuits 1264.

The stream data #1 to #3 are individually compressed through variable length compression, to thereby generate compressed stream data #1 to #3. The compressed stream data #1 is generated by performing a variable length compression on the stream data #1. Similarly, the compressed stream data #2 is generated by performing a variable length compression on the stream data #2 and the compressed stream data #3 is generated by performing a variable length compression on the stream data #3. While variable length compression techniques are mentioned, in other embodiments, other types of compression may be used.

Each of the compressed stream data #1 and #3 is individually divided into fixed-length blocks. In the present embodiment, each of the compressed stream data #1 and #3 is divided into 96-bit fixed-length blocks.

The blocks obtained by dividing the compressed stream data #1 to #3 are sorted and transmitted to the display driver 1203A. In one embodiment, the host device 1202 sorts the blocks enclosing the compressed image data 1246 into the order in which the blocks are requested by the processing circuits $\mathbf{1264}_1$ to $\mathbf{1264}_3$ of the image decompression circuitry 1262, and supplies the sorted blocks to the display driver 1203A to store the same into the memory 61.

Figure 21:
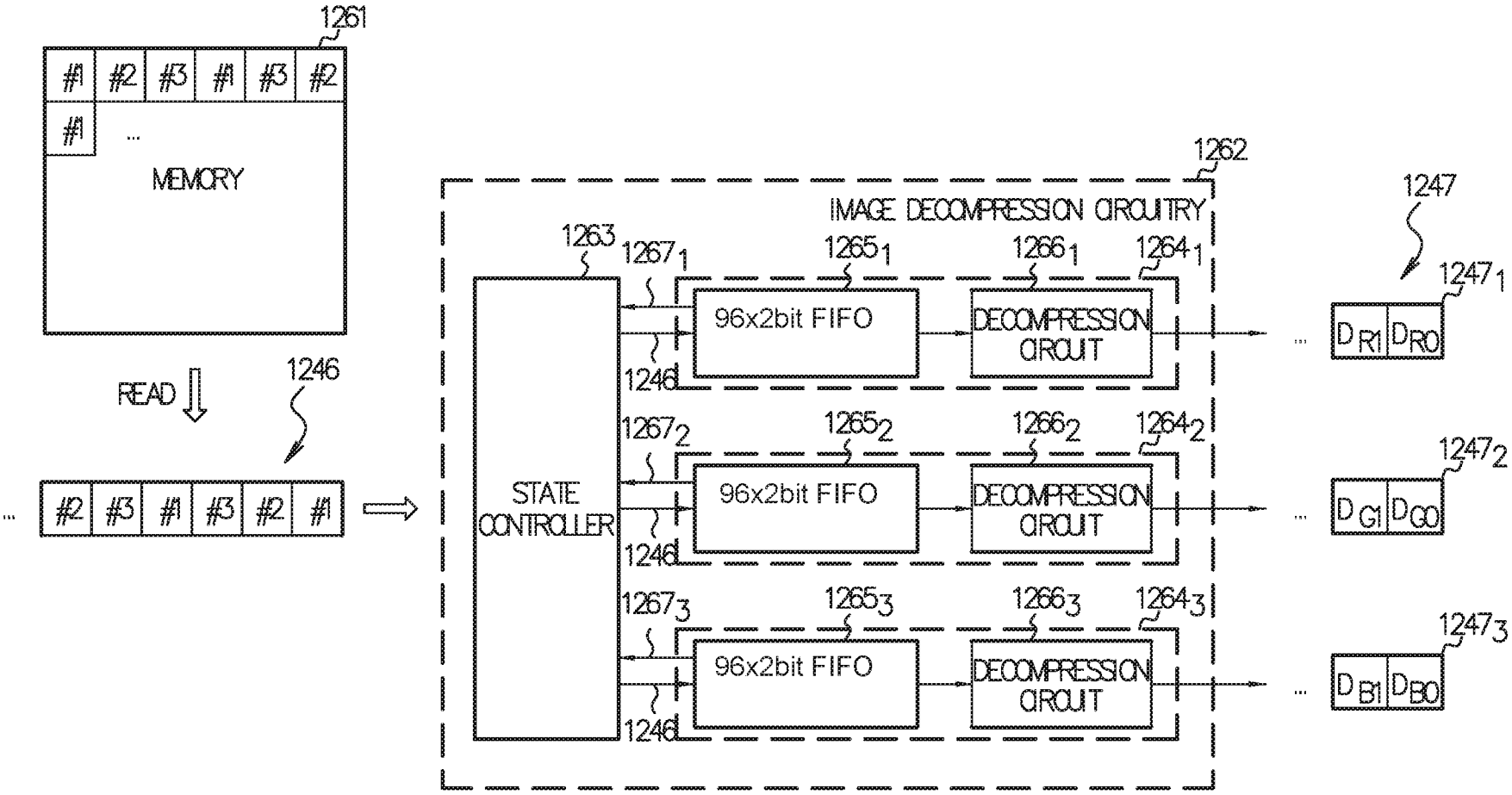
FIG. 21 is a diagram illustrating a decompression process performed in the image decompression circuitry according to one or more embodiments.

FIG. 21 is a diagram illustrating the decompression process performed in the image decompression circuitry 1262 according to one embodiment. The state controller 1263 reads out the blocks enclosing the compressed image data 1246 from the memory 1224 and delivers the to the processing circuits $\mathbf{1264}_1$ to $\mathbf{1264}_3$ in response to the request signals $\mathbf{1267}_1$ to $\mathbf{1267}_3$ received from the processing circuits $\mathbf{1264}_1$ to $\mathbf{1264}_3$.

In one embodiment, in the image display performed in a specific frame period, six fixed-length blocks are first sequentially read out by the state controller 1263 and the compressed image data 1246 of two fixed-length blocks are stored in each of the FIFOs $\mathbf{1265}_1$ to $\mathbf{1265}_3$ of the processing circuits $\mathbf{1264}_1$ to $\mathbf{1264}_3$.

Subsequently, the compressed image data 1246 is sequentially transmitted from the FIFOs $\mathbf{1265}_1$ to $\mathbf{1265}_3$ to the decompression circuits $\mathbf{1266}_1$ to $\mathbf{1266}_3$ in the processing circuits $\mathbf{1264}_1$ to $\mathbf{1264}_3$, and the decompression circuits $\mathbf{1266}_1$ to $\mathbf{1266}_3$ sequentially perform the decompression process on the compressed image data 1246 received from the FIFOs $\mathbf{1265}_1$ to $\mathbf{1265}_3$ to thereby generate processed image data $\mathbf{1247}_1$, $\mathbf{1247}_2$ and $\mathbf{1247}_3$, respectively. As described above, the decompressed image data 1247 is composed of the processed image data $\mathbf{1247}_1$, $\mathbf{1247}_2$ and $\mathbf{1247}_3$.

In the illustrated embodiment of FIG. 21, the processed image data $\mathbf{1247}_1$, $\mathbf{1247}_2$ and $\mathbf{1247}_3$ are reproductions of stream data #1, #2 and #3, respectively, that is, the image data associated with the R subpixels 1206R, the G subpixels 1206G and the B subpixels 1206B, in the present embodiment. In some embodiments having more four or more subpixel types (colors), there would be four or more streams of data. In FIG. 21, the correction data associated with the R subpixels 1206R is denoted by symbols DR0, DR1 . . . , the correction data associated with the G subpixels 1206G is denoted by symbols DG0, DG1 . . . , and the correction data associated with the B subpixels 6B is denoted by symbols DB0, DB1 . . . . The R subpixels 1206R of the display panel 1201 are driven in response to the associated image data DRi, the G subpixels 1206G of the display panel 1201 are driven in response to the associated image data DGi, and the B subpixels 1206B of the display panel 1201 are driven in response to the associated image data DBi.

In the operation described above, the FIFO $\mathbf{1265}_1$ of the processing circuit $\mathbf{1264}_1$ activates the request signal $\mathbf{1267}_1$ every when transmitting compressed image data 1246 of one fixed-length block to the decompression circuit $\mathbf{1266}_1$. In one embodiment, when the request signal $\mathbf{1267}_1$ is activated to request for read of a fixed-length block, the state controller 1263 reads out one block from the memory 1261 and supplies the block to the FIFO $\mathbf{1265}_1$.

Processing circuits $\mathbf{1264}_2$ and $\mathbf{1264}_3$ function similar to that of processing system $\mathbf{1264}_1$. In one embodiment, the FIFO $\mathbf{1265}_2$ of the processing circuit $\mathbf{1264}_2$ activates the request signal $\mathbf{1267}_2$ every when transmitting compressed image data 1246 of one fixed-length block to the decompression circuit $\mathbf{1266}_2$. Request signal $\mathbf{1267}_2$ indicates a request for read of a block, the state controller 1263 reads out one block from the memory 1261 and supplies the block to the FIFO $\mathbf{1265}_2$. In one or more embodiments, the FIFO $\mathbf{65}_3$ of the processing circuit $\mathbf{1264}_3$ activates the request signal $\mathbf{1267}_3$ when transmitting compressed image data 1246 of one fixed-length block to the decompression circuit $\mathbf{1266}_3$. Further, when the request signal $\mathbf{1267}_3$ is activated to request a block, the state controller $\mathbf{1260}_3$ reads out one block from the memory 1261 and supplies the block to the FIFO $\mathbf{1265}_3$.

In various embodiments, the code lengths of the compressed image data 1246 transmitted from the FIFOs $\mathbf{1265}_1$ to $\mathbf{1265}_3$ to the decompression circuits $\mathbf{1266}_1$ to $\mathbf{1266}_3$ may be different from one another, even though the decompression circuits $\mathbf{1266}_1$ to $\mathbf{1266}_3$ generate the processed image data $\mathbf{1247}_1$ to $\mathbf{1247}_3$ associated with the same number of subpixels per clock cycle. This implies that the order in which the FIFOs $\mathbf{1265}_1$ to $\mathbf{1265}_3$ require reading of the state controller 1263 is dependent on the code lengths of the compressed image data 1246 used in the decompression process in the decompression circuits $\mathbf{1266}_1$ to $\mathbf{1266}_3$.

In one or more embodiments, to address such situations and thereby facilitate the access control of the memory 1261, in one embodiment, the host device 1202 sorts the blocks enclosing the compressed image data 1246 into the order in which the blocks is requested by the processing circuits $\mathbf{1264}_1$ to $\mathbf{1264}_3$, and supplies the sorted blocks to the display driver 1203A to store the same into the memory 1261.

In some embodiments, the order in which the processing circuits $\mathbf{1264}_1$ to $\mathbf{1264}_3$ of the image decompression circuitry 1262 requests blocks is determined in advance, since the contents of the decompression process performed by the processing circuits $\mathbf{1264}_1$ to $\mathbf{1264}_3$ are determined in advance. Hence, the order in which the host device 1202 is configured to sort the blocks enclosing the compressed image data 1246 is available in advance. The host device 1202 may be configured to sort the blocks into the order in which the blocks are requested by the processing circuits $\mathbf{1264}_1$ to $\mathbf{1264}_3$ of the image decompression circuitry 1262 and supplies the sorted blocks to the display driver 1203A.

The order in which the processing circuits $\mathbf{1264}_1$ to $\mathbf{1264}_3$ request the supply of the fixed-length blocks may be determined by the host device 1202, as the host device performs the same process as the process performed on the fixed-length blocks by the state controller 1263 and the processing circuits $\mathbf{1264}_1$ to $\mathbf{1264}_3$ with software. In one embodiment, before the host device 1202 transmits the blocks enclosing the compressed image data 1246 to the display driver 1203A, the host may determine the order to sort the blocks. For example, the host device 1202 may determine the order into which the blocks are to be sorted, by simulating the process performed on the fixed-length blocks by the state controller 1263 and the processing circuits $\mathbf{1264}_1$ to $\mathbf{1264}_3$ with software. Further, the compression software installed on the storage device 1212 of the host device 1202 may include a software module which simulates the process same as the process performed on the blocks by the state controller 1263 and the processing circuits $\mathbf{1264}_1$ to $\mathbf{1264}_3$.

As described above, in the display system 1210 of one embodiment, the host device 1202 is configured to sort the blocks enclosing the compressed image data 1246 into the order in which the blocks are provided to the processing circuits 641 to $\mathbf{1264}_3$ of the image decompression circuitry 1262. The host device may be further configured to supply the sorted blocks to the display driver 1203A and store the same into the memory 1261. This allows matching the order in which the state controller 1263 reads out the blocks from the memory 1261 in response to the requests from the processing circuits $\mathbf{1264}_1$ to $\mathbf{1264}_3$ with the order in which the fixed-length blocks are stored in the memory 1261. This operation is effective for facilitating the access control of the memory 1261. For example, the operation of the present embodiment eliminates the need of performing random accesses to the memory 1261. This is effective for reducing the circuit size of the memory 1261.

Figure 22:
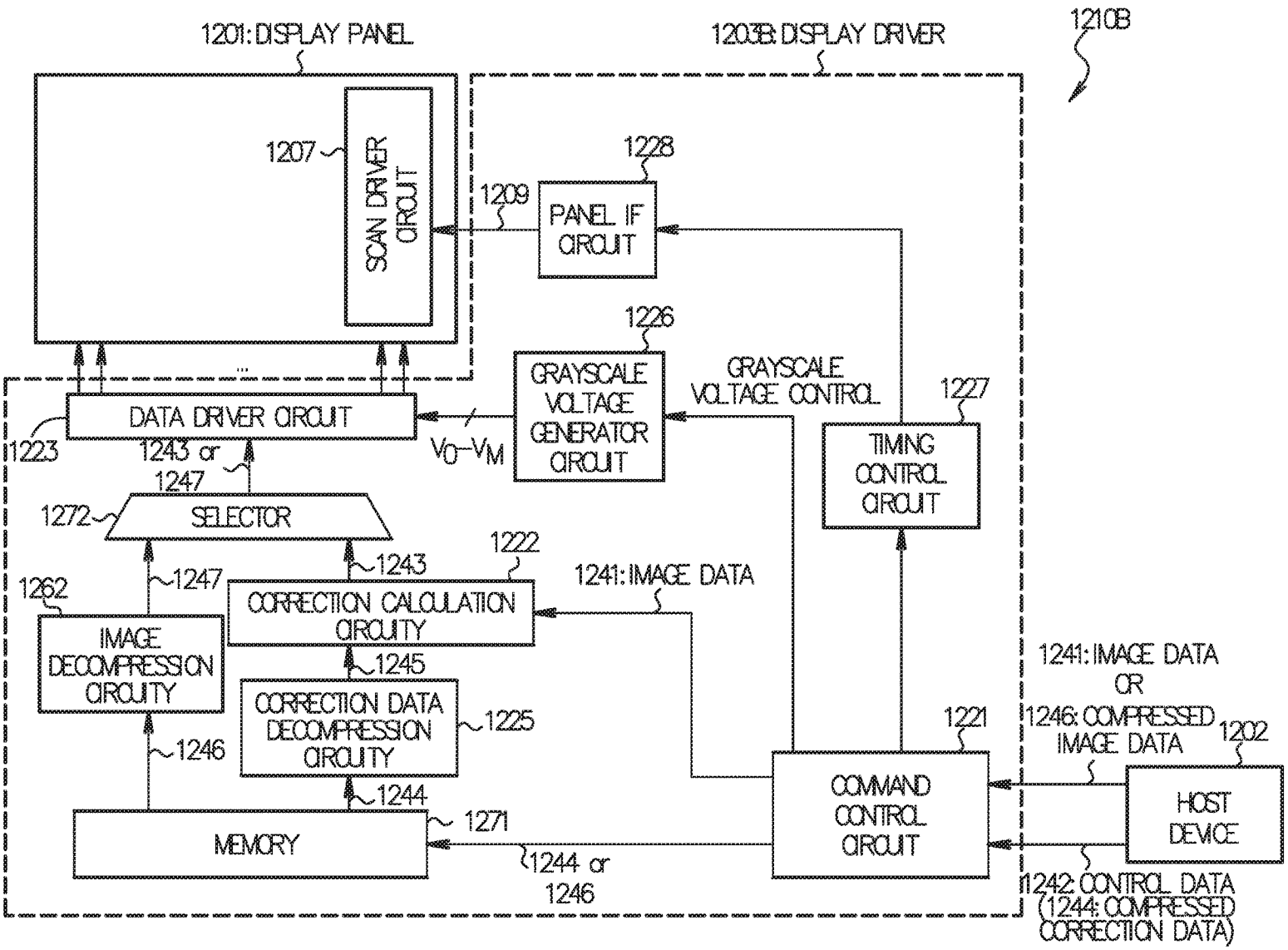
FIG. 22 is a block diagram illustrating the configuration of a display system according to one or more embodiments.

FIG. 22 is a block diagram illustrating the configuration of the display system 1210B, more particularly to a display driver 1203B in another embodiment. The configuration of the display system 1210B of the illustrated embodiment is similar to those of the display system 1210 and the display system 1210A of the earlier embodiments. The display system 1210B of the embodiment of FIG. 22 is configured to be adapted to both of the operations of the display system 1210 and the display system 1210A of the earlier embodiments. The display system 1210B may be configured to selectively perform a selected one of the operations of the earlier embodiments, in response to the setting of the operation mode.

In the embodiment of FIG. 22, the display driver 1203B includes the correction calculation circuitry 1222, the correction data decompression circuitry 1225, the image decompression circuitry 1262, a memory 1271 and a selector 1272. In one embodiment, the memory 1271 is used to store both of the compressed correction data 1244 and the compressed image data 1246.

The configurations and operation of the correction calculation circuitry 1222 and the correction data decompression circuitry 1225 is as described in the embodiments described in the above. The correction data decompression circuitry 1225 receives the compressed correction data 1244 from the memory 1271 and performs the decompression process on the received compressed correction data 1244 to generate the decompressed correction data 1245. The correction calculation circuitry 1222 generates the corrected image data 1243 by correcting the image data on the basis of the decompressed correction data 1245.

Further, the configuration and operation of the image decompression circuitry 1262 is as described in one or more of the above embodiments. The image decompression circuitry 1262 receives the compressed image data 1246 from the memory 1271 and generates the decompressed image data 1247 by performing the decompression process on the received compressed image data 1246.

The selector 1272 selects one of the correction calculation circuitry 1222 and the image decompression circuitry 1262 in response to the operation mode, and connects the output of the selected circuitry to the data driver circuit 1223. The operation of the selector 1272 allows the display system 1210B of the embodiment of FIG. 22 to selectively perform the operations of the earlier embodiments.

Figure 23:
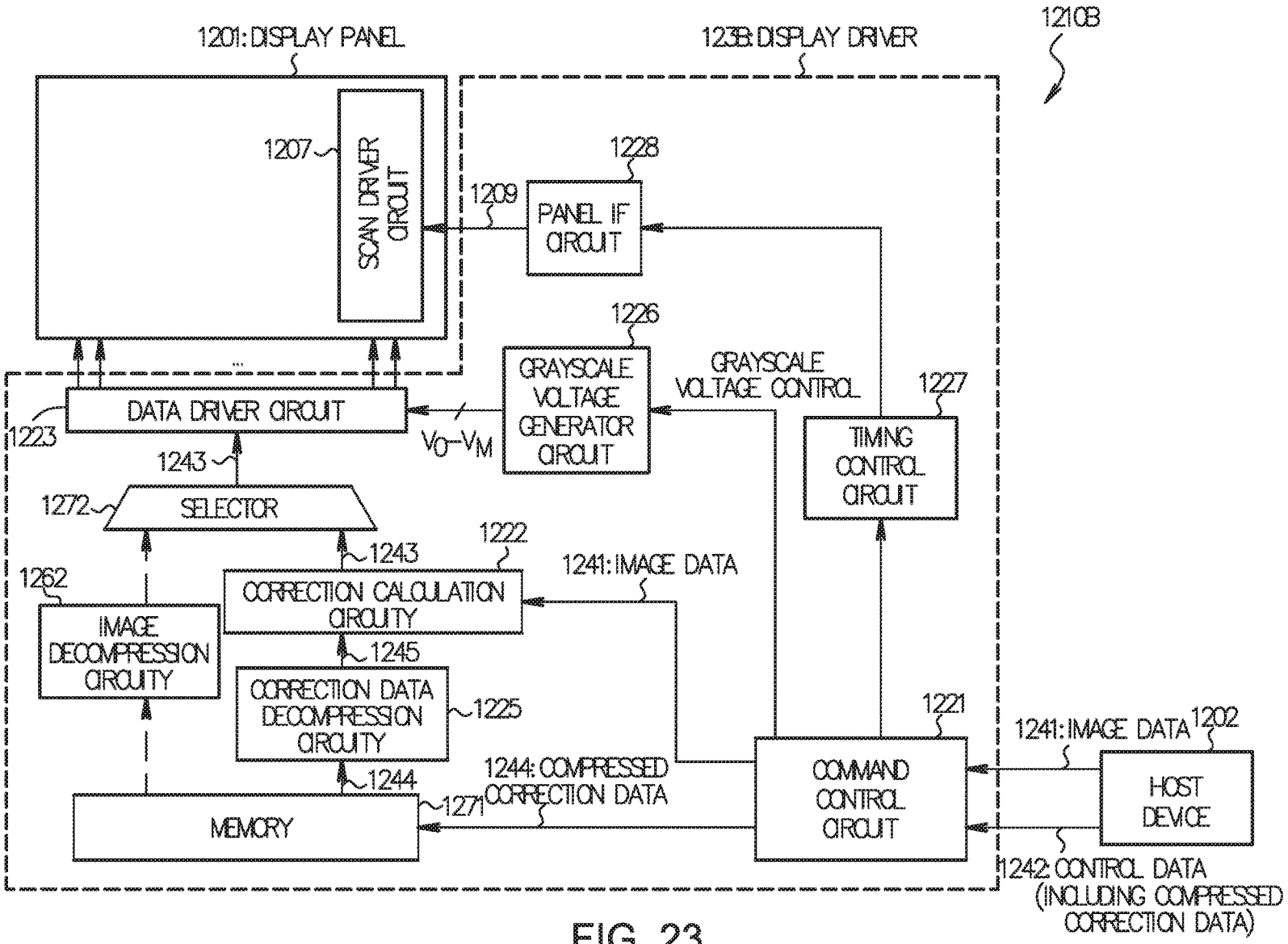
FIG. 23 is a block diagram illustrating the operation of the display system in one embodiment.

FIG. 23 is a block diagram illustrating the operation of the display system 1210B of one embodiment when the display system 1210B is placed in a first operation mode. When placed in the first operation mode, the display system 1210B operates similarly to the display system 1210 described in earlier embodiments. The selector 1272 selects the correction calculation circuitry 1222 and supplies the corrected image data 1243 received from the correction calculation circuitry 1222 to the data driver circuit 1223. More specifically, the display system 1210B operates as follows, when placed in the first operation mode.

In one embodiment, before image displaying, the compressed correction data 1244 is supplied from the host device 1202 to the display driver 1203B and written into the memory 1271. When an image is subsequently displayed on the display panel 1201, image data 1241 corresponding to the image is supplied from the host device 1202 to the display driver 1203B. The image data 1241 supplied to the display driver 1203B is supplied to the correction calculation circuitry 1222.

Further, the compressed correction data 1244 is read out from the memory 1271 and supplied to the correction data decompression circuitry 1225. The correction data decompression circuitry 1225 decompresses the compressed correction data 1244 to generate the decompressed correction data 1245. The decompressed correction data 1245 is generated for the respective subpixels (the R subpixels 1206R, G subpixels 1206G and B subpixels 1206B) of the pixels 8 of the display panel 1201.

The correction calculation circuitry 1222 is configured to correct The image data 1241 in response to the decompressed correction data 1245 received from the correction data decompression circuitry 1225 to generate the corrected image data 1243. In correcting the image data 1241 associated with a certain subpixel of a certain pixel 1208, the decompressed correction data 1245 associated with the certain subpixel of the certain pixel 1208 is used to thereby generate the corrected image data 1243 associated with the certain subpixel of the certain pixel 1208. The corrected image data 1243 thus generated is transmitted to the data driver circuit 1223 and used to drive the respective subpixels of the respective pixels 8 of the display panel 1201.

Figure 24:
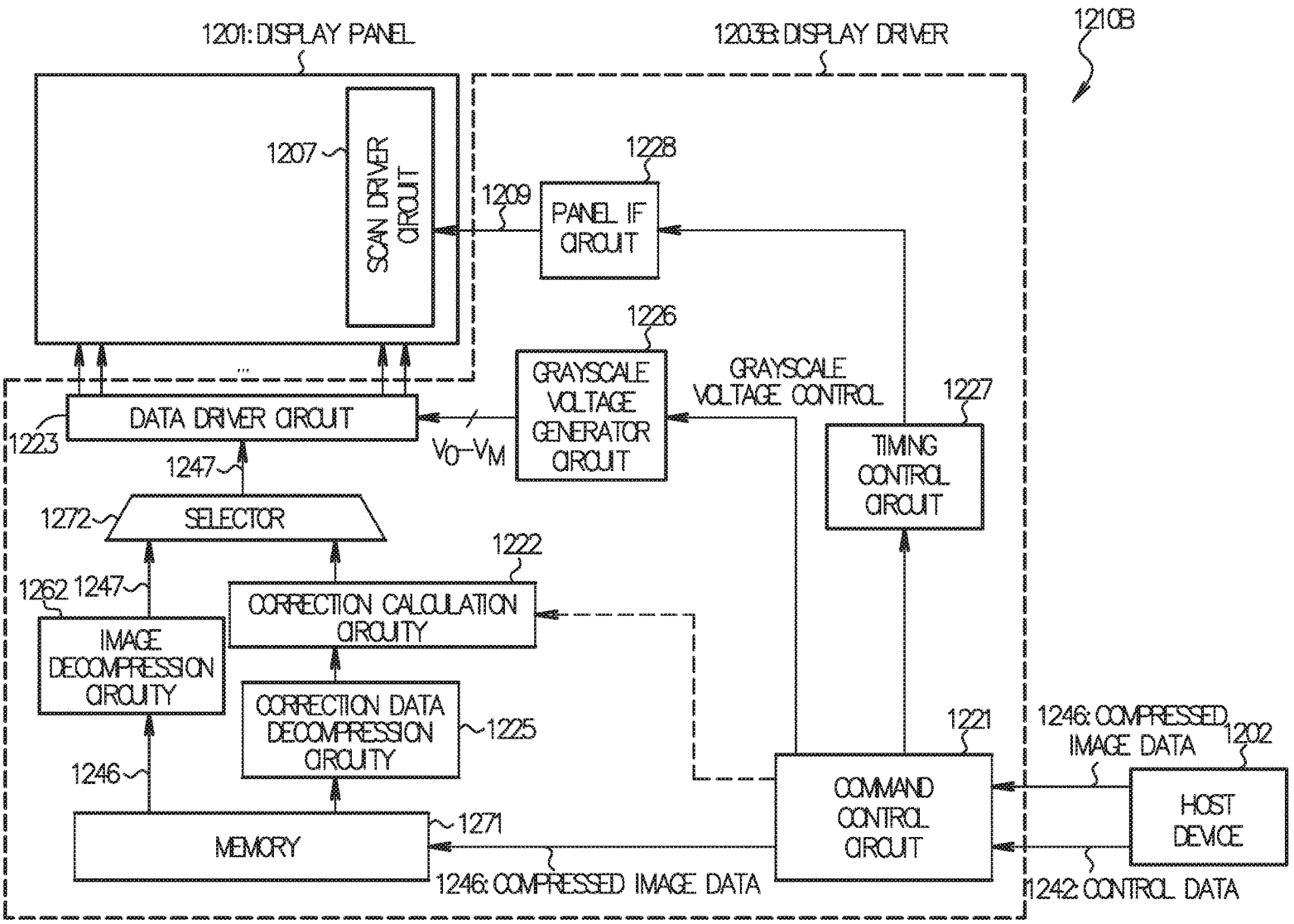
FIG. 24 is a block diagram illustrating the operation of the display system in one embodiment.

FIG. 24 is a block diagram illustrating the operation of the display system 1210B in an embodiment where the display system 1210B is placed in a second operation mode. When placed in the second operation mode, the display system 1210B operates similarly to the display system 1210A. In one embodiment, the selector 1272 selects the image decompression circuitry 1262 and supplies the decompressed image data 1247 received from the image decompression circuitry 1262 to the data driver circuit 1223. The decompressed image data 1247 thus generated is transmitted to the data driver circuit 1223 and used to drive the respective subpixels of the respective pixels 8 of the display panel 1201.

The display system 1210B is adapted to both of the operations described in the earlier embodiments. The display system 1210B, in which the memory 1271 is used for both of the operations performed described in the earlier embodiments, effectively suppresses an increase in the circuitry size.

Image Data Processing

In a display driver which drives a display panel, such as an organic light emitting diode (OLED) display panel and a liquid crystal display panel, voltage data corresponding to drive voltages to be supplied to the display panel may be generated from grayscale values of respective subpixels of respective pixels described in image data.

Figure 25:
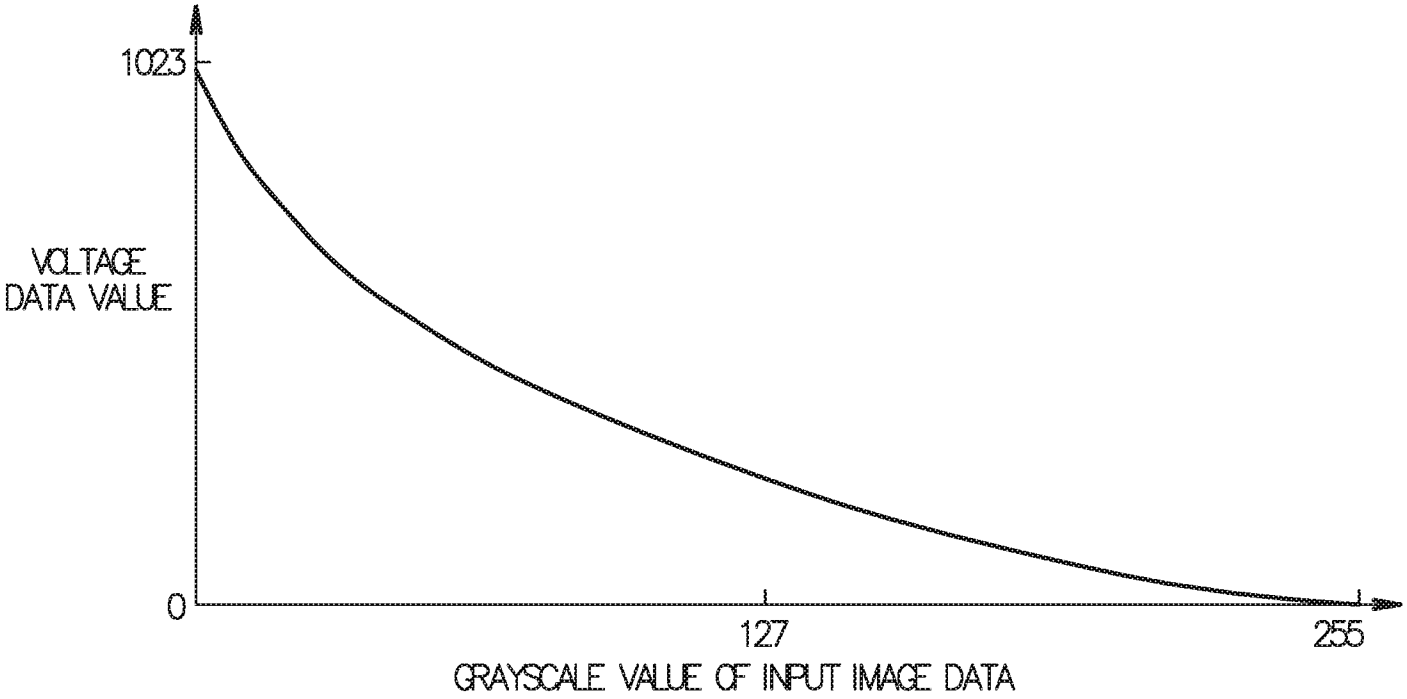
FIG. 25 is a graph illustrating one example of the correspondence relationship between the grayscale value of a subpixel described in an image data and the value of a voltage data.

FIG. 25 is a graph illustrating one exemplary correspondence relationship between the grayscale value of a subpixel described in an image data and the value of a voltage data. In FIG. 25, the graph of the correspondence relationship between the grayscale value and the value of the voltage data is illustrated with an assumption that the voltage proportional to the value of the voltage data is programmed to each subpixel of each pixel of a display panel, in relation to the processing of the image data in driving the display panel. When the grayscale value of a certain subpixel is "0", for example, the value of the voltage data associated with the subpixel of interest is set to "1023"; in this case, the subpixel of interest is programmed with a drive voltage corresponding to the value "1023" of the voltage data, that is, a drive voltage of 5V in the example illustrated in FIG. 25. The brightness is increased as the drive voltage is lowered when the display panel is driven with voltage programming. In various embodiments, the correspondence relationship between the grayscale value of a subpixel described in an image data and the value of the voltage data is also dependent on the type of display panel. For example, in driving a liquid crystal display panel, the correspondence relationship between the grayscale value of a subpixel and the value of a voltage data is determined in general so that the drive voltage is generated so as to increase the difference between the drive voltage and the voltage on the common electrode (that is, the common level) as the grayscale value of the subpixel is increased.

In one or more embodiments, a correction may be performed on an image data to improve the image quality of the image displayed on a display panel. In a display device including an OLED display panel, for example, there exist variations in the properties of OLED light emitting elements included in respective subpixels (respective pixel circuits) and the variations in the properties may cause a deterioration of the image quality, including display mura. In such a case, the display mura can be suppressed by preparing correction data for respective subpixels of respective pixels of the OLED display panel and correcting the image data corresponding to the respective pixel circuits in response to the prepared correction data.

Figure 26:
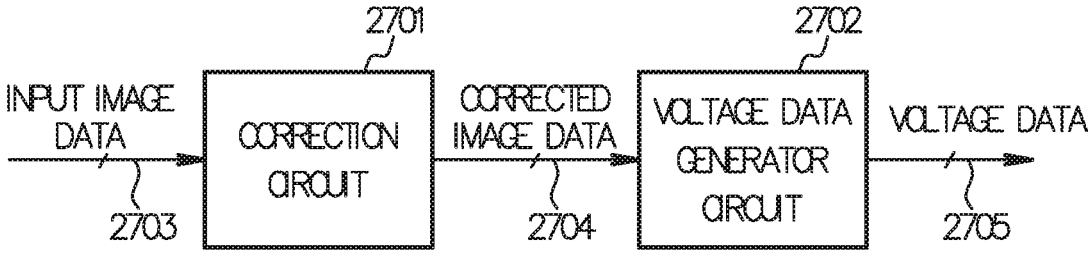
FIG. 26 illustrates one example of the circuit configuration which generates a corrected image data by correcting an input image data and generates a voltage data from the corrected image data.

FIG. 26 illustrates one example of the circuit configuration in which corrected image data are generated by correcting input image data and voltage data are generated from the corrected image data. In the configuration illustrated in FIG. 26, a correction circuit 2701 generates corrected image data 2704 by correcting input image data 2703, and a voltage data generator circuit 2702 generates voltage data 2705 from the corrected image data 2704. In one embodiment, an input image data 2703 and corrected image data 2704 both describe the grayscale value of each subpixel with eight bits.

Figure 27:
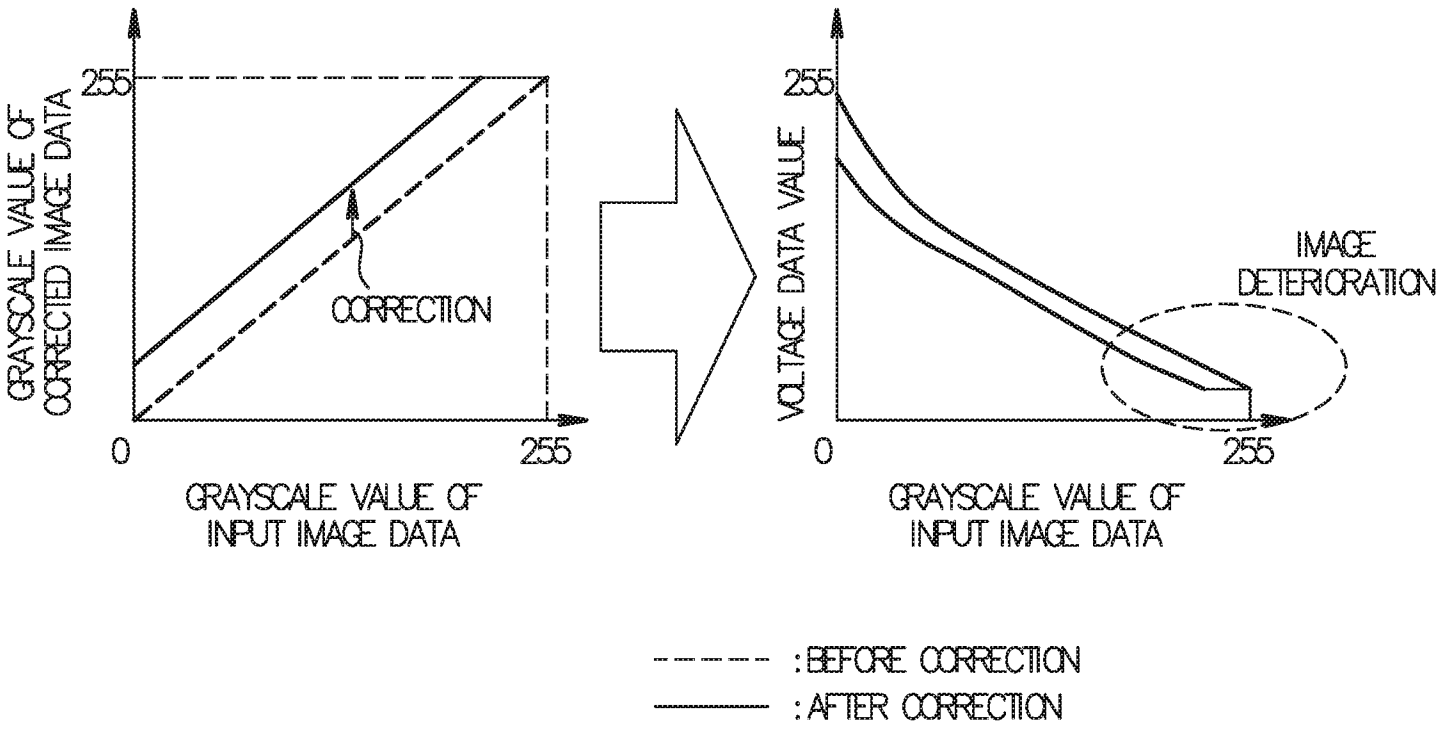
FIG. 27 is a diagram illustrating a problem that an appropriate correction is not achieved when the grayscale value of an input image data is closed to the allowed maximum or allowed minimum grayscale value.

In one or more embodiments, the grayscale value of an input image data 2703 supplied to the correction circuit 2701 may be close to the allowed maximum grayscale value or the allowed minimum grayscale value. As illustrated in FIG. 27, when the correction circuit 2701 performs a correction which increases the grayscale value, the grayscale value of the corrected image data 2704 may be saturated at the allowed maximum grayscale value. The value of the voltage data may also be saturated, affecting the image quality. Similarly, the correction circuit 2701 may perform a correction which decreases the grayscale value, and the gray scale value may be saturated when an input image data 2703 having a grayscale value close to the allowed minimum grayscale value is supplied to the correction circuit 2701.

In one or more embodiments, increasing the bit width of the corrected image data 2704 supplied to the voltage data generator circuit 2702 may allow further corrections to the image data. The increase in the bit width of the corrected image data may, however, increase the circuit size of the voltage data generator circuit 2702.

In yet other embodiments, the voltage offset of a subpixel of a display panel is cancelled through correction in a display driver configured to generate drive voltages proportional to the values of voltage data, and the voltage data may be corrected so as to cancel the voltage offset. The circuit configuration illustrated in FIG. 26 only allows indirectly correcting the value of the voltage data 2705 through correcting the input image data 2703. The value of the voltage data 2705 obtained as a result of the correction on the image data 2703 is not equivalent to the value obtained by directly correcting the voltage data 2705. This may affect the image quality.

As discussed above, there exists a technical need for suppressing the image quality deterioration when image data correction is performed in a display driver configured to generate voltage data corresponding to drive voltages to be supplied to a display panel from the grayscale values of respective subpixels of respective pixels described in image data.

Figure 28:
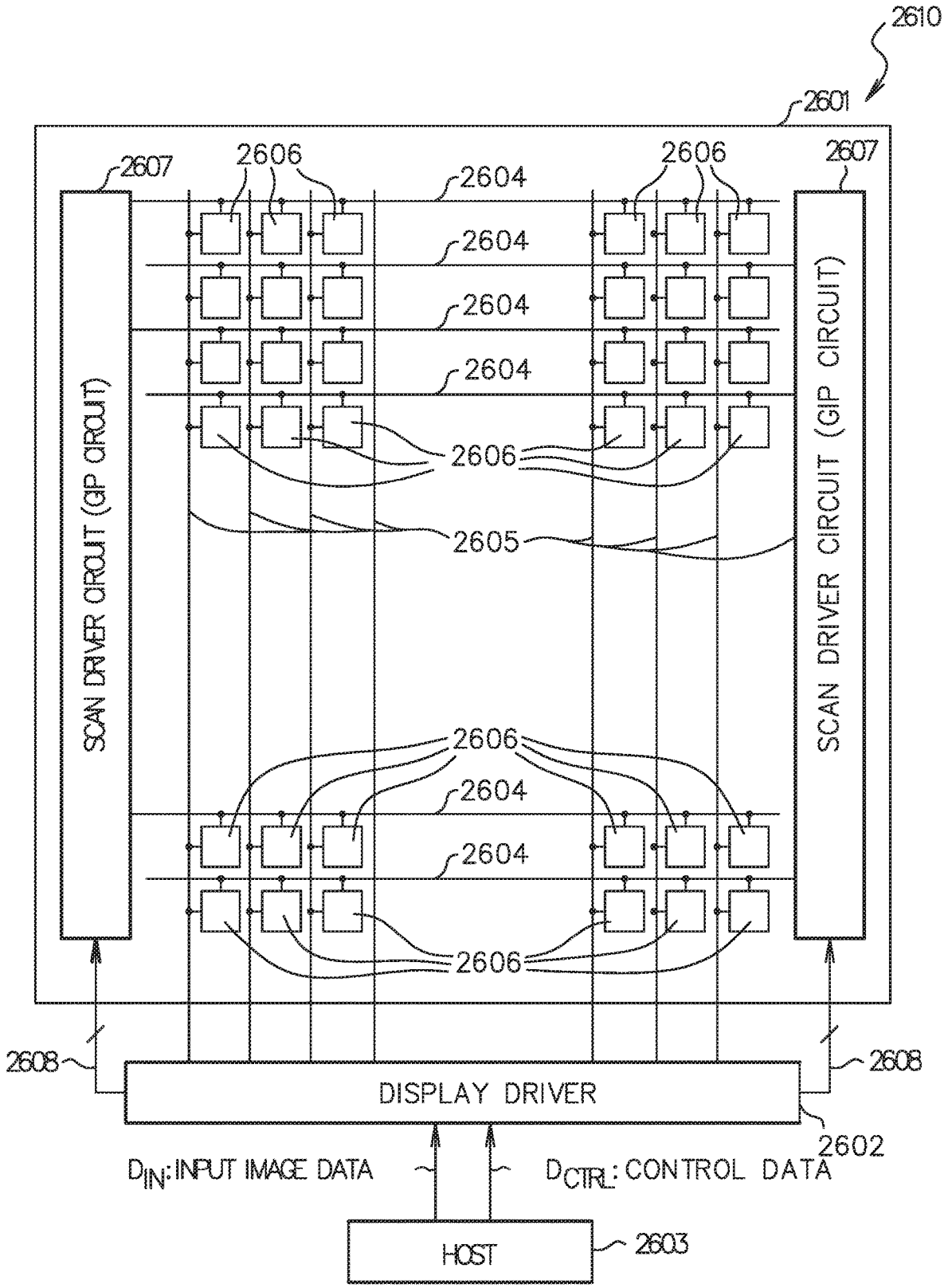
FIG. 28 is a block diagram illustrating the configuration of a display device in one embodiment.

FIG. 28 is a block diagram illustrating the configuration of a display device 2610 according to one or more embodiments. The display device 2610 of FIG. 28 includes a display panel 2601 and a display driver 2602. An OLED display panel or a liquid crystal display panel may be used as the display panel 2601, for example. The display driver 2602 drives the display panel 2601 in response to input image data DIN and control data DCTRL which are received from a host 2603. The input image data DIN describe the grayscale values of the respective subpixels (e.g., R (red) subpixels, G (green) subpixels, B (blue) subpixels, and/or W (white) subpixels) of the respective pixels of images to be displayed. In one embodiment, the input image data DIN describe the grayscale value of each subpixel of each pixel with eight bits. The control data DCTRL include commands and parameters for controlling the display driver 2602.

Further, the display panel 2601 includes scan lines 2604, data lines 2605, pixel circuits 2606, and scan driver circuits 2607.

In one or more embodiments, each of the pixel circuits 2606 is disposed at an intersection of a scan line 2604 and a data line 2605 and configured to display a selected one of the red, green and blue colors. The pixel circuits 2606 displaying the red color are used as R subpixels. Similarly, the pixel circuits 2606 displaying the green color are used as G subpixels, and the pixel circuits 2606 displaying the blue color are used as B subpixels. Further, in some embodiments, the pixel circuits 2606 displaying other colors may be used with corresponding subpixels. When an OLED display panel is used as the display panel 2601, in one embodiment, the pixel circuits 2606 displaying the red color may include an OLED element emitting red colored light, the pixel circuits 2606 displaying the green color may include an OLED element emitting green colored light, and the pixel circuits 2606 displaying the blue color may include an OLED element emitting blue colored light. Various embodiments may employ OLED elements configured to emit colors other than red, green blue. Alternatively, each pixel circuit 2606 may include an OLED element emitting white-colored light and the color displayed by each pixel circuit 6 (red, green, blue or another color) may be set with a color filter. In embodiments, when an OLED display panel is used as the display panel 2601, other signal lines for operating the light emitting elements within the respective pixel circuits 2606, such as emission lines used for controlling light emission of the light emitting elements of the respective pixel circuits 2606, may be disposed.

The scan driver circuits 2607 may drive the scan lines 4 in response to scan control signals 2608 received from the display driver 2602. In one embodiment, a pair of scan driver circuits 2607 are provided; one of the scan driver circuits 2607 drives the even-numbered scan lines 2604 and the other drives the odd-numbered scan lines 4. In one embodiment, the scan driver circuits 2607 are integrated in the display panel 2601 with a gate-in-panel (GIP) technology. The scan driver circuits 2607 thus configured may be referred to as GIP circuits.

Figure 29:
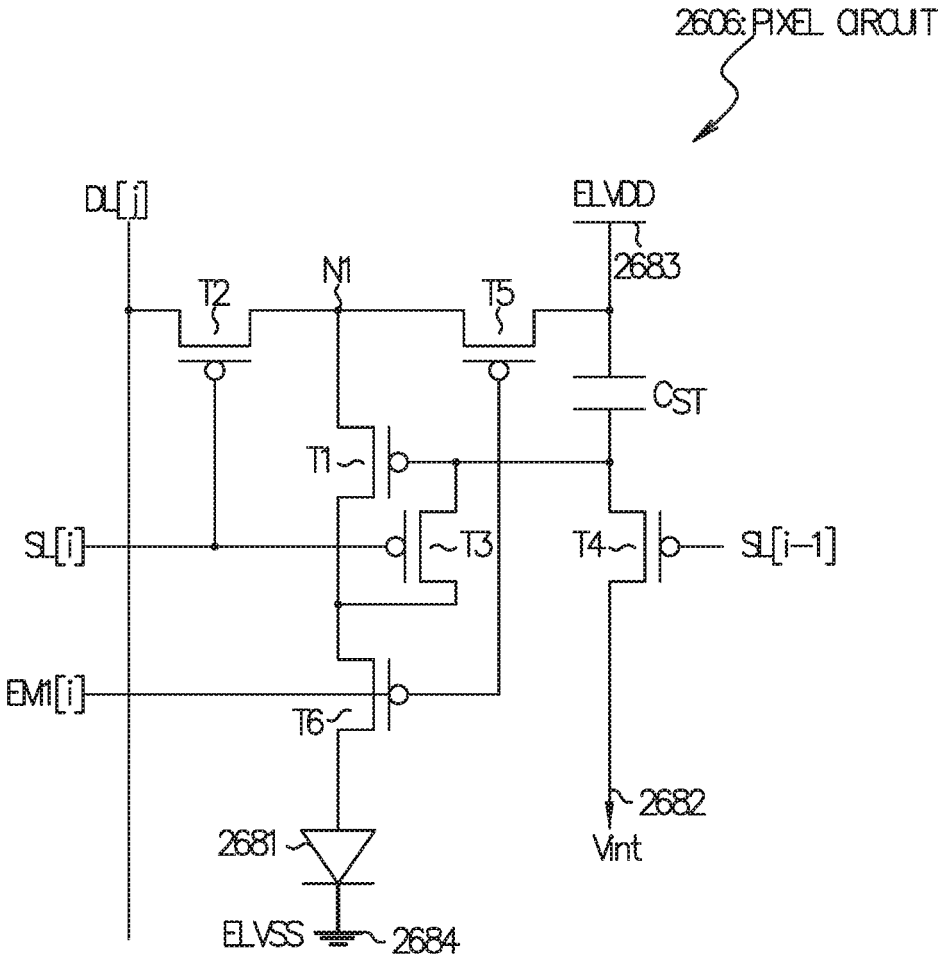
FIG. 29 is a block diagram illustrating an example of the configuration of a pixel circuit.

FIG. 29 illustrates an example of the configuration of the pixel circuit 2606 when an OLED display panel is used as the display panel 2601 according to one embodiment. In this figure, the symbol SL[i] denotes the scan line 2604 which is activated in a horizontal sync period in which data voltages are written into the pixel circuits 2606 positioned in the ith row. Similarly, the symbol SL[i−1] denotes the scan line 2604 which is activated in a horizontal sync period in which data voltages are written into the pixel circuits 2606 positioned in the (i−1)th row. In the meantime, the symbol EM[i] denotes an emission line which is activated to allow the OLED elements of the pixel circuits 2606 positioned in the ith row to emit light, and the symbol DL[j] denotes the data line 2605 connected to the pixel circuits 2606 positioned in the jth column.

Illustrated in FIG. 29 is one embodiment of a circuit configuration of each pixel circuit 2606 when the pixel circuit 2606 is configured in a so called "6T1C" structure. Each pixel circuit 2606 includes an OLED element 2681, a drive transistor T1, a select transistor T2, a threshold compensation transistor T3, a reset transistor T4, select transistors T5, T6, T7, and storage capacitor CST. The numeral 2682 denotes a power supply line kept at an internal power supply voltage Vint, the numeral 2683 denotes a power supply line kept at a power supply voltage ELVDD and the numeral 2684 denotes a ground line. In the configuration illustrated in FIG. 29, a voltage corresponding to a drive voltage supplied to the pixel circuit 2606 may be held across the storage capacitor CST, and the drive transistor T1 drives the OLED element 2681 in response to the voltage held across the storage capacitor CST.

Referring back to FIG. 28, the display driver 2602 drives the data lines 2605 in response to the input image data DIN and control data DCTRL received from the host 2603 and further supplies the scan control signals 2608 to the scan driver circuits 2607 in the display panel 2601.

Figure 30:
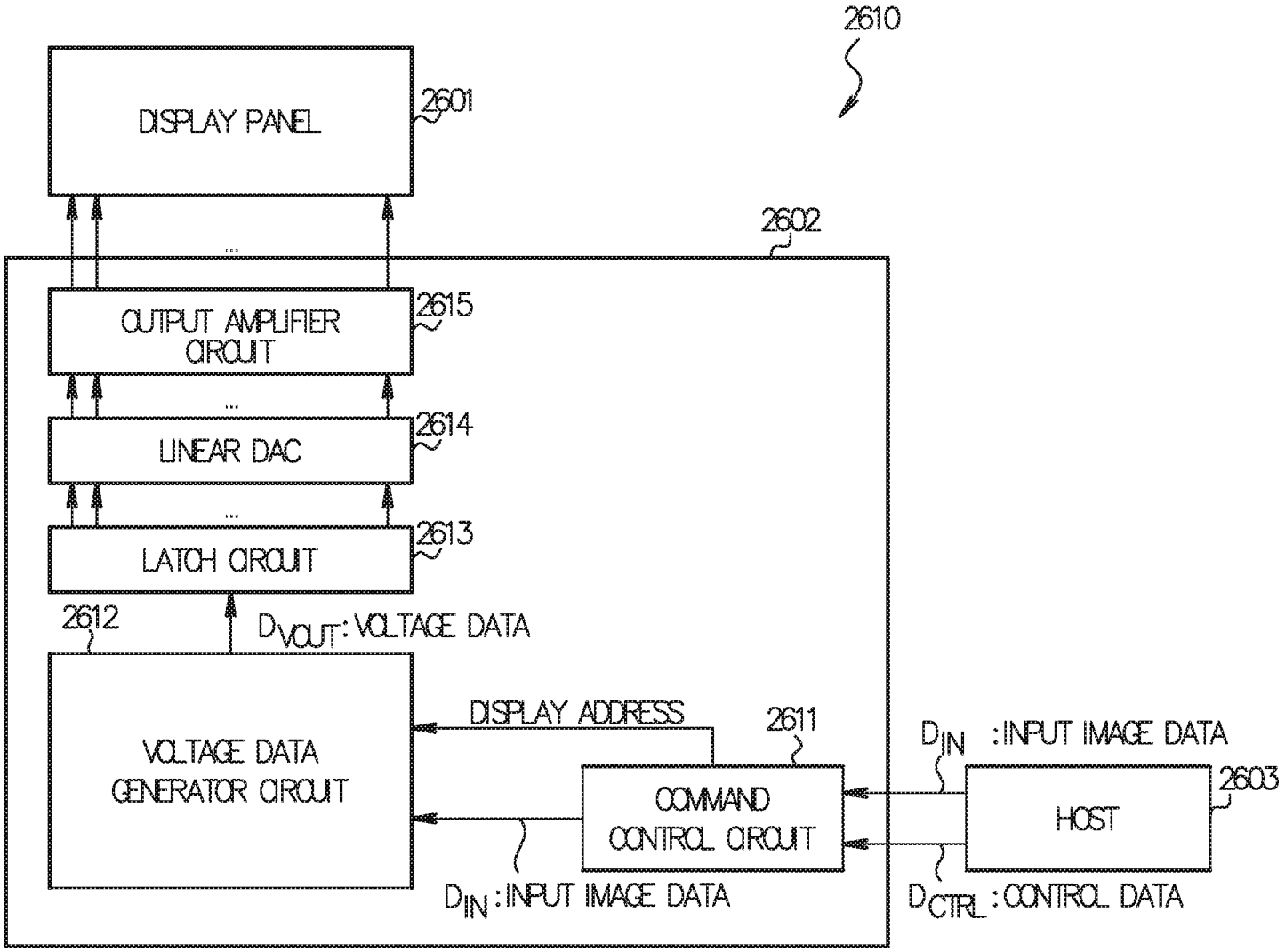
FIG. 30 is a block diagram schematically illustrating the configuration of a display driver according to one or more embodiments.

FIG. 30 is a block diagram schematically illustrating the configuration of a part of the display driver 2602 which is relevant to the driving of the data lines 2605 according to one embodiment, where the display driver 2602 includes a command control circuit 2611, a voltage data generator circuit 2612, a latch circuit 2613, a linear DAC (digital-analog converter) 14, and an output amplifier circuit 2615.

In one embodiment, the command control circuit 2611 forwards the input image data DIN received from the host 2603 to a data correction circuit 2624A. Additionally, the command control circuit 2611 controls the respective circuits of the display driver 2602 in response to various control parameters and commands included in the control data DCTRL.

The voltage data generator circuit 2612 generates voltage data DVOUT from the input image data DIN received from the command control circuit 2611. The voltage data DVOUT are data specifying the voltage levels of drive voltages to be supplied to the data lines 2605 of the display panel 2601 (that is, drive voltages to be supplied to the pixel circuits 2606 connected to a selected scan line 2604). In the present embodiment, the voltage data generator circuit 2612 holds a correction data associated with each pixel circuit 2606 of the display panel 2601, that is, each subpixel (the R, G, and B subpixels) of each pixel of the display panel 2601 and is configured to perform correction calculation based on the correction data for each pixel circuit 2606 in generating the voltage data DVOUT.

The latch circuit 2613 is configured to sequentially receive the voltage data DVOUT from the voltage data generator circuit 2612 and hold the voltage data DVOUT associated with the respective data lines 2605.

The linear DAC 2614 generates analog voltages corresponding to the respective voltage data DVOUT held by the latch circuit 2613. In the present embodiment, the linear DAC 2614 generates analog voltages having voltage levels proportional to the values of the corresponding voltage data DVOUT.

The output amplifier circuit 2615 generates drive voltages corresponding to the analog voltages generated by the linear DAC 2614 and supplies the generated drive voltages to the data lines 2605 associated therewith. In one or more embodiments, the output amplifier circuit 2615 is configured to provide impedance conversion and generate drive voltages having the same voltage levels as those of the analog voltages generated by the linear DAC 2614.

In various embodiments, the drive voltages supplied to the respective data lines 2605 have voltage levels proportional to the values of the voltage data DVOUT and data processing to be performed on the input image data DIN (for example, correction calculation) is performed by the voltage data generator circuit 2612.

Figure 31:
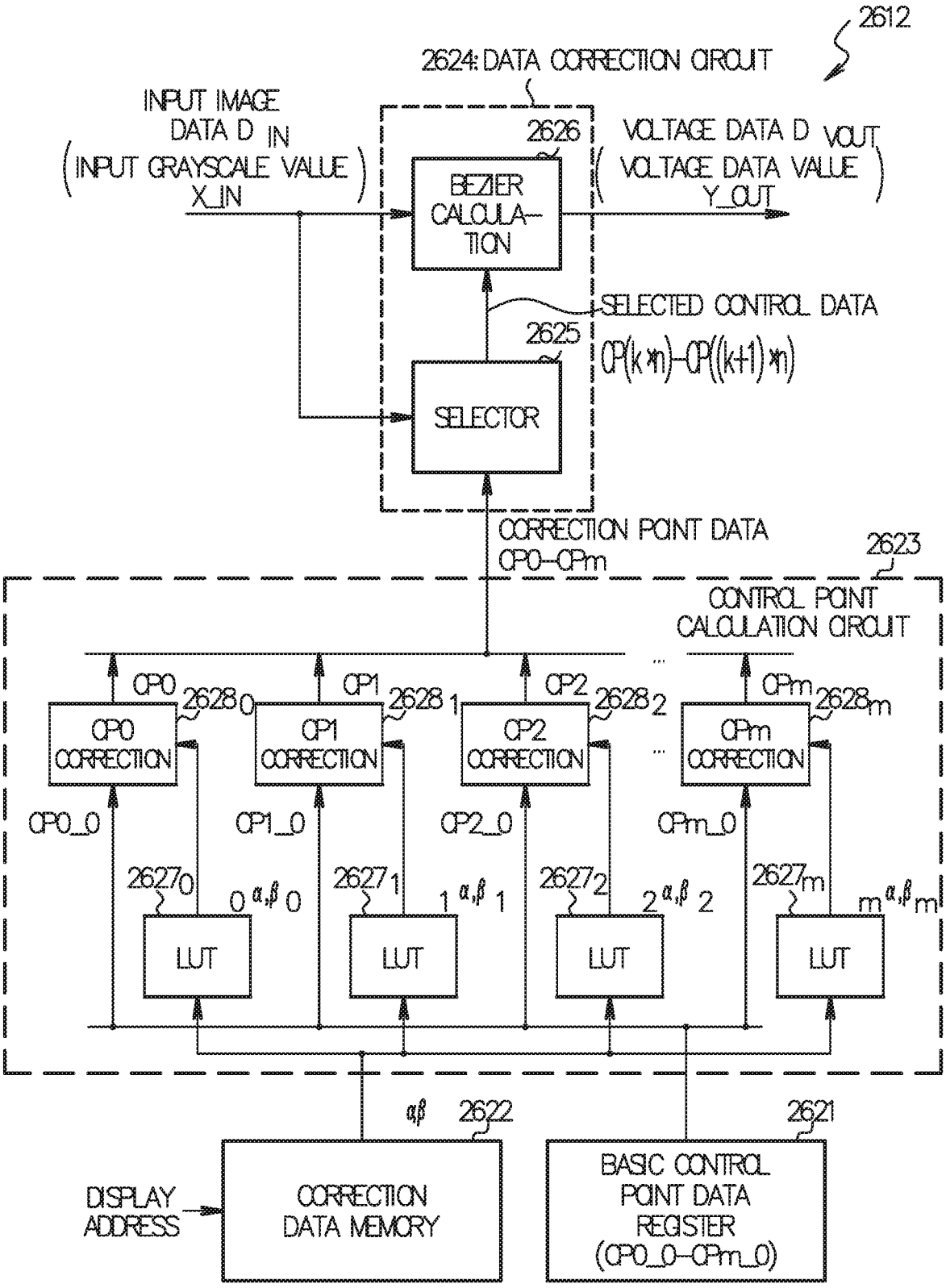
FIG. 31 is a block diagram illustrating the configuration of a voltage data generator circuit according to one or more embodiments.

FIG. 31 is a block diagram illustrating the configuration of the voltage data generator circuit 2612 according to one embodiment, where the voltage data generator circuit 2612 includes a basic control point data register 2621, a correction data memory 2622, a control point calculation circuit 2623, and a data correction circuit 2624.

In one embodiment, the basic control point data register 2621 operates as a storage circuit storing therein basic control point data CP0_0 to CPm_0. The basic control point data CP0_0 to CPm_0 referred herein are data which specify a basic correspondence relationship between the grayscale values of the input image data DIN and the values of the voltage data DVOUT.

Figure 32:
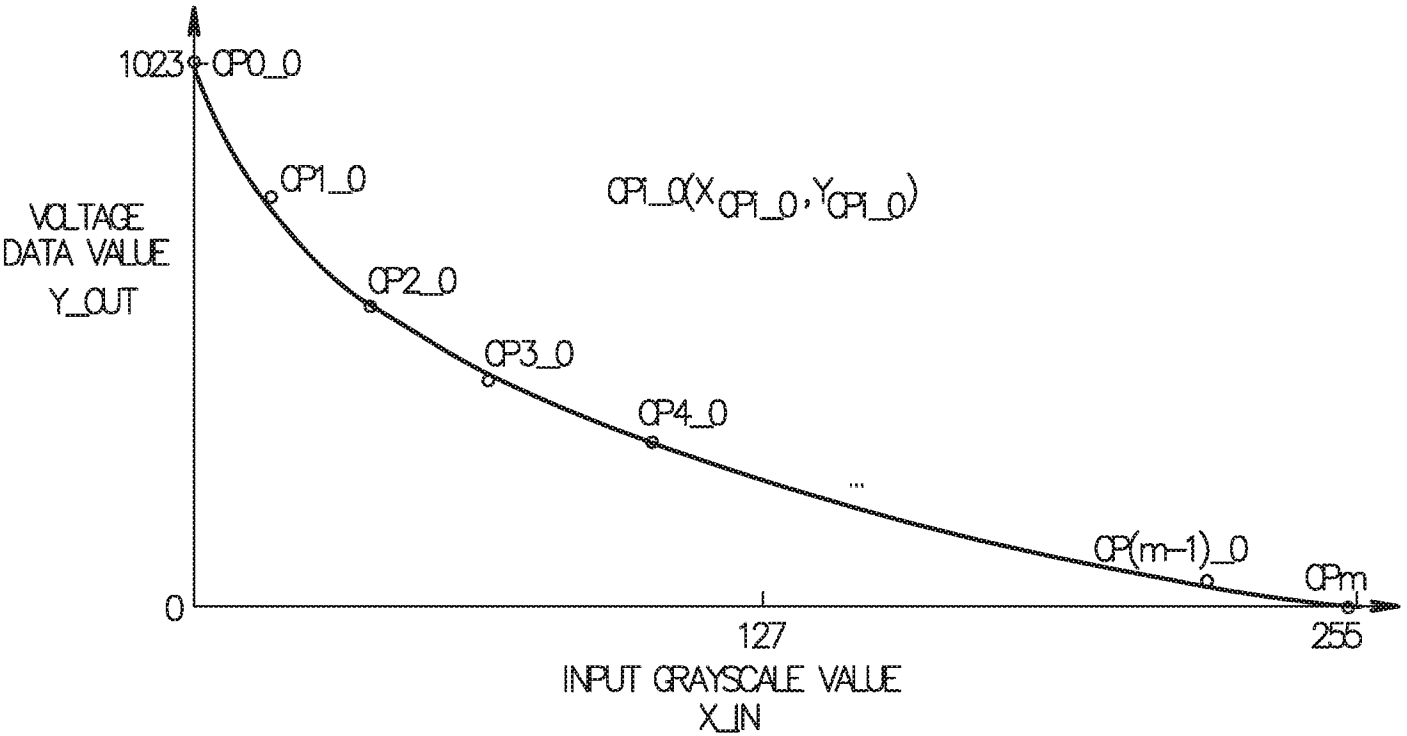
FIG. 32 is a graph schematically illustrating a basic control point data and the curve of the correspondence relationship specified by the basic control point data.

FIG. 32 is a graph schematically illustrating the basic control point data CP0_0 to CPm_0 and the curve of the correspondence relationship specified thereby. The basic control point data CP0_0 to CPm_0 are a set of data which specify coordinates of basic control points which specify the basic correspondence relationship between the grayscale value described in the input image data DIN (referred to as "input grayscale values X_IN", hereinafter) and the value of the voltage data DVOUT (referred to as "voltage data values Y_OUT", hereinafter) in an XY coordinate system in which the X axis corresponds to the input grayscale value X_IN and the Y axis corresponds to the voltage data value Y_OUT. Hereinafter, the basic control point the coordinates of which are specified by the basic control point data CPi_0 may be also referred to as the basic control point CPi_0. FIG. 32 illustrates the curve of the correspondence relationship when the input grayscale value X_IN is an eight-bit value and the voltage data value Y_OUT is a 10-bit value.

The basic control point data CPi_0 is data including the coordinates (XCPi_0, YCPi_0) of the basic control point CPi_0 in the XY coordinate system, where i is an integer from 0 to m, XCPi_0 is the X coordinate of the basic control point CPi_0 (that is, the coordinate indicating the position in a direction along the X axis direction), and YCPi_0 is the Y coordinate of the basic control point CPi_0 (that is, the coordinate indicating the position in a direction along the Y axis direction). Here, the X coordinates XCPi of the basic control point CPi_0 satisfy the following expression 2:

$$X_{CP0_0}<X_{CP1_0}< \quad . \quad . \quad . \quad <X_{CPi_0}< \quad . \quad . \quad . \quad <X_{CP(m-1)_0}<X_{CPm_0}, \text{v.} \qquad 2$$

In expression 2 the X coordinate XCP0_0 of the basic control point CP0_0 is the allowed minimum value of the input grayscale value X_IN (that is, "0") and the X coordinate XCPm_0 of the basic control point CPm_0 is the allowed maximum value of the input grayscale value X_IN (that is, "255").

Referring back to FIG. 31, the correction data memory 2622 stores therein correction data α and β for each pixel circuit 2606 (that is, each subpixel of each pixel) of the display panel 1. The correction data α and β are used for correction of the basic control point data CP0_0 to CPm_0. As is described later in detail, the correction data α are used for correction of the X coordinates XCP0_0 to XCPm_0 of the basic control points described in the basic control point data CP0_0 to CPm_0 and the correction data β are used for correction of the Y coordinates YCP0_0 to YCPm_0 of the basic control points described in the basic control point data CP0_0 to CPm_0. When the value of the voltage data DVOUT corresponding to a certain pixel circuit 2606 is calculated, the display address corresponding to the pixel circuit 2606 of interest is given to the correction data memory 2622 and the correction data α and β specified by the display address (that is, the correction data α and β associated with the pixel circuit 2606) are read out and used for correction of the basic control point data CP0_0 to CPm_0. The display address may be supplied from the command control circuit 2611, for example (see FIG. 30).

The control point calculation circuit 2623 generates control point data CP0 to CPm by correcting the basic control point data CP_0 to CPm_0 in response to the correction data α and β received from the correction data memory 2622. The control point data CP0 to CPm are a set of data which specify the correspondence relationship between the input grayscale value X_IN and the voltage data value Y_OUT in calculating the voltage data value Y_OUT by the data correction circuit 2624. The control point data CPi includes the coordinates ($X_{CPi}$, $Y_{CPi}$) of the control point CPi in the XY coordinate system. The configuration and operation of the control point calculation circuit 2623 will be described later in detail.

The data correction circuit 2624 generates the voltage data $D_{VOUT}$ from the input image data $D_{IN}$ in response to the control point data CP0 to CPm received from the control point calculation circuit 2623. When generating the voltage data $D_{VOUT}$ with respect to a certain pixel circuit 6, the data correction circuit 2624 calculates the voltage data value Y_OUT to be described in the voltage data $D_{VOUT}$ from the input grayscale value X_IN described in the input image data $D_{IN}$ in accordance with the correspondence relationship specified by the control point data CP0 to CPm associated with the pixel circuit 6 of interest. In the present embodiment, the data correction circuit 2624 calculates the Y coordinate of the point which is positioned on the n degree Bezier curve specified by the control point data CP0 to CPm and has an X coordinate equal to the input grayscale value X_IN, and outputs the calculated Y coordinate as the voltage data value Y_OUT, where n is an integer equal to or more than two.

In various embodiments, the correction data may be applied gamma values. After the gamma values are corrected, the control data points may be used to determine the voltages to drive on each subpixel. Further, the correction data may be applied to the greyscale voltage values after they are determined.

More specifically, in various embodiments, the data correction circuit 2624 includes a selector 2625 and a Bezier calculation circuit 26026.

The selector 2625 selects control point data CP(k×n) to CP((k+1)×n) corresponding to (n+1) control points from among the control point data CP0 to CPm. Hereinafter, the control point data CP(k×n) to CP((k+1)×n) selected by the selector 2625 may be referred to as selected control point data CP(k×n) to CP((k+1)×n). The selected control point data CP(k×n) to CP((k+1)×n) are selected to satisfy the following expression 3:

$$X_{CP(k\times n)} \leq X_IN \leq X_{CP(k+1)\times n)}. \quad 3$$

In expression 3, XCP(k×n) is the X coordinate of the control point CP(k×n), and XCP((k+1)×n) is the X coordinate of the control point CP((k+1)×n).

The Bezier calculation circuit 2626 calculates the voltage data value Y_OUT corresponding to the input grayscale value X_IN on the basis of the selected control point data CP(k×n) to CP((k+1)×n). In one embodiment, the voltage data value may corrected with correction data. In other embodiments, the control point data is corrected with correction data. The voltage data value Y_OUT is calculated as the Y coordinate of the point which is positioned on the nth degree Bezier curve specified by the (n+1) control points CP(k×n) to CP((k+1)×n) described in the selected control point data CP(k×n) to CP((k+1)×n) and has an X coordinate equal to the input grayscale value X_IN. It should be noted that an nth degree Bezier curve can be specified by (n+1) control points.

The LUT 270 to 27*m* operate as a correction value calculation circuit which calculates correction values α0 to αm and β0 to βm used for correction of the basic control point data CP0_0 to CPm_0 from the correction data α and β. Here, the correction values α0 to αm, which are values calculated from the correction data α, are used for correction of the X coordinates XCP0_0 to XCPm_0 of the basic control points described in the basic control point data CP0_0 to CPm_0. On the other hand, the correction values β0 to βm, which are values calculated from the correction data β, are used for correction of the Y coordinates YCP0_0 to YCPm_0 of the basic control points described in the basic control point data CP0_0 to CPm_0.

In one embodiment, the LUT 27*i* determines the correction value αi used for the correction of the basic control point data CPi_0 from the correction data α through table lookup, and determines the correction value βi used for the correction of the basic control point data CPi_0 from the correction data β through table lookup, where i is any integer from zero to m. It should be noted that, in this configuration, the correction data α is commonly used for calculation of the correction values α0 to αm and the correction data β is commonly used for calculation of the correction values β0 to βm.

The control point correction circuits 2628$_0$ to 2628$_m$ calculate the control point data CP0 to CPm by correcting the basic control point data CP0_0 to CPm_0 on the basis of the correction values $\alpha_0$ to $\alpha_m$ and $\beta_0$ to $\beta_m$. More specifically, the control point correction circuit 2628*i* calculates the correction point data CPi by correcting the basic control point data CPi_0 on the basis of the correction values $\alpha_i$ and $\beta_i$. As described above, the correction value αi is used for correction of the X coordinate XCPi_0 of the basic control point CPi_0 described in the basic control point data CPi_0, that is, calculation of the X coordinate XCPi of the control point CPi and the correction value s, is used for correction of the Y coordinate YCPi_0 of the basic control point CPi_0 described in the basic control point data CPi_0, that is, calculation of the Y coordinate YCPi of the control point CPi.

In one embodiment, the X coordinate XCPi and Y coordinate YCPi of the control point CPi described in the control point data CPi are calculated in accordance with the following expressions 4 and 5:

$$X_{CPi}=\alpha_i \times X_{CPi_0}, \text{ and} \quad 4$$

$$Y_{CPi}=Y_{CPi_0}+\beta_i. \quad 5$$

In other words, the X coordinate XCPi of the control point CPi is calculated depending on (in this embodiment, to be equal to) the product of the correction value αi and the X coordinate XCPi_0 of the basic control point CPi_0 and the Y coordinate YCPi of the control point CPi is calculated depending on (in this embodiment, to be equal to) the sum of the correction value βi and the Y coordinate YCPi_0 of the basic control point CPi_0.

The data correction circuit 2624 generates the voltage data DVOUT from the input image data DIN in accordance with the correspondence relationship between the input grayscale value X_IN and the voltage data value Y_OUT specified by the control point data CP0 to CPm thus calculated.

The configuration of the voltage data generator circuit 2612 of in one embodiment, in which the control point data CP0 to CPm are calculated through correcting the basic control point data CP0_0 to CPm_0 on the basis of the correction data α and β associated with each pixel circuit 6 and the voltage data value Y_OUT is calculated from the input grayscale value X_IN in accordance with the correspondence relationship specified by the control point data CP0 to CPm, aids in suppressing image quality deterioration. In the configuration of FIG. 31, grayscale values of the corrected image data are not saturated at the allowed maximum or allowed minimum value unlike.

Additionally, the embodiment of FIG. 31 substantially achieves correction of a drive voltage through the calculation of the Y coordinates YCPi of the control points CPi through correcting the Y coordinates YCPi_0 of the basic control points CPi_0. The correction of the Y coordinates YCPi of the control points CPi is equivalent to the correction of the voltage data value Y_OUT, that is, the correction of the drive voltage. Accordingly, the voltage data value Y_OUT, that is the drive voltage can be set so as to cancel the voltage offset of each pixel circuit 2606 of the display panel 2601 by appropriately setting the correction values $\beta_0$ to $\beta_m$ or the correction data β, which are used for calculating the Y coordinates YCPi of the control points CPi.

Figure 33:
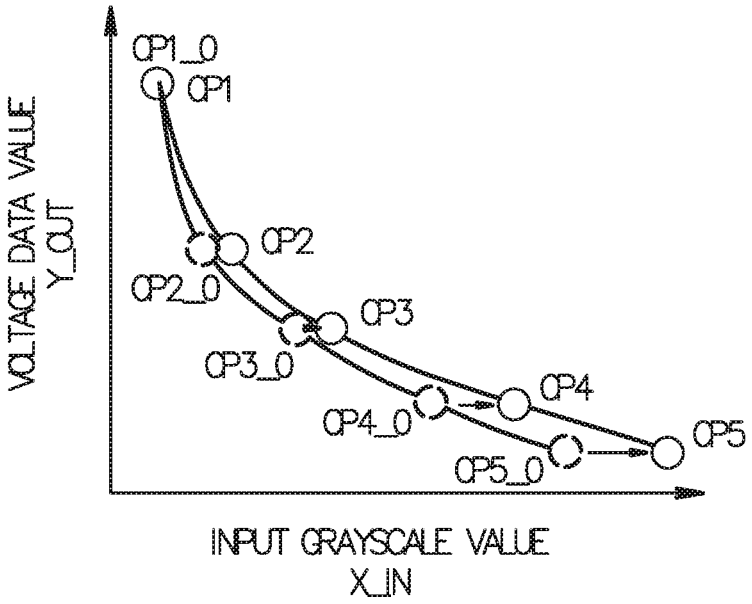
FIG. 33 is a graph illustrating an effect of a correction based on correction values $\alpha 0$ to $\alpha m$.

The above-described correction in accordance with the expressions (3) and (4) are especially suitable for compensating the variations in the properties of the pixel circuits 2606 when the pixel circuits 2606 of the display panel 1 each incorporate an OLED element. FIG. 33 is a graph illustrating the effect of the correction based on the correction values $\alpha_0$ to $\alpha_m$ and FIG. 34 is a graph illustrating the effect of the correction based on the correction values $\beta_0$ to $\beta_m$.

In one or more embodiments where the display panel 2601 is configured as an OLED display panel, there may be variations in the properties of the pixel circuits 2606. Causes of such variations may include variations in the current-voltage properties of the OLED elements included in the pixel circuits 2606 and variations in the threshold voltages of the drive transistors included in the pixel circuits 2606. Causes of the variations in the current-voltage properties of the OLED elements may include variations in the areas of the OLED elements, for example. It is desired to appropriately compensate the above-described variations for improving the image quality of the display panel 2601.

With reference to FIG. 33, calculating the X coordinate XCPi of the control point CPi depending on the product of the correction value αi and the X coordinate XCPi_0 of the basic control points CPi_0 is effective for compensating the variations in the current-voltage properties. The calculation of the coordinate XCPi of the control point CPi depending on the product of the correction value αi and the X coordinate XCPi_0 of the basic control points CPi_0 is equivalent to enlargement or shrinking of the curve of the correspondence relationship between the input grayscale value X_IN and the voltage data value Y_OUT in the X axis direction, in other words, equivalent to the calculation of the product of the input grayscale value X_IN and a correction value. This is effective for compensating the variations in the current-voltage properties.

Figure 34:
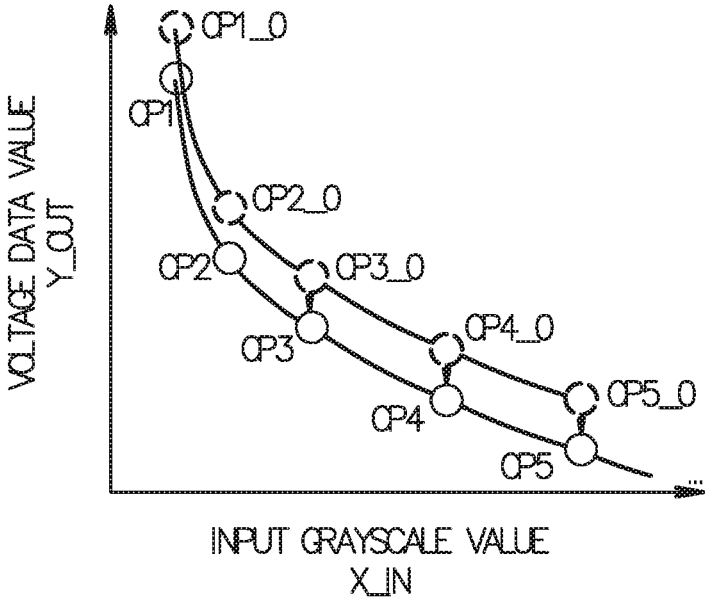
FIG. 34 is a graph illustrating an effect of a correction based on correction values $\beta 0$ to $\mu m$.

Meanwhile, with reference to FIG. 34, calculating the Y coordinate YCPi of the control point CPi depending on the sum of the correction value βi and the Y coordinate YCPi_0 of the basic control point CPi_0 is effective for compensating the variations in the threshold voltages of the drive transistors included in the pixel circuits 2606. Calculating the Y coordinate YCPi of the control point CPi depending on the sum of the correction value βi and the Y coordinate YCPi_0 of the basic control point CPi_0 is equivalent to shifting the curve of the correspondence relationship between the input grayscale value X_IN and the voltage data value Y_OUT in the Y axis direction, in other words, equivalent to calculation of the sum of the voltage data value Y_OUT and a correction value. This is effective for compensating the variations in the threshold voltages of the drive transistors included in the pixel circuits 2606.

Figure 35:
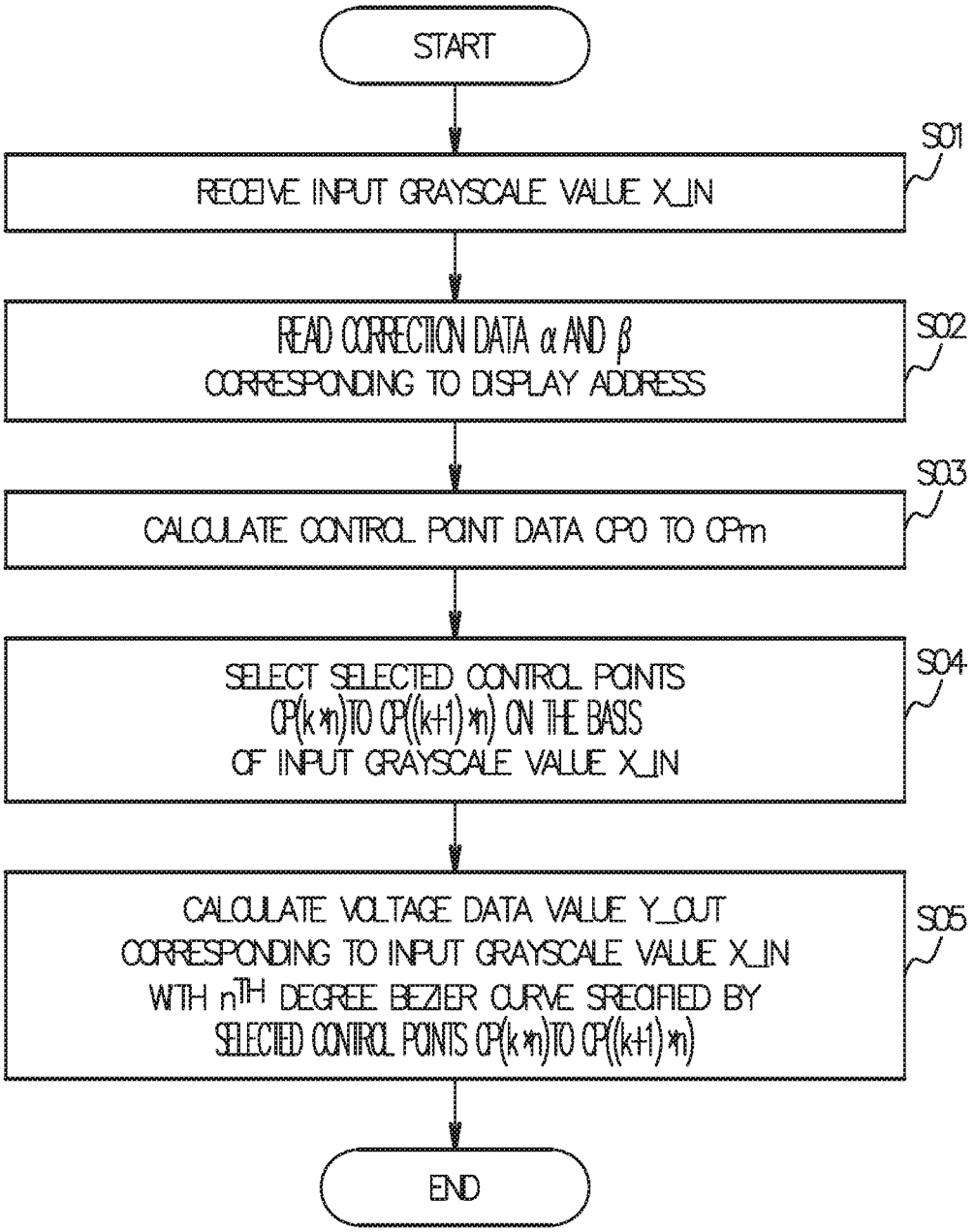
FIG. 35 is a flowchart illustrating the operation of the voltage data generator circuit according to one or more embodiments.

FIG. 35 is a flowchart illustrating the operation of the voltage data generator circuit 2612 according to one or more embodiments. When the voltage data value Y_OUT specifying the drive voltage to be supplied to a certain pixel circuit 2606 is calculated, the input grayscale value X_IN associated with the pixel circuit 2606 is supplied to the voltage data generator circuit 2612 (step S01). In the following, a description is given with an assumption that the input grayscale value X_IN is an eight-bit value and the voltage data value Y_OUT is a 10-bit value.

In synchronization with the supply of the input grayscale value X_IN to the voltage data generator circuit 2612, the display address associated with the pixel circuit 6 of interest is supplied to the correction data memory 2622 and the correction data α and β associated with the display address (that is, the correction data α and β associated with the pixel circuit 2606 of interest) are read out (step S02).

The control point data CP0 to CPm actually used to calculate the voltage data value Y_OUT are calculated through correcting the basic control point data CP0_0 to CPm_0 by using the correction data α and β read out from the correction data memory 2622 (step S03). The control point data CP0 to CPm may be calculated as follows.

First, in one or more embodiments, by using the LUTs $\mathbf{27}_0$ to $\mathbf{27}_m$, correction values $\alpha_0$ to αm are calculated from the correction data α and correction values $\beta_0$ to $\beta_m$ are calculated from the correction data β. The correction value $\alpha_i$ is calculated through table lookup in the LUT $\mathbf{27}_i$ in response to the correction data α and the correction value $\beta_i$ is calculated through table lookup in the LUT $\mathbf{27}_i$ in response to the correction data β.

Subsequently, the basic control point data CP0_0 to CPm_0 are corrected by the control point correction circuits $\mathbf{28}_0$ to $\mathbf{28}_m$ on the basis of the correction values $\alpha_0$ to $\alpha_m$ and $\beta_0$ to $\beta_m$, to thereby calculate the control point data CP0 to CPm. As described above, in various embodiments, the X coordinate XCPi of the control point CPi described in the control point data CPi is calculated in accordance with the above-described expression (3) and the Y coordinate YCPi of the control point CPi is calculated in accordance with the above-described expression (4).

This is followed by selecting (n+1) control points CP(k×n) to CP((k+1)×n) from among the control points CP0 to CPm on the basis of the input grayscale value X_IN (step S04). The (n+1) control points CP(k×n) to CP((k+1)×n) are selected by the selector 2625.

In one embodiment, the (n+1) control points CP(k×n) to CP((k+1)×n) may be selected as follows.

The basic control points CP0_0 to CPm_0 are defined to satisfy m=p×n, where p is a predetermined natural number. In this case, the number of the basic control points CP_0 to CPm_0 and the number of the control points CP0 to CPm are m+1. The nth degree Bezier curve passes through the control point CP0, CPn, CP(2n) . . . , CP(p×n) of the m+1 control points CP0 to CPm. The other control points are not necessarily positioned on the nth degree Bezier curve, although specifying the shape of the nth degree Bezier curve.

The selector 2625 compares the input grayscale value X_IN with the respective X coordinates of the control points through which the nth degree Bezier curve passes, and select the (n+1) control points CP(k×n) to CP((k+1)×n) in response to the result of the comparison.

More specifically, when the input grayscale value X_IN is larger than the X coordinate of the control point CP0 and smaller than the X coordinate of the control point CPn, the selector 2625 selects the control points CP0 to CPn. When the input grayscale value X_IN is larger than the X coordinate of the control point CPn and smaller than the X coordinate of the control point CP(2n), the selector 2625 selects the control points CPn to CP(2n). Generally, when the input grayscale value X_IN is larger than the X coordinate XCP(k×n) of the control point CP(k×n) and smaller than the X coordinate XCP((k+1)×n) of the control point CP((k+1)×n), the selector 2625 selects the control points CP(k×n) to CP((k+1)×n), where k is an integer from 0 to p.

When the input grayscale value X_IN is equal to the X coordinate XCP(k×n) of the control point CP(k×n), in one embodiment, the selector 2625 selects the control points CP(k×n) to CP((k+1)×n). In this case, when the input grayscale value X_IN is equal to the control point CP(p×n), the selector 2625 selects the control points CP((p−1)×n) to CP(p×n).

Alternatively, the selector 2625 may select the control points CP(k×n) to CP((k+1)×n), when the input grayscale value X_IN is equal to the X coordinate XCP((k+1)×n) of the control point CP((k+1)×n). In this case, when the input grayscale value X_IN is equal to the control point CP0, the selector 2625 selects the control points CP0 to CPn.

The control point data of the thus-selected control points CP(k×n) to CP((k+1)×n), that is, the X and Y coordinates of the control points CP(k×n) to CP((k+1)×n) are supplied to the Bezier calculation circuit 2626 and the voltage data value Y_OUT corresponding to the input grayscale value X_IN is calculated by the Bezier calculation circuit 2626 (step S05). The voltage data value Y_OUT is calculated as the Y coordinate of the point which is positioned on the nth degree Bezier curve specified by the (n+1) control points CP(k×n) to CP((k+1)×n) and has an X coordinate equal to the input grayscale value X_IN.

In one or more embodiments, the degree n of the Bezier curve used to calculate the voltage data value Y_OUT is not limited to a specific number; the degree n may be selected depending on required precision. However, in various embodiments, calculating the voltage data value Y_OUT with a second degree Bezier curve preferably allows precisely calculating the voltage data value Y_OUT with a simple configuration of the Bezier calculation circuit 2626. In the following description, a configuration and operation of the Bezier calculation circuit 2626 are described when the voltage data value Y_OUT is calculated by using a second degree Bezier curve. In such embodiments, when the voltage data value Y_OUT is calculated with a second degree Bezier curve, the control point data CP(2k), CP(2k+1) and CP(2k+2) corresponding to the three control points CP(2k), CP(2k+1) and CP(2k+2), that is, the X and Y coordinates of the three control points CP(2k), CP(2k+1) and CP(2k+2) are supplied to the input of the Bezier calculation circuit 2626.

Figure 36:
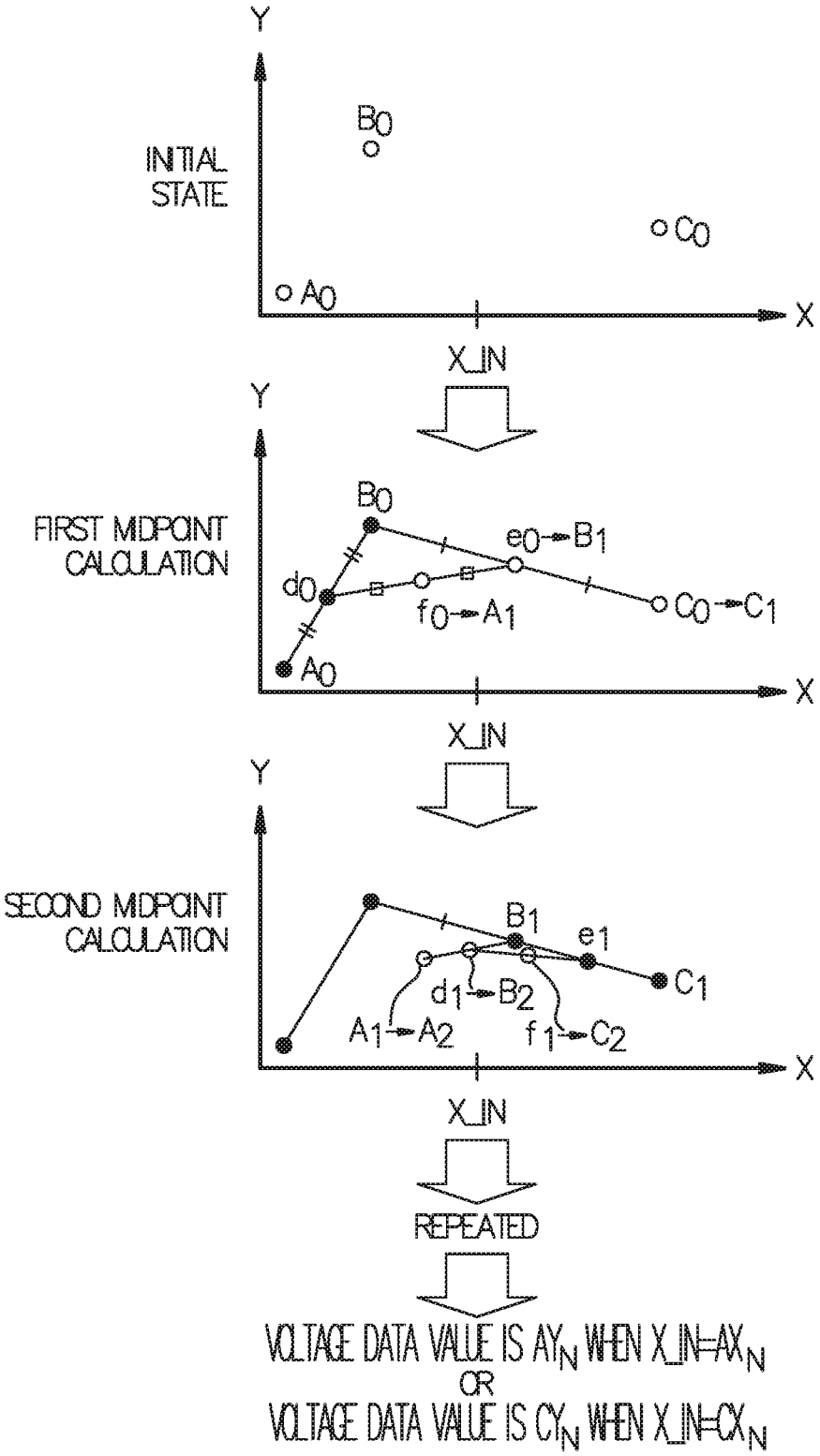
FIG. 36 is a diagram illustrating a calculation algorithm performed in a Bezier calculation circuit according to one or more embodiments.
Figure 37:
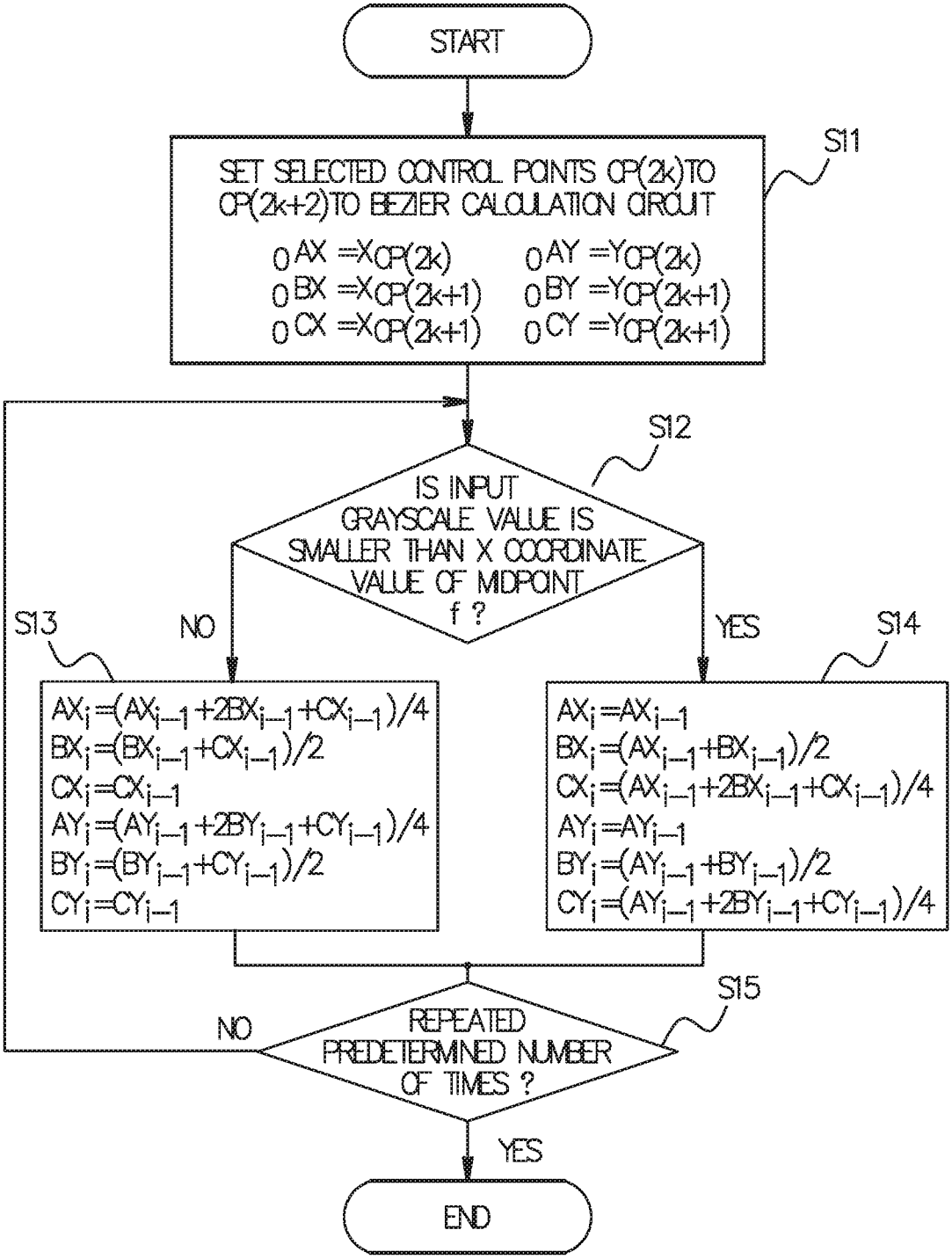
FIG. 37 is a flowchart illustrating the procedure of the calculation performed in the Bezier calculation circuit.

FIG. 36 illustrates conceptual diagram illustrating the calculation algorithm performed in the Bezier calculation circuit 2626, and FIG. 37 is a flowchart illustrating the procedure of the calculation according to one embodiment.

As illustrated in FIG. 37, the X and Y coordinates of the three control points CP(2k) to CP(2k+2) are set to the Bezier calculation circuit 2626 as an initial setting (step S11). For simplicity of the description, the control points CP (2k), CP(2k+1) and CP(2k+2), which are set to the Bezier calculation circuit 2626, are hereinafter referred to as control points A0, B0 and C0, respectively. Referring to FIG. 36, the coordinates A0(AX0, AY0), B0(BX0, BY0) and C0(CX0, CY0) of the control points A0, B0 and C0 are represented as follows:

$$A_0(AX_0,AY_0)=(X_{CP(2k)},Y_{CP(2k)}), \quad 6$$

$$B_0(BX_0,BY_0)=(X_{CP(2k+1)},Y_{CP(2k+1)}), \text{ and} \quad 7$$

$$C_0(CX_0,CY_0)=(X_{CP(2k+2)},Y_{CP(2k+2)}). \quad 8$$

Referring to FIG. 36, the voltage data value Y_OUT is calculated through repeated calculations of midpoints as described in the following. One unit of the repeated calculations is referred to as "midpoint calculation", hereinafter. The midpoint of adjacent two of the three control points may be referred to as first-order midpoint and the midpoint of two first-order midpoints may be referred to as second-order midpoint.

In the first midpoint calculation, with respect to the initially-given control points $A_0$, $B_0$ and $C_0$ (that is, the three control points CP(2k), CP(2k+1) and CP(2k+2), a first-order midpoint $d_0$ which is the midpoint of the control points $A_0$ and $B_0$ and a first-order midpoint $e_0$ which is the midpoint of the control points $B_0$ and $C_0$ are calculated and a second-order midpoint $f_0$ which is the midpoint of the first-order midpoints $d_0$ and $e_0$ is further calculated. The second-order midpoint $f_0$ is positioned on the second degree Bezier curve specified by the three control points $A_0$, $B_0$ and $C_0$. The coordinates ($Xf_0$, $Yf_0$) of the second-order midpoint $f_0$ is calculated by the following expressions:

$$X_{f0}=(AX_0+2BX_0+CX_0)/4, \text{ and} \quad 9$$

$$Y_{f0}=(AY_0+2BY_0+CY_0)/4. \quad 10$$

In various embodiments, three control points A1, B1 and C1 used in the next midpoint calculation (the second midpoint calculation) are selected from among the control point A0, the first-order midpoint d0, the second-order midpoint $f_0$, the first-order midpoint $e_0$ and the control point B0 in response to the result of the comparison between the input grayscale value X_IN and the X coordinate Xf0 of the second-order midpoint $f_0$. More specifically, the control points A1, B1 and C1 are selected as follows:

(A) In embodiments where $X_{f0} \geq X_IN$

In such embodiments, the three points having the least three X coordinates (the leftmost three points): the control points $A_0$, the first-order midpoint $d_0$ and the second-order midpoint $f_0$ are selected as control points $A_1$, $B_1$ and $C_1$. In other words, $$A_1=A_0, B_1=d_0 \text{ and } C_1=f_0. \quad 11$$

(B) In embodiments where $X_{f0} < X_IN$

In such embodiments, the three points having the most three X coordinates (the rightmost three points): the second-order midpoint f0, the first order midpoint eo and the control point C0 are selected as the control points A1, B1 and C1. In other words, $$A_1=f_0, B_1=e_0 \text{ and } C_1=C_0. \quad 12$$

The second midpoint calculation may be performed in a similar manner. With respect to the control points A1, B1 and C1, the first-order midpoint d1 of the control points A1 and B1 and the first-order midpoint e1 of the control points B1 and C1 are calculated and the second-order midpoint f1 of the first order midpoints d1 and e1 is further calculated. The second-order midpoint f1 is positioned on the desired second-order Bezier curve. Subsequently, three control points A2, B2 and C2 used in the next midpoint calculation (the third midpoint calculation) are selected from among the control point A1, the first-order midpoint d1, the second-order midpoint f1, the first-order midpoint e1 and the control point B1 in response to the result of a comparison between the input grayscale value X_IN and the X coordinate Xf1 of the second-order midpoint f1.

Further, as illustrated in FIG. 36, the calculations described below are performed in the ith midpoint calculation (steps S12 to S14):

(A) In embodiments where $(AX_{i-1}+2BX_{i-1}+CX_{i-1})/4 \geq X_IN$, $$AX_i=AX_{i-1}, \quad 13$$

$$BX_i=(AX_{i-1}+BX_{i-1})/2, \quad 14$$

$$CX_i=(AX_{i-1}+2BX_{i-1}+CX_{i-1})/4, \quad 15$$

$$AY_i=AY_{i-1}, \quad 16$$

$$BY_i=(AY_{i-1}+BY_{i-1})/2, \text{ and} \quad 17$$

$$CY_i=(AY_{i-1}+2BY_{i-1}+CY_{i-1})/4. \quad 18$$

(B) In embodiments where $(AX_{i-1}+2BX_{i-1}+CX_{i-1})/4 < X_IN$, $$AX_i=(AX_{i-1}+2BX_{i-1}+CX_{i-1})/4, \quad 19$$

$$BX_i=(BX_{i-1}+CX_{i-1})/2, \quad 20$$

$$CX_i=CX_{i-1}, \quad 21$$

$$AY_i=(AY_{i-1}+2BY_{i-1}+CY_{i-1})/4, \quad 22$$

$$BY_i=(BY_{i-1}+CY_{i-1})/2, \text{ and} \quad 23$$

$$CY_i=CY_{i-1}. \quad 24$$

With respect to conditions (A) and (B), the equal sign may be attached to either the inequality sign recited in condition (A) or that in condition (B).

The midpoint calculations are repeated in a similar manner a desired number of times (step S15).

Each midpoint calculation makes the control points Ai, Bi and Ci closer to the second degree Bezier curve and also makes the X coordinate values of the control points Ai, Bi and Ci closer to the input grayscale value X_IN. The voltage data value Y_OUT to be finally calculated is obtained from the Y coordinate of at least one of control points AN, BN and CN obtained by the N-th midpoint calculation. For example, the voltage data value Y_OUT may be determined as the Y coordinate of an arbitrarily selected one of the control points AN, BN, and CN. Alternatively, the voltage data value Y_OUT may be determined as the average value of the Y coordinates of the control points AN, BN and CN.

In a range in which the number of times N of the midpoint calculations is relatively small, the preciseness of the voltage data value Y_OUT is more improved as the number of times N of the midpoint calculations is increased. In various embodiments, once the number of times N of the midpoint calculations reaches the number of bits of the voltage data value Y_OUT, the preciseness of the voltage data value Y_OUT is not further improved thereafter. Accordingly, in various embodiments, the number of times N of the midpoint calculations is equal to the number of bits of the voltage data value Y_OUT. In some embodiments, in which the voltage data value Y_OUT is a 10-bit data, the number of times N of the midpoint calculations is 10.

Figure 38:
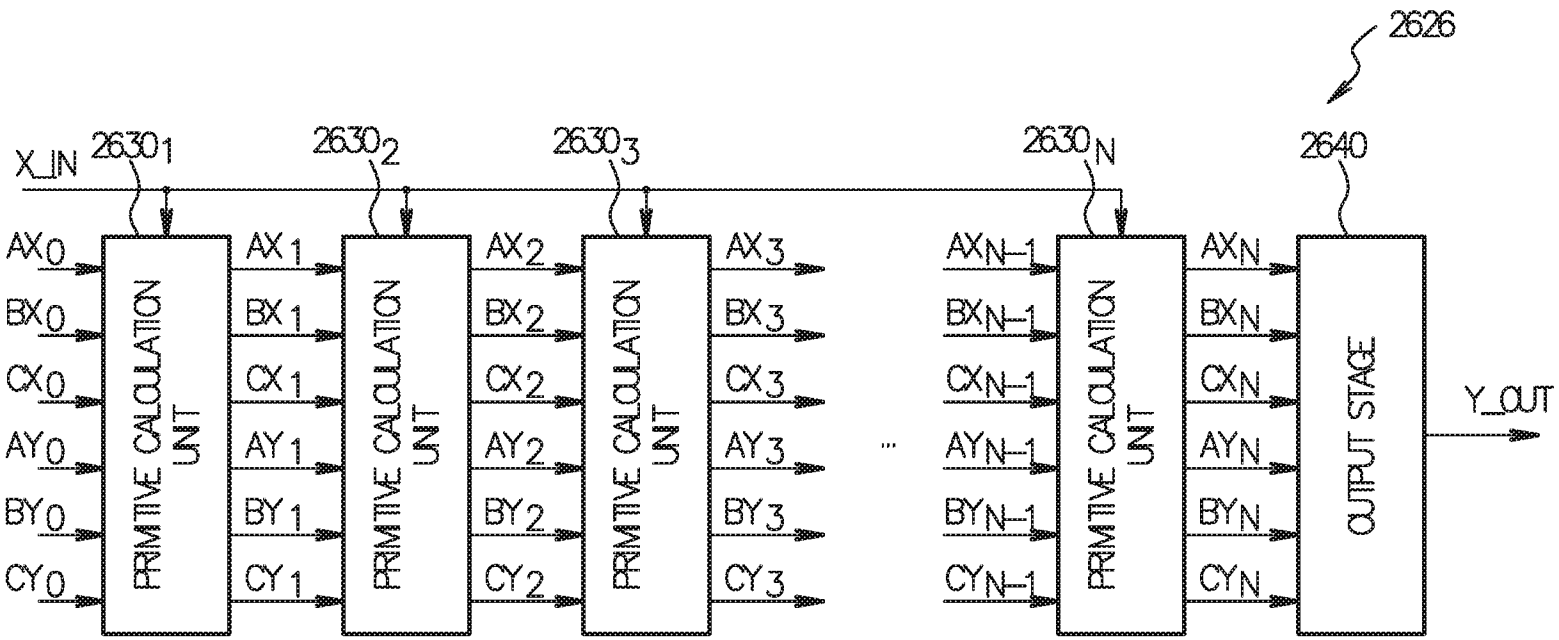
FIG. 38 is a block diagram illustrating one example of the configuration of the Bezier calculation circuit.

Since the voltage data value Y_OUT is calculated through repeated midpoint calculations as described above, the Bezier calculation circuit 2626 may be configured as a plurality of serially-connected calculation circuits each configured to perform a midpoint calculation. FIG. 38 is a block diagram illustrating one example of the configuration of the Bezier calculation circuit 2626 according to one embodiment.

The Bezier calculation circuit 2626 includes N primitive calculation units $\mathbf{2630}_1$ to $\mathbf{2630}_N$ and an output stage 2640. Each of the primitive calculation units $\mathbf{2630}_1$ to $\mathbf{30}_N$ is configured to perform the above-described midpoint calculation. In other words, the primitive calculation unit 2630*i* is configured to calculate the X and Y coordinates of the control points Ai, Bi and Ci from the X and Y coordinates of the control points Ai−1, Bi−1 and Ci−1 through calculations in accordance with the above expressions. The output stage 2640 outputs the voltage data value Y_OUT on the basis of the Y coordinate of at least one control point selected from the control points $A_N$, $B_N$ and $C_N$, which is output from the primitive calculation unit $\mathbf{2630}_N$ (that is, on the basis of at least one of $AY_N$, $BY_N$ and $CY_N$). The output stage 2640 may output the Y coordinate of a selected one of the control points $A_N$, $B_N$ and $C_N$ as the voltage data value Y_OUT.

Figure 39:
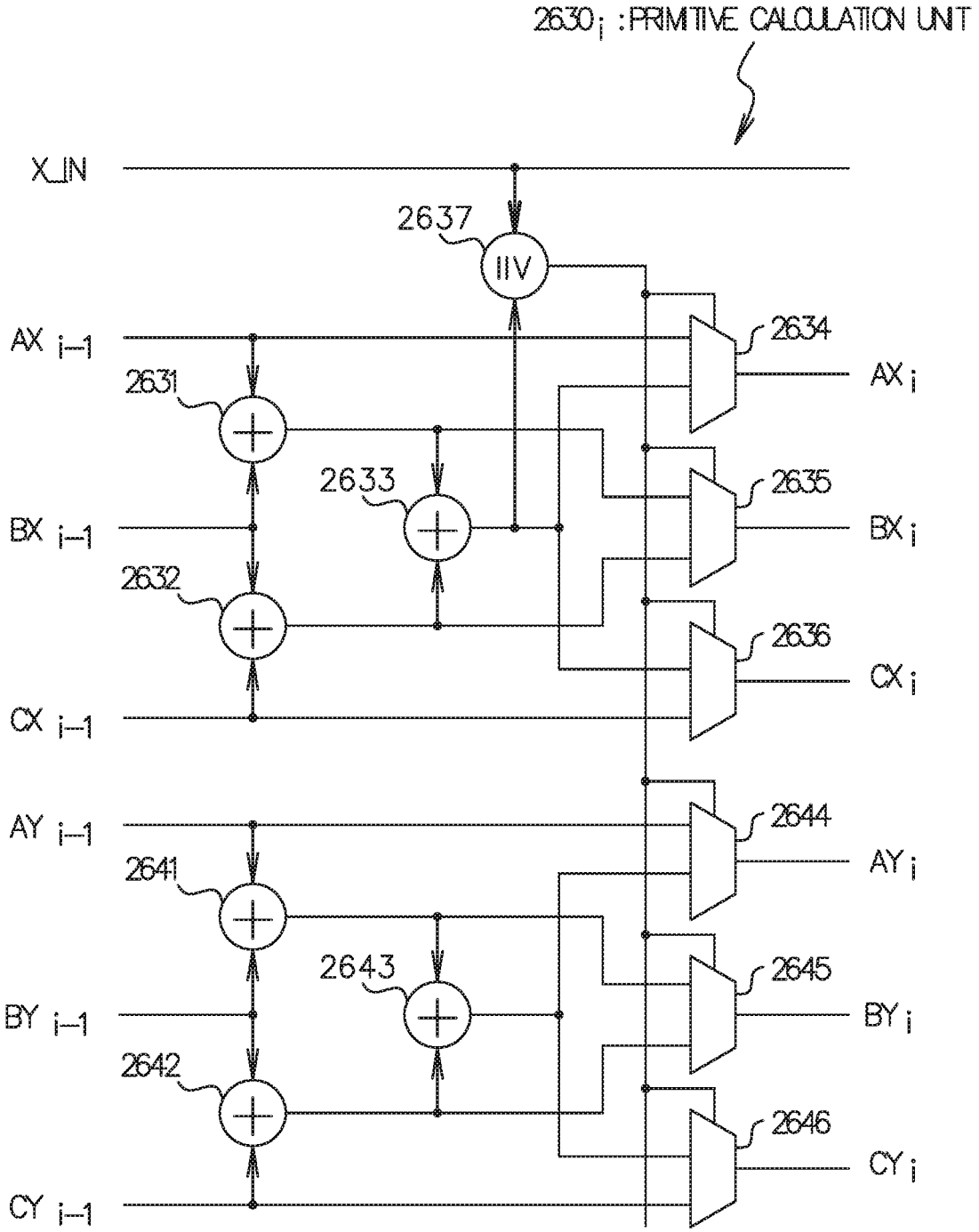
FIG. 39 is a circuit diagram illustrating the configuration of each primitive calculation unit.

FIG. 39 is a circuit diagram illustrating the configuration of each primitive calculation unit 2630*i* according to one embodiment. Each primitive calculation unit 2630 includes adders 2631 to 2633, selectors 2634 to 2636, a comparator 2637, adders 2641 to 2643, and selectors 2644 to 2646. The adders 2631 to 2633 and the selectors 2634 to 2636 perform calculations on the X coordinates of the control points $A_{i-1}$, $B_{i-1}$, and $C_{i-1}$ and the adders 2641 to 2643 and the selectors 2644 to 2646 perform calculations on the Y coordinates of the control points $A_{i-1}$, $B_{i-1}$, and $C_{i-1}$.

In various embodiments, each primitive calculation unit 2630 includes seven input terminals, one of which receives the input grayscale value X_IN, and the remaining six receive the X coordinates $AX_{i-1}$, $BX_{i-1}$ and $CX_{i-1}$ and Y coordinates $AY_{i-1}$, BYi−1 and $CY_{i-1}$ of the control points $A_{i-1}$, $B_{i-1}$ and $C_{i-1}$, respectively. The adder 2631 has a first input connected to the input terminal to which $AX_{i-1}$ is supplied and a second input connected to the input terminal to which $BX_{i-1}$ is supplied. The adder 2632 has a first input connected to the input terminal to which $BX_{i-1}$ is supplied and a second input connected to the input terminal to which $CX_{i-1}$ is supplied. The adder 2633 has a first input connected to the output of the adder 2631 and a second input connected to the output of the adder 2632.

Correspondingly, the adder 2641 has a first input connected to the input terminal to which $AY_{i-1}$ is supplied and a second input connected to the input terminal to which $BY_{i-1}$ is supplied. The adder 2642 has a first input connected to the input terminal to which $BY_{i-1}$ is supplied and a second input connected to the input terminal to which $CY_{i-1}$ is supplied. The adder 2643 has a first input connected to the output of the adder 41 and a second input connected to the output of the adder 2642.

The comparator 2637 has a first input to which the input gray-level value X_IN is supplied and a second input connected to the output of the adder 2633.

The selector 2634 has a first input connected to the input terminal to which AXi−1 is supplied and a second input connected to the output of the adder 2633, and selects the first or second input in response to the output value of the comparator 2637. The output of the selector 2634 is connected to the output terminal from which AXi is output. Similarly, the selector 2635 has a first input connected to the output of the adder 2631 and a second input connected to the output of the adder 2632, and selects the first or second input in response to the output value of the comparator 2637. The output of the selector 2635 is connected to the output terminal from which BXi is output. Furthermore, the selector 36 has a first input connected to the output of the adder 2633 and a second input connected to the input terminal to which Ci−1 is supplied, and selects the first or second input in response to the output value of the comparator 2637. The output of the selector 2636 is connected to the output terminal from which CXi is output.

In one or more embodiments, the selector 2644 has a first input connected to the input terminal to which AYi−1 is supplied and a second input connected to the output of the adder 2643, and selects the first or second input in response to an output value of the comparator 2637. The output of the selector 2644 is connected to the output terminal from AYi is output. Similarly, the selector 2645 has a first input connected to the output of the adder 41 and a second input connected to the output of the adder 2642, and selects the first or second input in response to the output value of the comparator 2637. The output of the selector 2645 is connected to the output terminal from which BYi is output. Further, the selector 2646 has a first input connected to the output of the adder 2643 and a second input connected to the input terminal to which CYi−1 is supplied, and selects the first or second input in response to the output value of the comparator 2637. The output of the selector 2646 is connected to the output terminal from which CYi is output.

The adder 2631 performs the calculation in accordance with the above-described expressions, the adder 2632 performs the calculation in accordance with the above-described expression, and the adder 2633 performs the calculation in accordance with the above expressions using the output values from the adders 2631 and 2632. Similarly, the adder 2641 performs the calculation in accordance with the above-described expression, the adder 2642 performs the calculation in accordance with the expression, and the adder 2643 performs the calculation in accordance with the above expressions using the output values from the adders 2641 and 2642. The comparator 2637 compares the output value of the adder 2633 with the input grayscale value X_IN, and indicates which of the two input values supplied to each of the selectors 2634 to 2636 and 2644 to 2646 is to be output as the output value.

In one or more embodiments, when the input grayscale value X_IN is smaller than (AXi−1+2BXi−1+CXi−1)/4, the selector 2634 selects AXi−1, the selector 2635 selects the output value of the adder 2631, the selector 2636 selects the output value of the adder 2633, the selector 2644 selects AYi−1, the selector 2645 selects the output value of the adder 41, and the selector 46 selects the output value of the adder 2643. When the input gray-level value X_IN is larger than (AXi−1+2BXi−1+CXi−1)/4, the selector 2634 selects the output value of the adder 2633, the selector 2635 selects the output value of the adder 2632, the selector 2636 selects the CXi−1, the selector 2644 selects the output value of the adder 2643, the selector 2645 selects the output value of the adder 2642, and the selector 2646 selects CYi−1. The values selected by the selectors 2634 to 2636 and 2644 to 2646 are supplied to the primitive calculation unit 2630 of the following stage as AXi, BXi, CXi, AYi, BYi, and CYi, respectively.

In various embodiments, the divisions included in the above expressions can be realized by truncating lower bits. Most simply, desired calculations can be achieved by truncating lower bits of the outputs of the adders 2631 to 2633 and 2641 to 2643. In this case, one bit may be truncated from each of the output terminals of the adders 31 to 2633 and 2641 to 2643. In some embodiments, the positions where the lower bits are truncated in the circuit may be arbitrarily modified as long as calculations equivalent to the above expressions are achieved. For example, lower bits may be truncated at the input terminals of the adders 2631 to 2633 and 2641 to 2643 or on the input terminals of the comparator 2637 and the selectors 2634 to 2636 and 2644 to 2646.

In one embodiment, the voltage data value Y_OUT may be obtained from at least one of $AY_N$, $BY_N$ and $CY_N$ output from the final primitive calculation unit $\mathbf{2630}_N$ of the primitive calculation units $\mathbf{2630}_1$ to $\mathbf{2630}_N$ thus configured.

Figure 40:
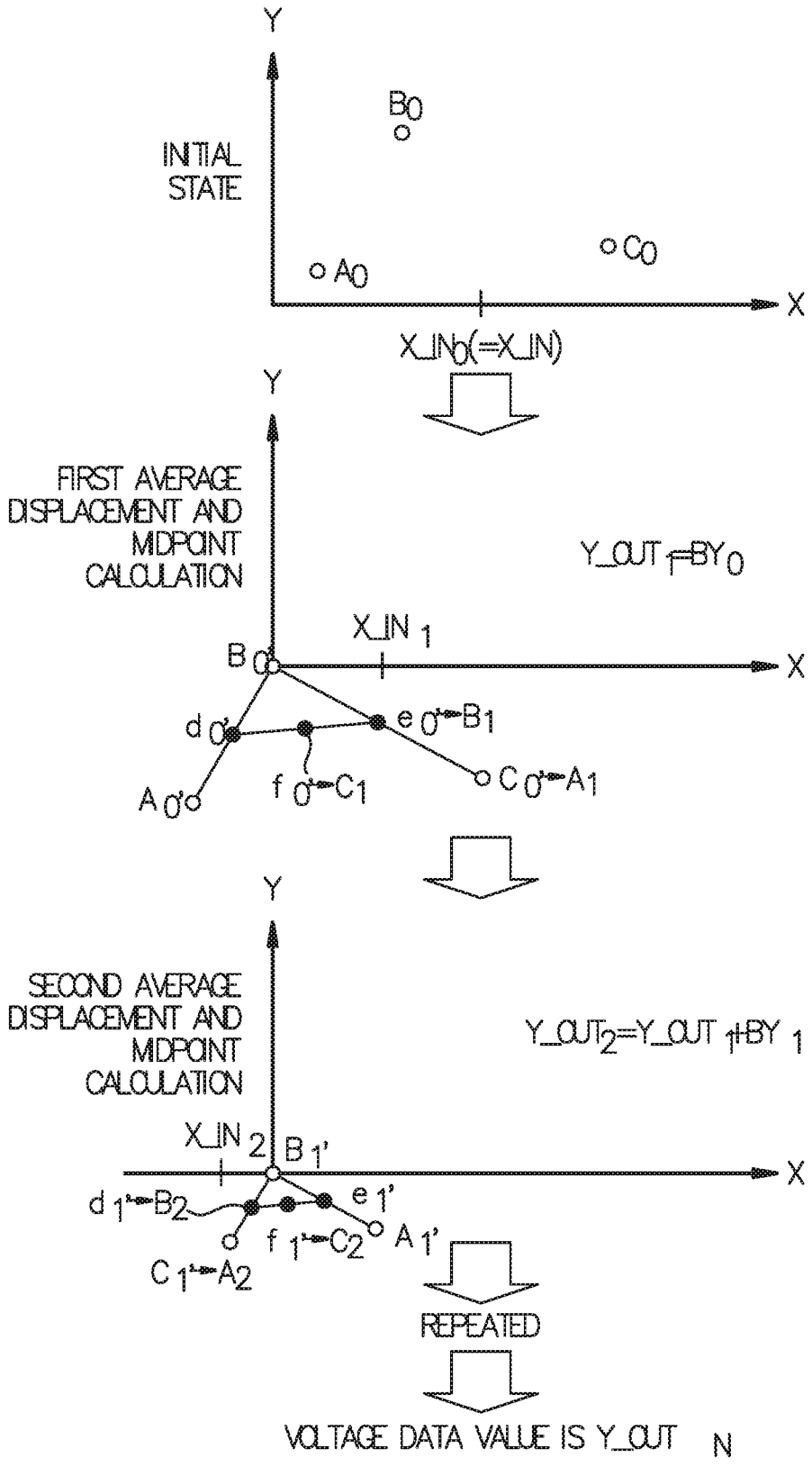
FIG. 40 is a diagram illustrating an improved calculation algorithm performed in the Bezier calculation circuit.

FIG. 40 is a conceptual diagram illustrating an improved calculation algorithm for calculating the voltage data value Y_OUT when a second degree Bezier curve is used for calculating the voltage data value Y_OUT according to one embodiment. First, in the algorithm illustrated in FIG. 40, i-th midpoint calculation involves calculating the first order midpoints di−1, ei−1 and the second order midpoint fi−1 after the control points Ai−1, Bi−1 and Ci−1 are subjected to parallel displacement so that the point Bi−1 is shifted to the origin. Second, the second order midpoint fi−1 is always selected as the point Ci used in the (i+1)-th midpoint calculation. The repetition of such parallel displacement and midpoint calculation effectively reduces the number of required calculating units and the number of bits of the values processed by the respective calculating units. In the following, a detailed description is given of the algorithm illustrated in FIG. 40.

In the first parallel displacement and midpoint calculation, the control points AO, BO and CO are subjected to parallel displacement so that the point BO is shifted to the origin. The control points AO, BO and CO after the parallel displacement are denoted by AO', BO' and CO', respectively.

The control point BO' coincides with the origin. Here, the coordinates of the control points A0' and C0' are represented as follows, respectively:

$$A_O'(AX_O',AY_O')=(AX_O-BX_O,AY_O-BY_O), \quad 25$$

$$C_O'(CX_O',CY_O')=(CX_O-BX_O,CY_O-BY_O). \quad 26$$

Concurrently, a parallel displacement distance BXO in the X axis direction is subtracted from a calculation target grayscale value X_INO to obtain a calculation target grayscale value X_IN1.

Next, the first order midpoint dO' of the control points AO' and BO' and the first order midpoint eO' of the control points BO' and CO' are calculated, and further the second order midpoint fO' of the first order midpoints eO' and fO' is calculated. The second order midpoint fO' is positioned on the second degree Bezier curve subjected to such parallel displacement that the control point Bi is shifted to the origin (that is, the second degree Bezier curve specified by the three control points AO', BO' and CO').

In one or more embodiments, the coordinates (XfO', YfO') of the second order midpoint fO' are represented by the following expression:

$$\begin{aligned}(X_{f0}', Y_{f0}') &= \left(\frac{AX_0'+CX_0'}{4}, \frac{AY_0'+CY_0'}{4}\right), \quad 27\\ &= \left(\frac{(AX_0-BX_0)+(CX_0-BX_0)}{4}, \frac{(AY_0-BY_0)+(CY_0-BY_0)}{4}\right)\\ &= \left(\frac{AX_0-2BX_0+CX_0}{4}, \frac{AY_0-2BY_0+CY_0}{4}\right)\end{aligned}$$

The three control points A1, B1 and C1 which may be used in next parallel displacement and midpoint calculation (second parallel displacement and midpoint calculation) are selected from among the point AO', the first order midpoint dO', the second order midpoint fO', the first order midpoint eO' and the point CO' in response to the result of comparison of the calculation target grayscale value X_IN1 with the X coordinate value XfO' of the second order midpoint fO'. In this selection, the second order midpoint fO' is always selected as the point C1 whereas the control points A1 and B1 are selected as follows:

(A) In embodiments where $X_{fo}' \geq X_IN_1$

In such embodiments, the two points having the least two X coordinates (the leftmost two points), that is, the control point $A_O'$ and the first order midpoint $d_O'$ are selected as the control points $A_1$ and $B_1$, respectively. In other words, $$A_1=A_O', B_1=d_O' \text{ and } C_1=f_O'. \quad 28$$

(B) In embodiments where $X_{fO} < X_IN_1$

In such embodiments, the two points having the largest two X coordinates (the rightmost two points), that is, the control point CO' and the first order midpoint eO' are selected as the control points A1 and B1, respectively. In other words, $$A_1=C_O', B_1=e_O' \text{ and } C_1=f_O'. \quad 29$$

As a whole, in the first parallel displacement and midpoint calculation, the following calculations are performed:

$$X_IN_1=X_IN_0-BX_0, \text{ and} \quad 30$$

$$X_{f0}'=(AX_0-2BX_0+CX_0)/4. \quad 31$$

(A) In embodiments where $X_{fO}' \geq X_IN_1$, $$AX_1=AX_0-BX_0, \quad 32$$

$$BX_1=(AX_0-BX_0)/2, \quad 33$$

$$CX_1=X_{f0}'=(AX_0-2BX_0+CX_0)/4, \quad 34$$

$$AY_1=AY_0-BY_0, \quad 35$$

$$BY_1=(AY_0-BY_0)/2, \text{ and} \quad 36$$

$$CY_1=Y_{f0}'=(AY_0-2BY_0+CY_0)/4. \quad 37$$

(B) In embodiments where $X_{fO}' < X_IN$, $$AX_1=CX_0-BX_0, \quad 38$$

$$BX_1=(CX_0-BX_0)/2, \quad 39$$

$$CX_1=(AY_0-2BY_0+CY_0)/4, \quad 40$$

$$AY_1=CY_0-BY_0, \quad 41$$

$$BY_1=(CY_0-BY_0)/2, \text{ and} \quad 42$$

$$CY_1=(AY_0-2BY_0+CY_0)/4. \quad 43$$

With respect to conditions (A) and (B), the equal sign may be attached to either the inequality sign recited in condition (A) or that in condition (B).

As understood from the above expressions, the following relationship is established irrespectively of which of conditions (A) and (B) is satisfied:

$$AX_1=2BX_1, \text{ and} \quad 44$$

$$AY_1=2BY_1. \quad 45$$

This implies that there is no need to redundantly calculate or store the coordinates of the control points A1 and B1 when the above-described calculations are actually implemented. This would be understood from the fact that the control point B1 is located at the midpoint between the control point A1 and the origin O as illustrated in FIG. 40. Although a description is given below of an embodiment in which the coordinates of the control point B1 are calculated, the calculation of the coordinates of the control point A1 is substantially equivalent to that of the coordinates of the control point B1.

Similar operations are performed in the second parallel displacement and midpoint calculation. First, the control points A1, B1 and C1 are subjected to such a parallel displacement that the point B1 is shifted to the origin. The control points A1, B1 and C1 after the parallel displacement are denoted by A1', B1' and C1', respectively. Additionally, the parallel displacement distance BX1 in the X axis direction is subtracted from the calculation target grayscale value X_IN1, thereby calculating the calculation target grayscale value X_IN2. Next, the first order midpoint d1' of the control points A1' and B1' and the first order midpoint e1' of the control points B1' and C1' are calculated, and further the second order midpoint f1' of the first order midpoints d1' and e1' is calculated.

Similarly to the above expressions, the following expressions are obtained:

$$X_IN_2=X_IN_1-BX_1, \text{ and} \quad 46$$

$$X_{f1}'=(AX_1-2BX_1+CX_1)/4. \quad 47$$

(A) In embodiments where $X_{f1}' \geq X_IN_2$, $$AX_2=AX_1-BX_1, \quad (48)$$

$$BX_2=(AX_1-BX_1)/2, \quad (49)$$

$$CX_2=X_{f1}'=(AX_1-2BX_1+CX_1)/4, \quad (50)$$

$$AY_2=AY_1-BY_1, \quad (51)$$

$$BY_2=(AY_1-BY_1)/2, \text{ and} \quad (52)$$

$$CY_2=Y_{f1}'=(AY_1-2BY_1+CY_1)/4. \quad (53)$$

(B) In embodiments where $X_{f1}' < X_IN_2$, $$AX_2=CX_1-BX_1 \quad (54)$$

$$BX_2=(CX_1-BX_1)/2, \quad (55)$$

$$CX_2=(AY_1-2BY_1+CY_1)/4, \quad (56)$$

$$AY_2=CY_1-BY_1, \quad (57)$$

$$BY_2=(CY_1-BY_1)/2, \text{ and} \quad (58)$$

$$CY_2=(AY_1-2BY_1+CY_1)/4. \quad (59)$$

In one or more embodiments, by substituting the above expressions, the following expressions are obtained:

$$BX_2 = BX_1/2, \text{ (for } CX_1 \geq X_IN_2) \quad (60)$$

$$= (CX_1 - BX_1)/2, \text{ (for } CX_1 < X_IN_2)$$

$$CX_2 = CX_1/4, \quad (62)$$

$$BY_2 = BY_1/2, \text{ (for } CX_1 \geq X_IN_2) \quad (63)$$

$$= (CY_1 - BY_1)/2, \text{ (for } CX_1 < X_IN_2) \text{ and} \quad (64)$$

$$CY_2 = CY_1/4. \quad (65)$$

It should be noted that there is no need to redundantly calculate or store the X coordinate AX2 and the Y coordinate AY2 of the control point A2, since the following relationship is established as is the case of expressions:

$$AX_2=2BX_2, \text{ and} \quad (66)$$

$$AY_2=2BY_2 \quad (67)$$

Similar calculations are performed in the third and subsequent parallel displacements and midpoint calculations. Similarly to the second parallel displacement and midpoint calculation, it would be understood that the calculations performed in the i-th parallel displacement and midpoint calculation (for i≥2) are represented by the following expressions:

$$X_IN_i = X_IN_{i-1} - BX_{i-1}, \quad (68)$$

$$BX_1 = BX_{i-1}/2, \text{ (for } CX_{i-1} \geq X_IN_i) \quad (69)$$

$$= (CX_{i-1} - BX_{i-1})/2, \text{ (for } CX_{i-1} < X_IN_i) \quad (70)$$

$$CX_i = CX_{i-1}/4, \quad (71)$$

$$BY_i = BY_{i-1}/2, \text{ (for } CX_{i-1} \geq X_IN_i) \quad (72)$$

$$= (CY_{i-1} - BY_{i-1})/2, \text{ (for } CX_{i-1} < X_IN_i) \text{ and} \quad (73)$$

$$CY_i = CY_{i-1}/4. \quad (74)$$

With respect to the above expressions, in one or more embodiments, the equal sign may be attached to either the inequality sign recited in the above expressions.

Here, in the above expressions imply that the control point C1 is positioned on the segment connecting the origin O to the control point C1–i and that the distance between the control point Ci and the origin O is a quarter of the length of the segment OCi–1. That is, the repetition of the parallel displacement and midpoint calculation makes the control point Ci closer to the origin O. It would be readily understood that such a relationship allows simplification of the calculation of coordinates of the control point C1. It should be also noted that there is no need to calculate or store the coordinates of the points A2 to AN in the second and following parallel displacements and midpoint calculations similarly to the first parallel displacement and midpoint calculation, since the above expressions do not recite the coordinates of the control points Ai and Ai–1.

The voltage data value Y_OUT to be finally obtained by repeating the parallel displacement and midpoint calculation N times is obtained as the Y coordinate value of the control point BN with all the parallel displacements cancelled (which is identical to the Y coordinate of the control point BN illustrated in FIG. 28). That is, the output coordinate value Y_OUT can be calculated the following expression:

$$Y_OUT=BY_0+BY_1+ \ldots +BY_{i-1}. \quad (75)$$

Such an operation can be achieved by performing the following operation in the i-th parallel displacement and midpoint calculation:

$$Y_OUT_1=BY_0, \text{(for } i=1) \text{ and} \quad (76)$$

$$Y_OUT_i=Y_OUT_{i-1}+BY_{i-1}. \text{(for } i \geq 2) \quad (77)$$

In this case, the voltage data value Y_OUT of interest is obtained as Y_OUTN.

Figure 41:
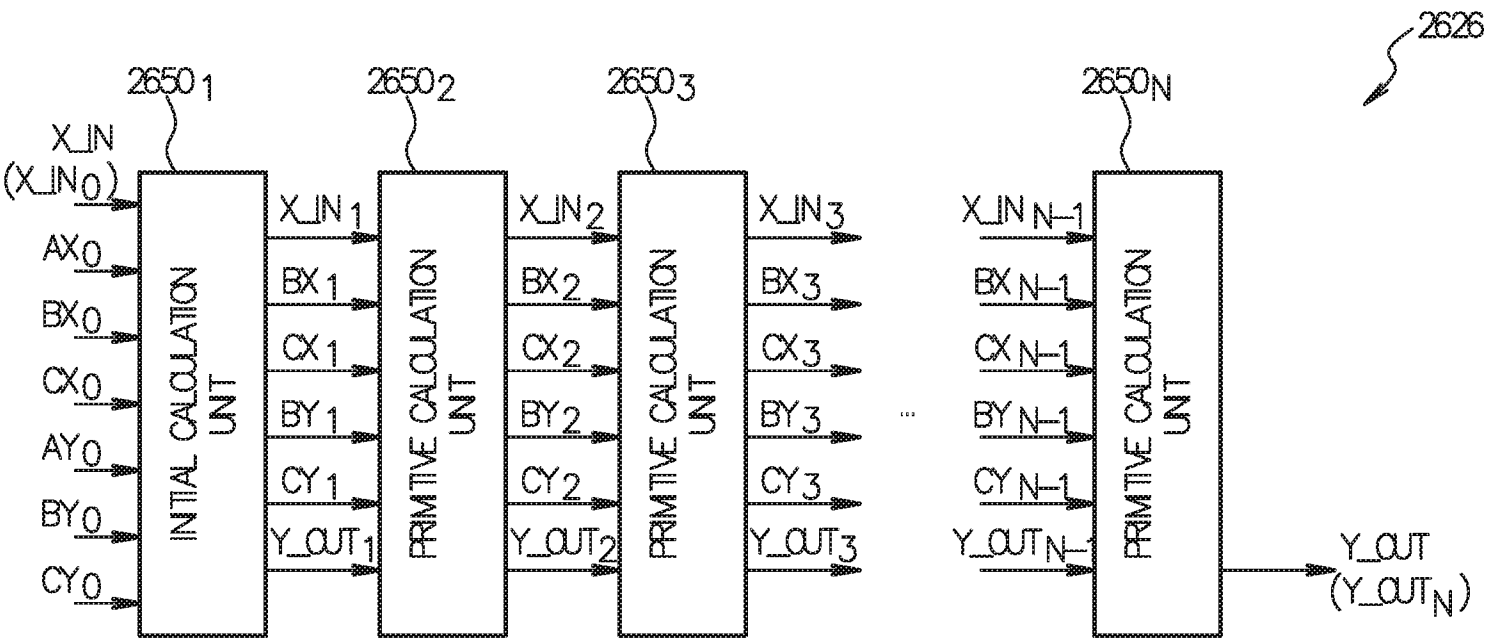
FIG. 41 is a block diagram illustrating the configuration of the Bezier calculation circuit for implementing parallel displacement and midpoint calculation with hardware.

FIG. 41 is a circuit diagram illustrating the configuration of the Bezier calculation circuit 2626 according to one embodiment in which the parallel displacement and midpoint calculation described above are implemented with hardware. The Bezier calculation circuit 2626 illustrated in FIG. 41 includes an initial calculation unit $\mathbf{2650_1}$ and a plurality of primitive calculation units $\mathbf{2650_2}$ to $\mathbf{2650_N}$ serially connected to the output of the initial calculation unit $\mathbf{2650_1}$. The initial calculation unit $\mathbf{2650_1}$ has the function of achieving the first parallel displacement and midpoint calculation and is configured to perform the calculations in accordance with the above expressions. The primitive calculation units $\mathbf{2650_2}$ to $\mathbf{2650_N}$ have the function of achieving the second and following parallel displacements and midpoint calculations and are configured to perform the calculations in accordance with the above expressions.

Figure 42:
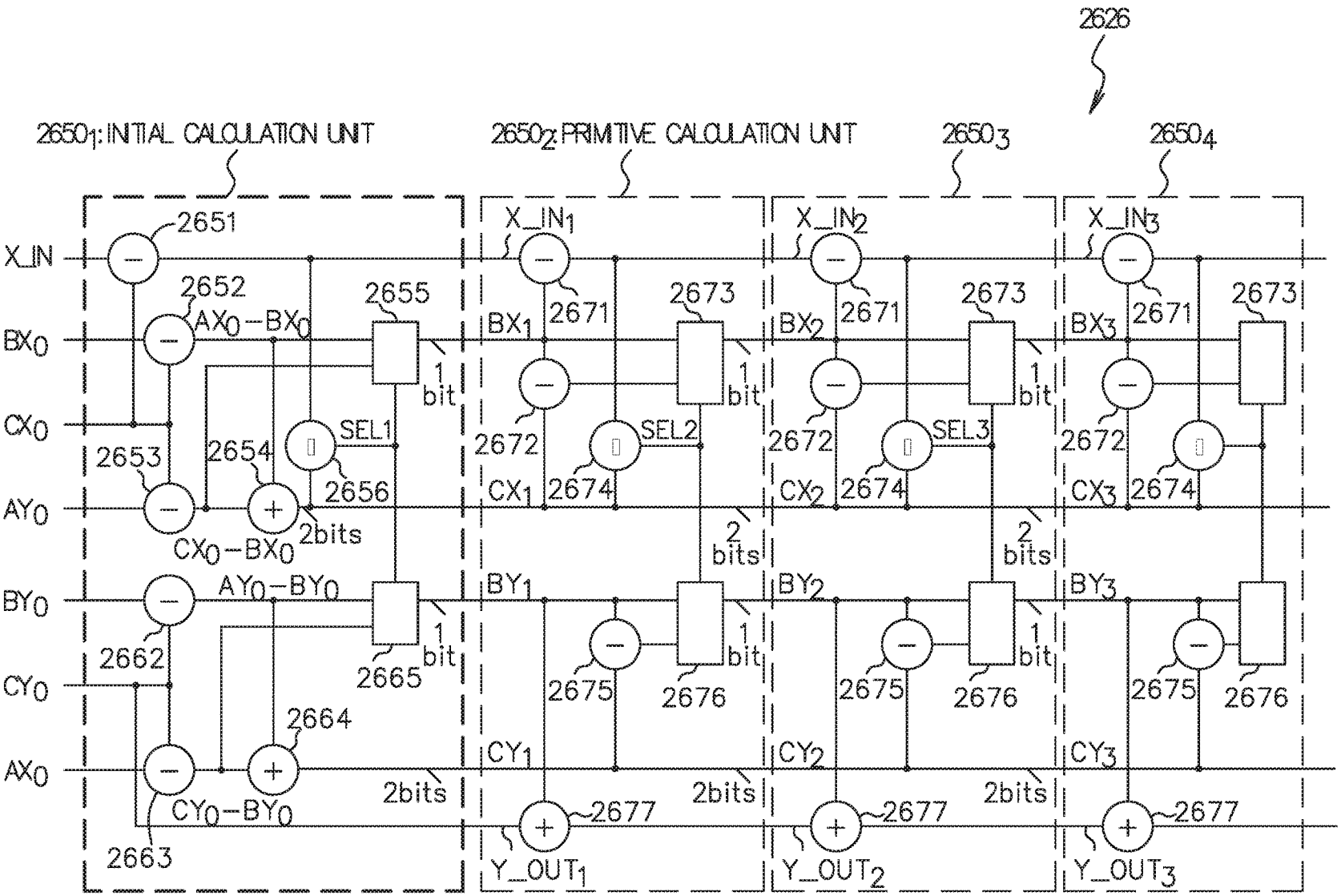
FIG. 42 is a circuit diagram illustrating the configurations of an initial calculation unit and primitive calculation units.

FIG. 42 is a circuit diagram illustrating the configurations of the initial calculation unit 501 and the primitive calculation units $\mathbf{2650_2}$ to $\mathbf{2650_N}$, according to one or more embodiments. The initial calculation unit $\mathbf{2650_1}$ includes subtractors 2651 to 2653, an adder 2654, a selector 2655, a comparator 2656, subtractors 62 and 63, an adder 2664, and a selector 2665. The initial calculation unit $\mathbf{2650_1}$ has seven input terminals; the input grayscale value X_IN is inputted to one of the input terminals, and the X coordinates AXO, BXO and CXO and Y coordinates AYO, BYO, and CYO of the control points AO, BO and CO are supplied to the other six terminals, respectively.

The subtracter 2651 has a first input to which the input grayscale value X_IN is supplied and a second input connected to the input terminal to which BXO is supplied. The subtracter 2652 has a first input connected to the input terminal to which AXO is supplied and a second input connected to the input terminal to which BXO is supplied. The subtracter 2653 has a first input connected to the input terminal to which CXO is supplied and a second input connected to the input terminal to which BXO is supplied. The adder 2654 has a first input connected to the output of the subtracter 2652 and a second input connected to the output of the subtracter 2653.

Similarly, the subtracter 2662 has a first input connected to the input terminal to which AYO is supplied and a second input connected to the input terminal to which BYO is supplied. The subtracter 2663 has a first input connected to the input terminal to which CYO is supplied and a second input connected to the input terminal to which BYO is supplied. The adder 2664 has a first input connected to the output of the subtracter 2662 and a second input connected to the output of the subtracter 2663.

The comparator 2656 has a first input connected to the output of the subtracter 2651 and a second input connected to the output of the adder 2654. The selector 2655 has a first input connected to the output of the subtracter 2652 and a second input connected to the output of the subtracter 2653, and selects the first or second input in response to the output value SEL1 of the comparator 2656. Furthermore, the selector 2665 has a first input connected to the subtracter 2662 and a second input connected to the output of the subtracter 2663, and selects the first or second input in response to the output value SEL1 of the comparator 2656.

The output terminal from which the calculation target grayscale value X_IN1 is outputted is connected to the output of the subtracter 2651. Further, the output terminal from which BX1 is outputted is connected to the output of the selector 2655, and the output terminal from which CX is outputted is connected to the output of the adder 2654. Furthermore, the output terminal from which BY1 is outputted is connected to the output of the selector 2665, and the output terminal thereof from which CY1 is outputted is connected to the output of the adder 2664.

The subtracter 2651 performs the calculation in accordance with the expressions, and the subtracter 2652 performs the calculation in accordance with one or more of the above expressions. The subtracter 2653 performs the calculation in accordance with one or more of the above expressions, and the adder 2654 performs the calculation in accordance with one or more of the above expressions on the basis of the output values of the subtractors 2652 and 2653. Similarly, the subtracter 2662 performs the calculation in accordance with one or more the above expressions. The subtracter 2663 performs the calculation in accordance with one or more the above expressions, and the adder 2664 performs the calculation in accordance with one or more the above expressions on the basis of the output values of the subtractors 2662 and 2663. The comparator 2656 compares the output value of the subtracter 2651 (that is, X_INO−BXO) with the output value of the adder 2654, and instructs the selectors 2655 and 2665 to select which of the two input values thereof is to be outputted as the output value. When X_IN1 is equal to or smaller than (AXO−2BXO+CXO)/4, the selector 2655 selects the output value of the subtracter 2652 and the selector 2665 selects the output value of the subtracter 2662. When X_INO−BXO is larger than (AXO−2BXO+CXO)/4, the selector 55 selects the output value of the subtracter 2653 and the selector 2665 selects the output value of the subtracter 2663. The values selected by the selectors 2655 and 2665 are supplied to the primitive calculation unit $\mathbf{2650}_2$ as BX1 and BY1, respectively. Furthermore, the output values of the adders 2654 and 2664 are supplied to the primitive calculation unit $\mathbf{2650}_2$ as CX1 and CY1, respectively.

In various embodiments, the divisions recited in one or more the above expressions can be realized by truncating lower bits. The positions where the lower bits are truncated in the circuit may be arbitrarily modified as long as calculations equivalent to one or more the above expressions are performed. The initial calculation unit $\mathbf{2650}_1$ illustrated in FIG. 42 is configured to truncate the lowest one bit on the outputs of the selectors 2655 and 2665 and to truncate the lowest two bits on the outputs of the adders 2654 and 2664.

Meanwhile, the primitive calculation units $\mathbf{2650}_2$ to $\mathbf{2650}_N$, which have the same configuration, each include subtractors 2671 and 2672, a selector 2673, a comparator 2674, a subtracter 2675, a selector 2676, and an adder 2677.

In the following, a description is given of the primitive calculation unit 50*i* which performs the i-th parallel displacement and midpoint calculation, where i is an integer from two to N. The subtracter 2671 has a first input connected to the input terminal to which the calculation target grayscale value X_INi−1 is supplied, and a second input connected to the input terminal to which BXi−1 is supplied. The subtracter 2672 has a first input connected to the input terminal to which BXi−1 is supplied, and a second input connected to the input terminal to which CXi−1 is supplied. The subtracter 2675 has a first input connected to the input terminal to which BYi−1 is supplied, and a second input connected to the input terminal to which CYi−1 is supplied.

The comparator 2674 has a first input connected to the output of the subtracter 2671 and a second input connected to the input terminal to which CXi−1 is supplied.

The selector 2673 has a first input connected to the input terminal to which BXi−1 is supplied, and a second input connected to the output of the subtracter 2672, and selects the first or second input in response to the output value SELi of the comparator 2674. Similarly, the selector 2676 has a first input connected to the input terminal to which BYi−1 is supplied, and a second input connected to the output of the subtrater 2675, and selects the first or second input in response to the output value of the comparator 2674.

The calculation target grayscale value X_INi is output from the output terminal connected to the output of the subtracter 2671. BXi is output from the output terminal connected to the output of the selector 2673, and CXi is output from the output terminal connected to the input terminal to which CXi is supplied via an interconnection. In this process, the lower two bits of CXi are truncated. Furthermore, BYi is output from the output terminal connected to the output of the selector 2673, and CYi is output from the output terminal connected to the input terminal to which CYi−1 is supplied via an interconnection. In this process, the lower two bits of CYi−1 are truncated.

Meanwhile, the adder 2677 has a first input connected to the input terminal to which BXi−1 is supplied, and a second input connected to the input terminal to which Y_OUTi−1 is supplied. It should be noted that, with respect to the primitive calculation unit $\mathbf{2650}_2$ which performs the second parallel displacement and midpoint calculation, the Y_OUT1 supplied to the primitive calculation unit $\mathbf{2650}_2$ coincides with $BY_O$. Y_OUTi is outputted from the output of the adder 2677.

The subtracter 2671 performs the calculation in accordance with expression the above expressions, and the subtracter 2672 performs the calculation in accordance with the above expressions. The subtracter 2675 performs the calculation in accordance with the above expressions, and the adder 2677 performs the calculation in accordance with the above expressions. The comparator 2674 compares the output value X_INi (=X_INi−1−BXi−1) of the subtracter 2671 with CXi−1, and instructs the selectors 2673 and 2676 to select which of the two input values thereof is to be outputted as the output value. In one or more embodiments, when X_INi is equal to or smaller than CXi−1, the selector 2673 selects BXi−1 and the selector 2676 selects BYi−1. Further, in embodiments when X_INi is larger than CXi−1, on the other hand, the selector 2673 selects the output value of the subtracter 2672 and the selector 2676 selects the output value of the subtracter 2675. The values selected by the selectors 73 and 2676 are supplied to the next primitive calculation unit 50*i*+1 as BXi and BYi, respectively. Furthermore, the values obtained by truncating the lower two bits of CXi−1 and CYi−1 are supplied to the next primitive calculation unit 50*i*+1 as CXi and CYi, respectively.

In some embodiments, divisions recited in the above expressions can be realized by truncating lower bits. The positions where the lower bits are truncated in the circuit may be arbitrarily modified as long as operations equivalent to any of the above expressions. The primitive calculation unit 2650*i* illustrated in FIG. 42 is configured to truncate the lower one bit on the outputs of the selectors 2673 and 2676 and to truncate the lower two bits on the interconnections receiving CXi−1 and CYi−1.

The effect of reduction in the number of the calculating units would be understood from the comparison of the configuration of the primitive calculation units $\mathbf{2650}_2$ to $\mathbf{2650}_N$ illustrated in FIG. 42 with that of the primitive calculation units $\mathbf{2630}_1$ to $\mathbf{2630}_N$ illustrated in FIG. 39. Besides, in the configuration adapted to the parallel displacement and midpoint calculation as illustrated in FIG. 42, in which each of the primitive calculation units $\mathbf{2650}_2$ to $\mathbf{2650}_N$ is configured to truncate lower bits, the number of bits of data to be handled is more reduced in latter ones of the primitive calculation units $\mathbf{2650}_2$ to $\mathbf{2650}_N$. As thus discussed, the configuration adapted to the parallel displacement and midpoint calculation as illustrated in FIG. 42 allows calculating the voltage data value Y_OUT with reduced hardware utilization.

Although the above-described embodiments recite the cases in which the voltage data value Y_OUT is calculated using the second degree Bezier curve having the shape specified by three control points, the voltage data value Y_OUT may be calculated by using a third or higher degree Bezier curve, alternatively. When an nth degree Bezier curve is used, the X and Y coordinates of (n+1) control points are initially given, and similar midpoint calculations are performed on the (n+1) control points to calculate the voltage data value Y_OUT.

More specifically, when (n+1) control points are given, the midpoint calculation is performed as follows: First order midpoints are each calculated as a midpoint of adjacent two of the (n+1) control points. The number of the first order midpoints is n. Further, second order midpoints are each calculated as a midpoint of adjacent two of the n first order midpoints. The number of the second order midpoint is n−1. In the same way, (n−k) (k+1)-th order midpoints are each calculated as a midpoint of adjacent two of the (n−k+1) k-th order midpoints. This procedure is repeatedly carried out until the single n-th order midpoint is finally calculated. Here, the control point having the smallest X coordinate out of the (n+1) control points is referred to as the minimum control point and the control point having the largest X coordinate is referred to as the maximum control point. Similarly, the k-th order midpoint having the smallest X coordinate out of the k-th order midpoints is referred to as the k-th order minimum midpoint and the k-th order midpoint having the largest X coordinate is referred to as the k-th order maximum midpoint. When the X coordinate value of the n-th order midpoint is smaller than the input grayscale value X_IN, the minimum control point, the first to (n−1)-th order minimum midpoints and the n-th order midpoint are selected as the (n+1) control points for the next step. When the X coordinate of the n-th order midpoint is larger than the input grayscale value X_IN, the n-th order midpoint, the first to (n−1)-th order maximum midpoints and the maximum control point are selected as the (n+1) control points for the next midpoint calculation. The voltage data value Y_OUT is calculated on the basis of the Y coordinate of at least one of the (n+1) control points obtained through n times of the midpoint calculation.

In one or more embodiments, four control points CP(3k) to CP(3k+3) are set to the Bezier calculation circuit 2626. In the following, the four control points CP(3k) to CP(3k+3) are simply referred to control points A0, B0, C0 and D0 and the coordinates of the control points AO, BO, CO, and DO are referred to as (AXO, AYO), (BXO, BYO), (CXO, CYO), and (DXO, DYO), respectively. The coordinates A0(AX0, AY0), B0(BX0, BY0), C0(CX0, CY0) and D0(DX0, DY0) of the control points AO, BO, CO, and DO are respectively represented as follows:

$$A_0(AX_0, AY_0)=(X_{CP(3k)}, Y_{CP(3k)}), \tag{78}$$

$$B_0(BX_0, BY_0)=(X_{CP(3k+1)}, Y_{CP(3k+1)}), \tag{79}$$

$$C_0(CX_0, CY_0)=(X_{CP(3k+2)}, Y_{CP(3k+2)}), \text{ and} \tag{80}$$

$$D_0(DX_0, DY_0)=(X_{CP(3k+3)}, Y_{CP(3k+3)}). \tag{81}$$

Figure 43:
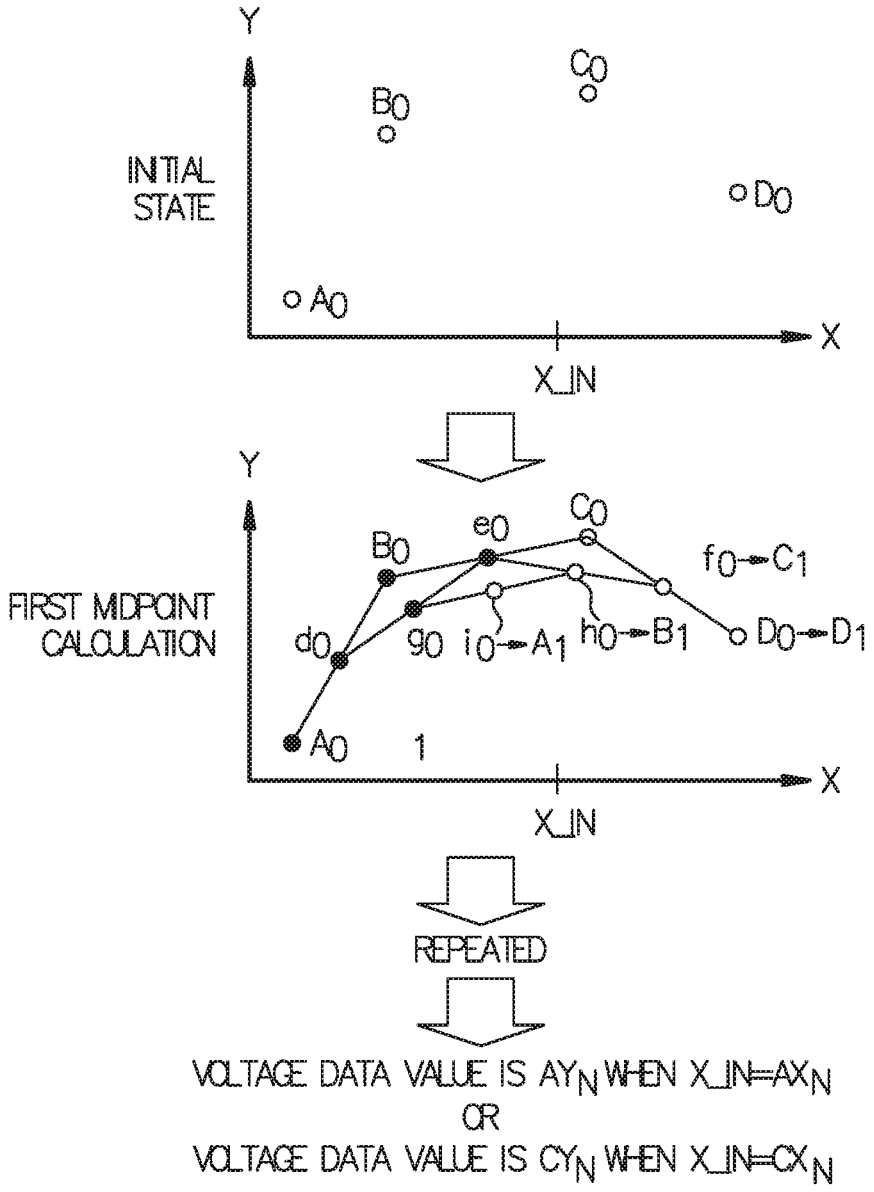
FIG. 43 is a diagram illustrating the midpoint calculation when n=3 (that is, when a third degree Bezier curve is used to calculate the voltage data value)

FIG. 43 is a diagram illustrating the midpoint calculation for n=3 (that is, for the case when the third degree Bezier curve is used to calculate the voltage data value Y_OUT) according to one embodiment. Initially, four control points $A_O$, $B_O$, $C_O$, and $D_O$ are given. It should be noted that the control point $A_O$ is the minimum control point and the point DO is the maximum control point. In the first midpoint calculation, the first order midpoint do that is the midpoint of the control points $A_O$ and $B_O$, the first order midpoint eo that is the midpoint of the control points $B_O$ and $C_O$, and the first order midpoint fo that is the midpoint of the control points $C_O$ and $D_O$ are calculated.

In various embodiments, the first order minimum midpoint and that $f_O$ is the first order maximum midpoint. Further, the second order midpoint $g_O$ that is the midpoint of the first order midpoints $d_O$ and $e_O$ and the second order midpoint hO that is the midpoint of the first order midpoints $e_O$ and $f_O$ are calculated. Here, the midpoint $g_O$ is the second order minimum midpoint and $h_O$ is the second order maximum midpoint. Furthermore, the third order midpoint $i_O$ that is the midpoint between the second order midpoints $g_O$ and $h_O$ is calculated. The third order midpoint $i_O$ is a point on the third degree Bezier curve specified by the four control points $A_O$, $B_O$, $C_O$ and $D_O$ and the coordinates ($Xi_O$, $Yi_O$) of the third order midpoint $i_O$ are represented by the following expressions, respectively:

$$X_{i0}=(AX_0+3BX_0+3CX_0+DX_0)/8, \tag{82}$$

$$Y_{i0}=(AY_0+3BY_0+3CY_0+DY_0)/8. \tag{83}$$

The four control points: points A1, B1, C1 and D1 used in the next midpoint calculation (the second midpoint calculation) are selected according to the result of comparison of the input grayscale value X_IN with the X coordinate $Xi_O$ of the third-order midpoint $i_O$. More specifically, when $Xi_O \geq X_IN$, the minimum control point $A_O$, the first order minimum midpoint $d_O$, the second order minimum midpoint $f_O$, and the third order midpoint $e_O$ are selected as the control points $A_1$, $B_1$, C, and $D_1$, respectively. When $Xi_O < X_IN$, on the other hand, the third order midpoint $e_O$, the second order maximum midpoint $h_O$, the first order maximum midpoint $f_O$, and the maximum control point $D_O$ are selected as the points $A_1$, $B_1$, C, and $D_1$, respectively.

The second and subsequent midpoint calculations are performed by a similar procedure as described above. Generally, the following calculations are performed in the i-th midpoint calculation:

(A) In embodiments where $(AX_{i-1}+3BX_{i-1}+3CX_{i-1}+DX_{i-1})/8 \geq X_IN$, $$AX_i=AX_{i-1}, \quad 84$$

$$BX_i=(AX_{i-1}+BX_{i-1})/2, \quad 85$$

$$CX_i=(AX_{i-1}+2BX_{i-1}+CX_{i-1})/4, \quad 86$$

$$DX_1=(AX_{i-1}+3BX_{i-1}+3CX_{i-1}+DX_{i-1})/8, \quad 87$$

$$AY_i=AY_{i-1}, \quad 88$$

$$BY_i=(AY_{i-1}+BY_{i-1})/2, \quad 89$$

$$CY_i=(AY_{i-1}+2BY_{i-1}+CY_{i-1})/4, \text{ and} \quad 90$$

$$DY_i=(AY_{i-1}+3BY_{i-1}+3CY_{i-1}+DY_{i-1})/8. \quad 91$$

(B) In embodiments where $(AX_{i-1}+3BX_{i-1}+3CX_{i-1}+DX_{i-1})/8 < X_IN$, $$AX_i=(AX_{i-1}+3BX_{i-1}+3CX_{i-1}+DX_{i-1})/8, \quad 92$$

$$BX_i=(BX_{i-1}+2CX_{i-1}+DX_{i-1})/4, \quad 93$$

$$CX_i=(CX_{i-1}+DX_{i-1})/2, \quad 94$$

$$DX_i=DX_{i-1}, \quad 95$$

$$AX_i=(AX_{i-1}+3BX_{i-1}+3CX_{i-1}+DX_{i-1})/8 \quad 96$$

$$BY_i=(BY_{i-1}+2CY_{i-1}+DY_{i-1})/4, \quad 97$$

$$CY_i=(CY_{i-1}+DY_{i-1})/2, \text{ and} \quad 98$$

$$DY_i=DY_{i-1}. \quad 99$$

In various embodiments, the equal sign may be attached to either the inequality sign recited in condition (A) or that in condition (B).

Each midpoint calculation makes the control points Ai, Bi, Ci and Di closer to the third degree Bezier curve and also makes the X coordinate values of the control points Ai, Bi, Ci and Di closer to the input grayscale value X_IN. The voltage data value Y_OUT to be finally calculated is obtained from the Y coordinate of at least one of the control points AN, BN, CN and DN obtained by the N-th midpoint calculation. For example, the voltage data value Y_OUT may be determined as the Y coordinate of an arbitrarily-selected one of the control points AN, BN, CN and DN. Alternatively, the voltage data value Y_OUT may be determined as the average value of the Y coordinates of the control points AN, BN, CN and DN.

In a range in which the number of times N of the midpoint calculations is relatively small, the preciseness of the voltage data value Y_OUT is more improved as the number of times N of the midpoint calculations is increased. It should be noted however that, once the number of times N of the midpoint calculations reaches the number of bits of the voltage data value Y_OUT, the preciseness of the voltage data value Y_OUT is not further improved thereafter. In various embodiments, the number of times N of the midpoint calculations is equal to the number of bits of the voltage data value Y_OUT. In one or more embodiments, in which the voltage data value Y_OUT is a 10-bit data, the number of times N of the midpoint calculations is 10.

In one or more embodiments, when the voltage data value Y_OUT is calculated by using an nth degree Bezier curve, the midpoint calculation may be performed after performing parallel displacement on the control points so that one of the control points is shifted to the origin O similarly to the case when the second-order Bezier curve is used. Further, when the gamma curve is expressed by a third degree Bezier curve, for example, the first to n-th order midpoints are calculated after subjecting the control points to parallel displacement so that the control point Bi−1 or Ci−1 is shifted to the origin O. In various embodiments, either a combination of the control point Ai−1' obtained by the parallel displacement, the first order minimum midpoint, the second order minimum midpoint and the third order midpoint or a combination of the third order midpoint, the second order maximum midpoint, the first order maximum midpoint, and the control point Di−1' are selected as the next control points Ai, Bi, Ci and Di. Also in this case, the number of bits of values processed by each calculating unit is effectively reduced.

In one or more embodiments, in driving a self-light emitting display panel such as an OLED (organic light emitting diode) display panel, data processing may be performed to control the brightness of the screen in the generation of the voltage data DVOUT. A display device may have the function of controlling the brightness of the screen (that is, the entire brightness of the displayed image). A display device may have the function of increasing the brightness of the screen in response to a manual operation, when the user desires to display a brighter image. As for a display device which has a backlight, such as a liquid crystal display panel, data processing for controlling the brightness of the screen may not be necessary, because the brightness of the screen may not be controllable with the brightness of the backlight. In driving a self-emitting display panel such as an OLED display panel, data processing may be performed to generate voltage data DVOUT in response to a desired brightness level of the screen in controlling the drive voltage supplied to each subpixel of each pixel.

Processing to control the brightness of the screen may be performed to generate the voltage data DVOUT, and the correspondence relationship between the input grayscale value X_IN and the voltage data value Y_OUT may be modified depending on the brightness of the screen.

Figure 44:
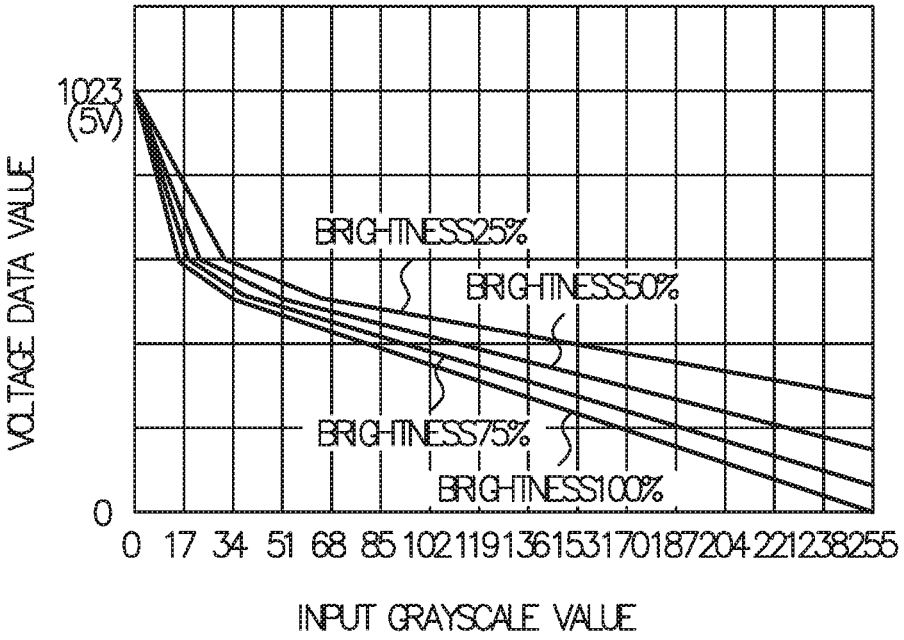
FIG. 44 is a graph illustrating one example of the correspondence relationship between the input grayscale value and the voltage data value, which is specified for each brightness level of the screen.

FIG. 44 is graph illustrating one example of the correspondence relationship between the input grayscale value X_IN and the voltage data value Y_OUT defined for each brightness level of the screen. FIG. 44 illustrates the correspondence relationship between the input grayscale value X_IN and the voltage data value Y_OUT defined for each brightness level for the case when the OLED display panel id driven with voltage programming. In the embodiment of FIG. 44, the graph of the input-output characteristics is presented with an assumption that the voltage data value Y_OUT is 10 bits and each subpixel of each pixel of the OLED display panel is programmed with a voltage proportional to the voltage data value Y_OUT. In one or more embodiments, the voltage data value Y_OUT is "1023", and the target subpixel is programmed with a voltage of 5V.

Figure 45:
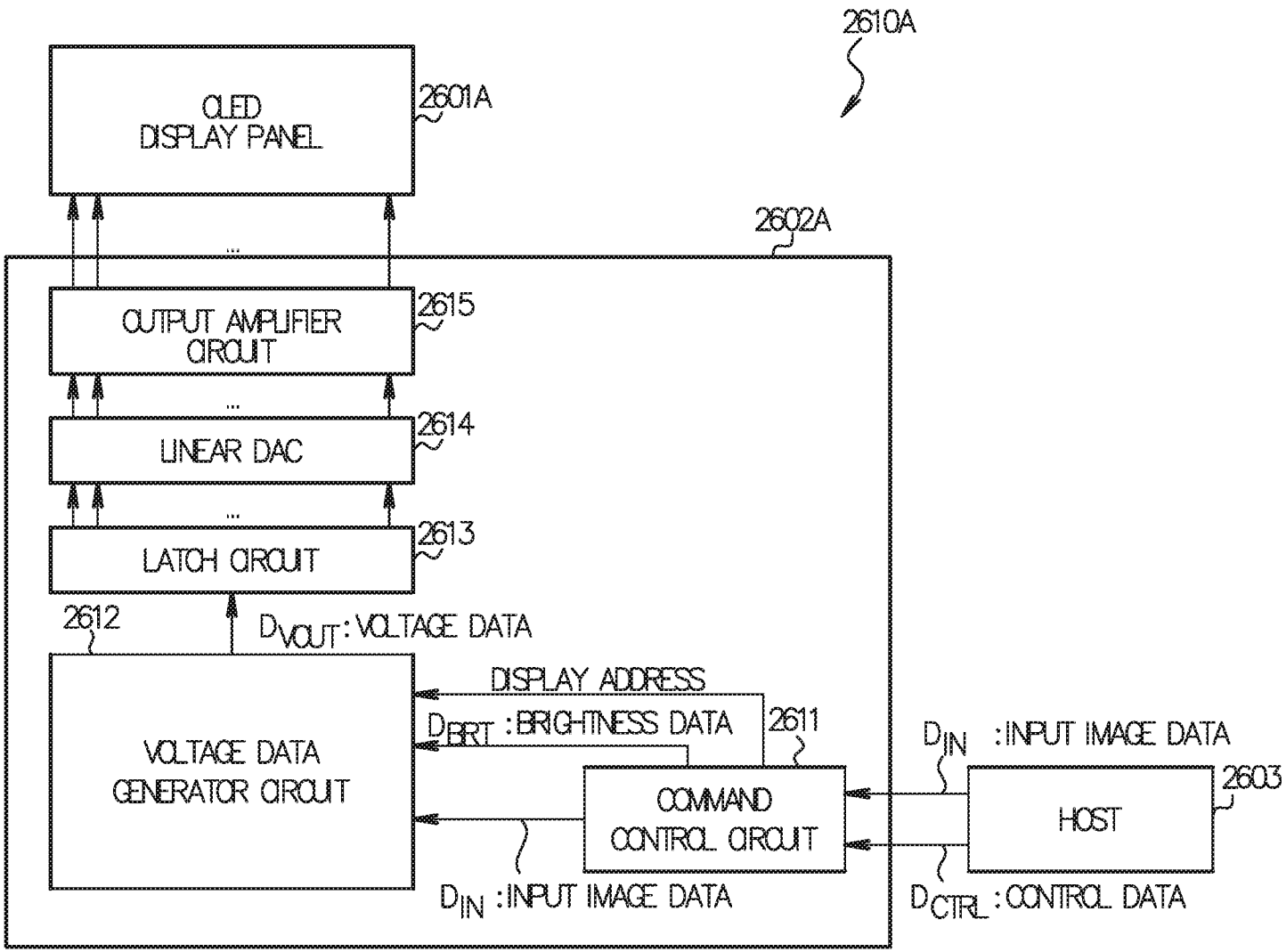
FIG. 45 is a block diagram illustrating the configuration of a display device in a second embodiment.

FIG. 45 is a block diagram illustrating the configuration of a display device 2610A according to one embodiment. The display device 2610A may be configured as an OLED display device including an OLED display panel 2601A and a display driver 2602A. The OLED display panel may be configured as illustrated in FIG. 29, where each pixel circuit 2606 includes a current-driven element, more specifically, an OLED element. The display driver 2602A drives the OLED display panel 2601A in response to the input image data DIN and control data DCTRL received from the host 2603, to display images on the OLED display panel 2601A.

The configuration of the display driver 2602A in FIG. 45 includes a voltage data generator circuit 2612A configured differently from the voltage data generator circuit 2612 of the display driver 2602 in FIG. 30. Additionally, the command control circuit 2611 in the embodiment of FIG. 45 supplies a brightness data which specifies the brightness level of the display screen of the OLED display panel 2601A (that is, the entire brightness of the image displayed on the OLED display panel 2601A). In one embodiment, the control data DCTRL received from the host 2603 may include brightness data DBRT and the command control circuit 2611 may supply the brightness data DBRT included in the control data DCTRL to the voltage data generator circuit 2612A.

Figure 46:
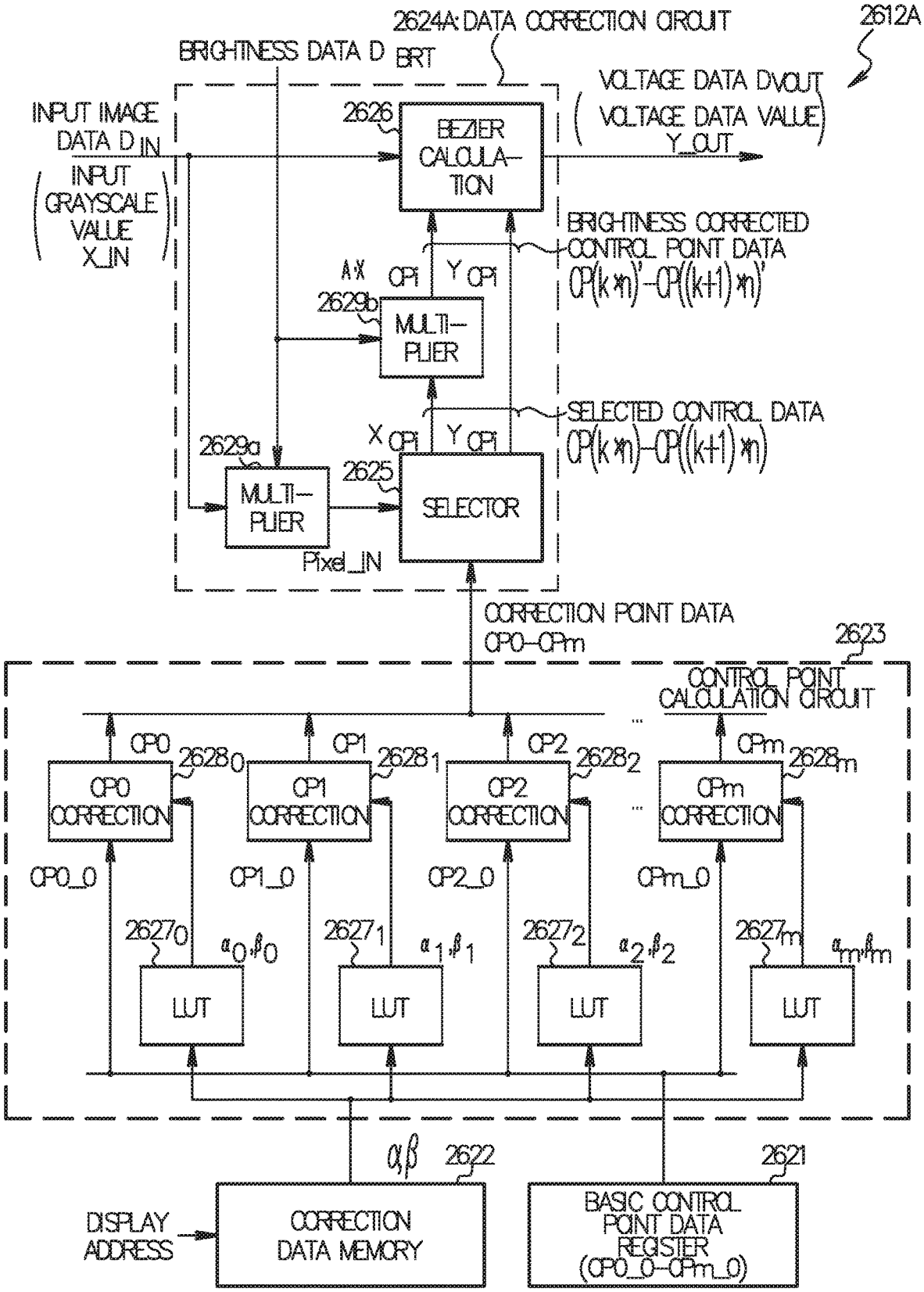

FIG. 46 is a block diagram illustrating the configuration of the voltage data generator circuit 2612A according to one embodiment. The configuration of the voltage data generator circuit 2612A in FIG. 46 is almost similar to that of the voltage data generator circuit 2612 used according to one or more embodiments. In the embodiment of FIG. 46, the coordinates of the basic control points CP0_0 to CPm_0 which specify the correspondence relationship between the input grayscale value X_IN and the voltage data value Y_OUT for the allowed maximum brightness level of the screen are described as the basic control point data CP0_0 to CPm_0.

In one or more embodiments, the data correction circuit 2624A includes multiplier circuits 2629*a* and 2629*b*, in addition to the selector 2625 and the Bezier calculation circuit 2626.

The multiplier circuit 29*a* outputs the value obtained by multiplying the input grayscale value X_IN by 1/A as the control-point-selecting grayscale value Pixel_IN. Note that a detail description will be given of the value A.

The selector 2625 selects selected control point data CP(k×n) to CP((k+1)×n) corresponding to (n+1) control points from among the control point data CP0 to CPm, on the basis of the control-point-selecting grayscale value Pixel_IN. The selected control point data CP(k×n) to CP((k+1)×n) are selected to satisfy the following expression:

$$X_{CP(k\times n)} \leq \text{Pixel_IN} \leq X_{CP((k+1)\times n)}. \quad 100$$

The multiplier circuit 29*b* is used to obtain brightness-corrected control point data CP(k×n)' to CP((k+1)×n)' in response to the brightness data $D_{BRT}$ from the selected control data CP(k×n) to CP((k+1)×n). Note that the brightness-corrected control point data CP(k×n)' to CP((k+1)×n)' are data indicating the coordinates of the brightness-corrected control points CP(k×n)' to CP((k+1)×n)' used to calculate the voltage data value Y_OUT from the input grayscale value X_IN in the Bezier calculation circuit 2626. The multiplier circuit 29*b* calculates the X coordinates of the respective brightness-corrected control points CP(k×n)' to CP((k+1)×n)' by multiplying the X coordinates $X_{CP0}$ to $X_{CPm}$ of the selected coordinates CP(k×n) to CP((k+1)×n) by A. The Y coordinates of the brightness-corrected control points CP(k×n)' to CP((k+1)×n)' are equal to the Y coordinates of the selected control points CP(k×n) to CP((k+1)×n), respectively.

In one or more embodiments, the coordinates CPi'($X_{CPi}$', $Y_{CPi}$') of the brightness-corrected control point CPi' are obtained on the basis of the coordinates CPi($X_{CPi}$, $Y_{CPi}$) of the selected control point CPi by using the following expressions.

$$X_{CPi}' = A \cdot X_{CPi}, \text{ and} \quad 101$$

$$Y_{CPi}' = Y_{CPi} \quad 102$$

The Bezier calculation circuit 2626 calculates the voltage data value Y_OUT corresponding to the input grayscale value X_IN on the basis of the brightness-corrected control data CP(k×n)' to CP((k+1)×n)'. The voltage data value Y_OUT is calculated as the Y coordinate of the point which is positioned on the $n^{th}$ degree Bezier curve specified by the (n+1) brightness-corrected control points CP(k×n)' to CP((k+1)×n)' described in the brightness-corrected control point data CP(k×n)' to CP((k+1)×n)' and has an X coordinate equal to the input grayscale value X_IN.

In various embodiments, when an input grayscale value X_IN of the subpixel of interest is given to the input of the data correction circuit 2624A as the input image data $D_{IN}$, the data correction circuit 2624A outputs the voltage data value Y_OUT as the data value of the voltage data $D_{VOUT}$ corresponding to the subpixel of interest. In the following description of the present embodiment, it is assumed that the input grayscale value X_IN is an eight-bit data and the voltage data value Y_OUT is a 10-bit data.

As is described above, in one or more embodiments, the correspondence relationship between the input grayscale value X_IN and the voltage data value Y_OUT is controlled on the brightness data $D_{BRT}$. Further, the relationship may be based on the control point data CP0 to CPm, in the calculation of the voltage data value Y_OUT performed in the data correction circuit 2624A. For example, the selected control point data CP(k×n) to CP((k+1)×n) are selected from the control point data CP0 to CPm, and the brightness-corrected control point data CP(k×n)' to CP((k+1)×n)' are calculated from the selected control point data CP(k×n) to CP((k+1)×n) and the brightness data $D_{BRT}$ in accordance with the expressions (56a) and (56b).

In one or more embodiments, the voltage data value Y_OUT is calculated as the Y coordinate of the point which is positioned on the nm degree Bezier curve specified by the brightness-corrected control point data CP(k×n)' to CP((k+1)×n)' thus obtained and has an X coordinate equal to the input grayscale value X_IN.

Figure 47:
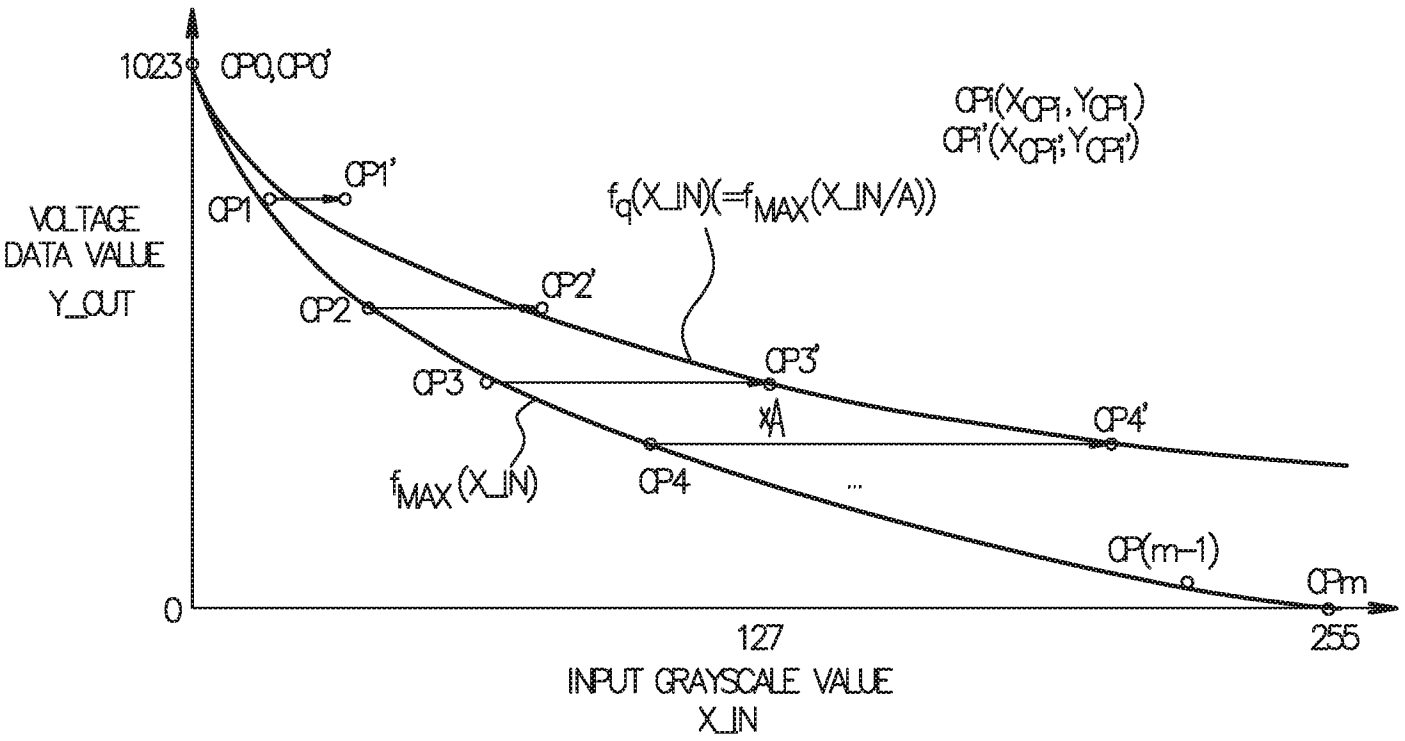
FIG. 47 is a diagram illustrating the relationship between control point data according to one or more embodiments.

FIG. 47 is a diagram illustrating the relationship between the control point data CP0 to CPm and the brightness-corrected control point data CP(k×n)' to CP((k+1)×n)' according to one embodiment.

The control points CP0 to CPm are used to specify the correspondence relationship between the input grayscale value X_IN and the voltage data value Y_OUT for the case when the brightness level of the screen is the allowed maximum brightness level, that is, the allowed maximum brightness level is specified by the brightness data $D_{BRT}$. When the brightness level of the screen is the allowed maximum brightness level (that is, the allowed maximum brightness level is specified by the brightness data $D_{BRT}$), the data correction circuit 2624A calculates the voltage data value Y_OUT as the Y coordinate of the point which is positioned on the curve specified by the control points CP0 to CPm and has an X coordinate equal to the input grayscale value X_IN.

In one embodiment, the data correction circuit 2624A calculates the voltage data value Y_OUT corresponding to the input grayscale value X_IN by using the $n^{th}$ degree Bezier curve specified by the control points CP0 to CPm.

A brightness level other than the allowed maximum brightness level may be specified by the brightness data $D_{BRT}$, and, the data correction circuit 2624A calculates the voltage data value Y_OUT with an assumption that the correspondence relationship between the input grayscale value X_IN and the voltage data value Y_OUT for the specified brightness level is represented by the curve obtained by enlarging the curve specified the control points CP0 to CPm to A times in the X axis direction. In such an embodiment, A is a coefficient depending on the ratio q of the brightness level specified by the brightness data $D_{BRT}$ to the allowed maximum brightness level and obtained by the following expression:

$$A=1/q^{(1/\gamma)}. \quad 103$$

Expression (57) may be obtained on the basis of a consideration that the coefficient A should satisfy the following expression when the gamma value of the display device 2610 is γ:

$$(X_IN/A)^{\gamma}=q\cdot(X_IN)^{\gamma}. \quad 104$$

When the gamma value γ is 2.2 and q is 0.5 (that is, the brightness level of the screen is 0.5 times of the allowed maximum brightness level), for example, A is obtained by the following expression:

$$A=1/(0.5)^{1/2.2},=255/186. \quad 105$$

The data correction circuit 2624A calculates the voltage data value Y_OUT as the Y coordinate of the point which is positioned on the Bezier curve obtained by enlarging the Bezier curve specified by the control points CP0 to CPm by A times in the X axis direction and has an X coordinate equal to the input grayscale value X_IN. In other word, the voltage data value Y_OUT is calculated with an assumption that, when the correspondence relationship between the input grayscale value X_IN and the voltage data value Y_OUT for the case when the brightness level of the screen is the allowed maximum brightness level is represented by the following expression:

$$Y_OUT=f_{MAX}(X_IN), \quad 106$$

then the correspondence relationship between the input grayscale value X_IN and the voltage data value Y_OUT for the case when the brightness level of the screen is q times of the allowed maximum brightness level is represented by the following expression:

$$Y_OUT=f_{MAX}(X_IN/A). \quad 107$$

The Bezier curve represented as the expression "Y_OUT=fMAX(X_IN/A)" can be specified by the control points obtained by multiplying the X coordinates of the control points CP0 to CPm by A. Accordingly, the brightness-corrected control points CP(k×n)' to CP((k+1)×n)', which are obtained by multiplying the X coordinates of the selected control points CP(k×n) to CP((k+1)×n) by A, represent the Bezier curve represented as the expression "Y_OUT=fMAX(X_IN/A)". The voltage data value Y_OUT for the case when the brightness level of the screen is q times of the allowed maximum brightness level can be calculated by calculating the voltage data value Y_OUT in accordance with the Bezier curve specified by the brightness-corrected control points CP(k×n)' to CP((k+1)×n)'.

Figure 48:
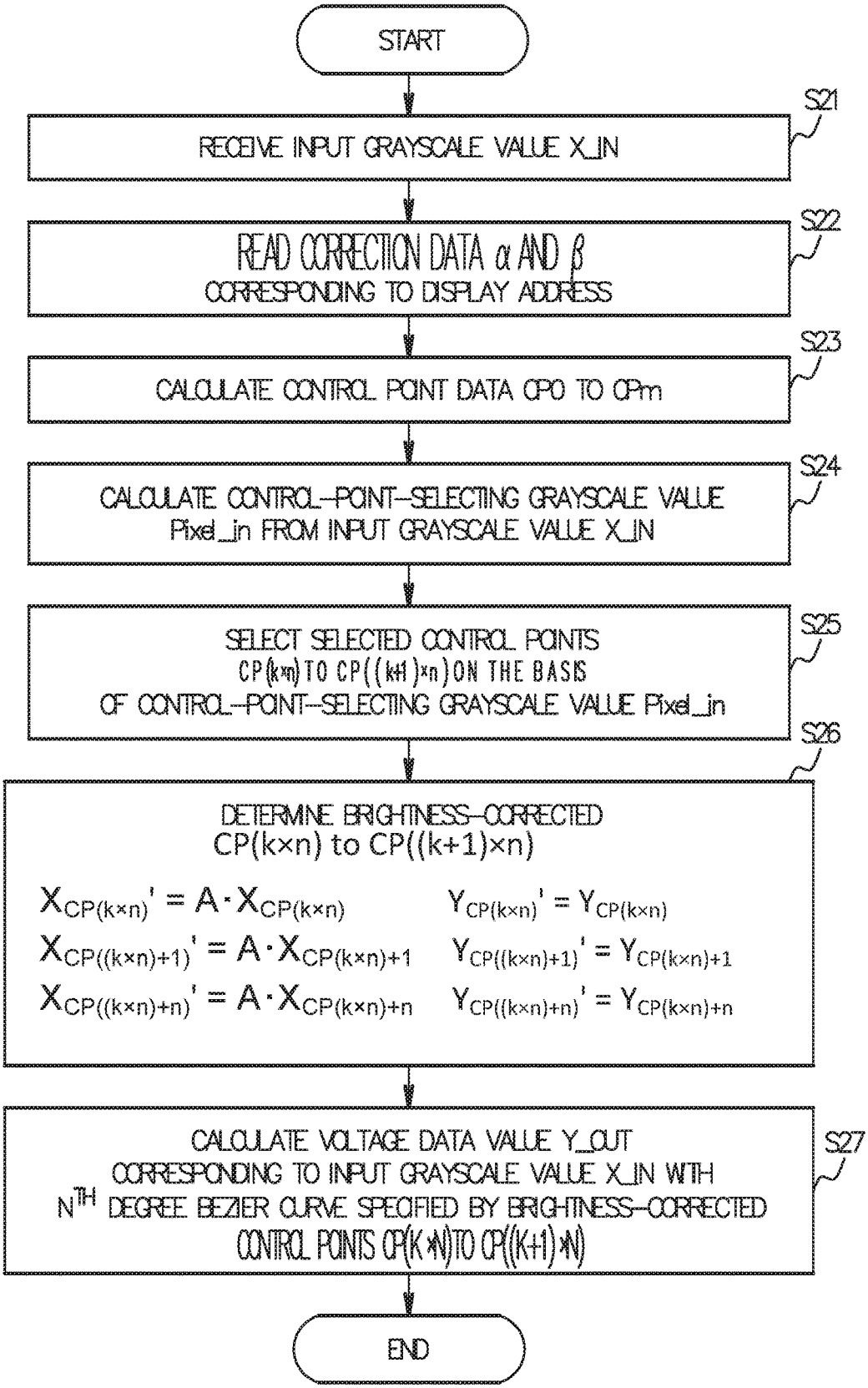
FIG. 48 is a flowchart illustrating the operation of the voltage data generator circuit according to one or more embodiments.

FIG. 48 is a flowchart illustrating the operation of the voltage data generator circuit 2612A illustrated in FIG. 46 according to one embodiment. When the voltage data value Y_OUT specifying the drive voltage to be supplied to a certain subpixel (that is a certain pixel circuit 2606) is calculated, the input grayscale value X_IN associated with the subpixel of interest is supplied to the voltage data generator circuit 2612 (step S21).

The display address corresponding to the subpixel of interest is supplied to the correction data memory 2622 in synchronization with the supply of the input grayscale value X_IN to the voltage data generator circuit 2612A, and the correction data α and β associated with the display address (that is, the correction data α and β associated with the subpixel of interest) are read out (step S22).

The control point data CP0 to CPm actually used for calculating the voltage data value Y_OUT are calculated by correcting the basic control point data CP0_0 to CPm_0 by using the correction data α and β read out from the correction data memory 2622 (step S23). The calculation method of the control point data CP0 to CPm are as described in the first embodiment.

Further, the control-point-selecting grayscale value Pixel_IN is calculated from the input grayscale value X_IN by the multiplier circuit 2629*a* (step S24). As described above, the control-point-selecting grayscale value Pixel_IN is calculated by multiplying the input grayscale value X_IN by the inverse number 1/A (that is, q(1/γ)) of the coefficient A.

Furthermore, (n+1) selected control points CP(k×n) to CP((k+1)×n) are selected from the control points CP0 to CPm on the basis of the control-point-selecting grayscale value Pixel_IN (step S25). The selection of the (n+1) selected control points CP(k×n) to CP((k+1)×n) is achieved by the selector 2625. It should be noted that the operation of selecting the (n+1) selected control points CP(k×n) to CP((k+1)×n) from the control points CP0 to CPm on the basis of the control-point-selecting grayscale value Pixel_IN, which is obtained by multiplying the input grayscale value X_IN by 1/A, is equivalent to the operation of selecting (n+1) selected control points from among control points obtained by multiplying the X coordinates of the control points CP0 to CPm on the basis of the input grayscale value X_IN.

In one or more embodiments, the (n+1) selected control points CP(k×n) to CP((k+1)×n) may be selected as follows.

The control points CP0, CPn, CP(2n) . . . CP(p×n) of the m (=p×n) control points CP0 to CPm are on the nth degree Bezier curve. Other control points are not necessary on the nth degree Bezier curve, although they determine the shape of the nth degree Bezier curve. The selector 2625 compares the control-point-selecting grayscale value Pixel_IN with the X coordinates of the respective control points which are on the nth degree Bezier curve and selects (n+1) control points CP(k×n) to CP((k+1)×n) in response to the result of the comparison.

In one or more embodiments, when the control-point-selecting grayscale value Pixel_IN is larger than the X coordinate of the control point CP0 and smaller than the X coordinate of the control point CPn, the selector 2625 selects the control points CP0 to CPn. When the control-point-selecting grayscale value Pixel_IN is larger than the X coordinate of the control point CPn and smaller than the X coordinate of the control point CP(2n), the selector 2625 selects the control points CPn to CP(2n). Generally, when the control-point-selecting grayscale value Pixel_IN is larger than the X coordinate XCP((k−1)×n) of the control point CP(k×n) and smaller than the X coordinate XCP(k×n) of the control point CP((k+1)×n), the selector 2625 selects the control points CP(k×n) to CP((k+1)×n), where k is an integer from 0 to p.

When the control-point-selecting grayscale value Pixel_IN is equal to the X coordinate XCP(k×n) of the control point CP(k×n), in one embodiment, the selector 2625 selects the control points CP(k×n) to CP((k+1)×n). In this case, when the control-point-selecting grayscale value Pixel_IN is equal to the control point CP(p×n), the selector 2625 selects the control points CP((p−1)×n) to CP(p×n).

Alternatively, in some embodiments, the selector 2625 may select the control points CP(k×n) to CP((k+1)×n), when the control-point-selecting grayscale value Pixel_IN is equal to the X coordinate XCP((k+1)×n) of the control point CP((k+1)×n). In such embodiments, when the control-point-selecting grayscale value Pixel_IN is equal to the control point CP0, the selector 2625 selects the control points CP0 to CPn.

Determining brightness-corrected control points CP(k×n)' to CP((k+1)×n)' (step S26) may be performed after the selector 2625 selects the control points CP0 to CPn. For example, The X coordinates XCP(k×n)' to XCP((k+1)×n)' of the brightness-corrected control points CP(k×n)' to CP((k+1)×n)' are calculated as the products of the coefficient A and the X coordinates XCP(k×n) to XCP((k+1)×n) of the selected control points CP(k×n) to CP((k+1)×n) by the multiplier circuit 2629*b*. In other words, the multiplier circuit 29*b* calculates the X coordinates XCP(k×n)' to XCP((k+1)×n)' of the brightness-corrected control points CP(k×n)' to CP((k+1)×n)' in accordance with the following expression:

$$X_{CP(k\times n)}' = A \cdot X_{CP(k\times n)} \quad 108$$

$$X_{CP((k\times n)+1)}' = A \cdot X_{CP((k\times n)+1)}$$

$$\ldots$$

$$X_{CP((k+1)\times n)}' = A \cdot X_{CP((k+1)\times n)}.$$

The Y coordinates YCP(k×n)' to YCP((k+1)×n)' of the brightness-corrected control points CP(k×n)' to CP((k+1)×n)' are determined as being equal to the Y coordinates YCP(k×n) to YCP((k+1)×n) of the selected control points CP(k×n) to CP((k+1)×n). In other words, the Y coordinates YCP(k×n)' to YCP((k+1)×n)' of the brightness-corrected control points CP(k×n)' to CP((k+1)×n)' are represented by the following expression:

$$Y_{CP(k\times n)}' = Y_{CP(k\times n)}, \quad 109$$

$$Y_{CP((k\times n)+1)}' = Y_{CP((k\times n)+1)},$$

$$\ldots$$

$$Y_{CP((k+1)\times n)}' = Y_{CP((k+1)\times n)}.$$

The X and Y coordinates of the brightness-corrected control points CP(k×n)' to CP((k+1)×n)' thus determined are supplied to the Bezier calculation circuit 2626 and the voltage data value Y_OUT corresponding to the input grayscale value X_IN is calculated by the Bezier calculation circuit 2626 (step S27). The voltage data value Y_OUT is calculated as the Y coordinate of the point which is positioned on the nth degree Bezier curve specified by the (n+1) brightness-corrected control points CP(k×n)' to CP((k+1)×n)' and has an X coordinate equal to the input grayscale value X_IN. The calculation performed in the Bezier calculation circuit 2626 is the same as that performed in other embodiments except for that the brightness-corrected control points CP(k×n)' to CP((k+1)×n)' are used in place of the selected control points CP(k×n) to CP((k+1)×n).

The display device 2610A of one or more embodiments is configured to calculate the brightness-corrected control points CP(k×n)' to CP((k+1)×n)' from the selected control points CP(k×n) to CP((k+1)×n) in response to the brightness data DBRT and this allows calculating the voltage data $D_{VOUT}$ (that is, the voltage data value Y_OUT) which achieves a desired brightness level of the screen.

Although embodiments of the present invention have been specifically described in the above, the present invention is not limited to the above-described embodiment. It would be understood by a person skilled in the art that the present invention may be implemented with various modifications.

What is claimed is:

1. A method for encoding demura calibration information for a display device, the method comprising:

generating demura correction coefficients based on display color information;

separating coherent components of the demura correction coefficients to generate a baseline of each of the demura correction coefficients and residual high-frequency information;

encoding the residual high-frequency information using a first encoding technique; and encoding the baseline of the each of the demura correction coefficients by encoding subpixels having a first color using a second encoding technique and encoding subpixels having a second color using a third encoding technique, wherein the second and third encoding techniques are different from the first encoding technique.

2. The method of claim 1, wherein the baseline of each of the demura correction coefficients and residual high-frequency information comprises a first baseline comprising a first pitch and a second baseline comprising a second pitch different than the first pitch.

3. The method of claim 1, wherein separating the coherent components comprises separating a first profile and a second profile of each of the demura correction coefficients.

4. The method of claim 3, wherein the first profile is a vertical profile and the second profile is a horizontal profile.

5. The method of claim 1, further comprising capturing the display color information from the display device.

6. The method of claim 1, further comprising generating a binary image based on the coherent components and the encoded residual high-frequency information.

7. The method of claim 6, further comprising storing the binary image within a memory of the display device.

8. The method of claim 1, wherein the residual high-frequency information includes first residual high-frequency information for a first subpixel type, second residual high-frequency information for a second subpixel type, and a third residual high-frequency information for a third subpixel type.

9. The method of claim 8, wherein at least one of the first residual high-frequency information, the second residual high-frequency information and the third residual high-frequency information is encoded differently than another one of the first residual high-frequency information, the second residual high-frequency information, and the third residual high-frequency information.

10. The method of claim 1, wherein the demura calibration information includes compressed correction data.

* * * * *